US009885187B2

(12) United States Patent
Kell

(10) Patent No.: US 9,885,187 B2
(45) Date of Patent: Feb. 6, 2018

(54) PANEL FOR COVERING A SURFACE OR SUPPORT AND AN ASSOCIATED JOINT SYSTEM

(71) Applicant: Inotec Global Limited, Hong Kong (HK)

(72) Inventor: Richard William Kell, North Beach (AU)

(73) Assignee: Inotec Global Limited, Hong Kong (HK)

( * ) Notice: Subject to any disclaimer, the term of this patent is extended or adjusted under 35 U.S.C. 154(b) by 0 days.

(21) Appl. No.: 15/450,730

(22) Filed: Mar. 6, 2017

(65) Prior Publication Data

US 2017/0175401 A1 Jun. 22, 2017

Related U.S. Application Data

(63) Continuation of application No. 14/428,705, filed as application No. PCT/AU2013/001073 on Sep. 19, 2013, now abandoned.

(30) Foreign Application Priority Data

Sep. 19, 2012 (AU) ..... 2012904096
Sep. 27, 2012 (AU) ..... 2012904235

(51) Int. Cl.
*E04F 15/02* (2006.01)
*E04F 13/08* (2006.01)
(Continued)

(52) U.S. Cl.
CPC .... *E04F 15/02038* (2013.01); *E04F 13/0894* (2013.01); *E04G 23/0285* (2013.01);
(Continued)

(58) Field of Classification Search
CPC ..... E04F 15/02011; E04F 15/107; E04F 15/02038; E04F 15/0215; E04F 15/10;
(Continued)

(56) References Cited

U.S. PATENT DOCUMENTS 5,616,389 A 4/1997 Blatz ..... 428/45
6,968,664 B2 11/2005 Thiers et al. ..... 52/592.1
(Continued)

FOREIGN PATENT DOCUMENTS

CN 201665978 U 12/2010 ..... E04F 15/02
DE 2516843 A1 10/1976 ..... A63B 5/18
(Continued)

OTHER PUBLICATIONS

International Preliminary Examining Authority, International Preliminary Report on Patentability—International Application No. PCT/AU2012/000280, dated Mar. 8, 2013, 42 pages.
(Continued)

*Primary Examiner* — Joshua J Michener
*Assistant Examiner* — Matthew J Gitlin
(74) *Attorney, Agent, or Firm* — Sunstein Kann Murphy & Timbers LLP

(57) ABSTRACT

A panel 10 is formed with first and second joint systems 20 and 22 to enable engagement of a plurality of panels 10 along their sides 16 and 18. The first joint system 20 has a laterally extending tongue 24*a* along one longitudinal side 16*a* and a groove 24*b* along an opposite longitudinal side 16*b*. The second joint system 22 is a vertical joint system having mutually engageable male and female parts Jm and Jf respectively. The male part Jm is formed on one transverse the side 18*a*, while the female part Jf is formed on an opposite transverse side 18*b*.

29 Claims, 20 Drawing Sheets

(51) Int. Cl.
*E04G 23/02* (2006.01)
*E04F 15/04* (2006.01)

(52) U.S. Cl.
CPC ..... *E04F 15/04* (2013.01); *E04F 2201/0146* (2013.01); *E04F 2201/023* (2013.01); *E04F 2201/042* (2013.01); *E04F 2201/043* (2013.01)

(58) Field of Classification Search
CPC . E04F 15/04; E04F 15/02033; E04F 2201/07; E04F 2201/0146; E04F 2201/041; E04F 13/26; E04G 23/0285; E04G 23/006
USPC .. 52/578, 588.1, 589.1, 590.2, 590.3, 591.4, 52/592.1, 592.4
See application file for complete search history.

(56) References Cited

U.S. PATENT DOCUMENTS

| | | | | |
|---|---|---|---|---|
| 7,398,625 | B2 | 7/2008 | Pervan | 52/578 |
| 7,552,568 | B2 | 6/2009 | Pålsson et al. | 52/589.1 |
| 7,617,651 | B2 | 11/2009 | Grafenauer | 52/592.1 |
| 7,841,145 | B2 | 11/2010 | Pervan et al. | 52/395 |
| 7,874,118 | B2 | 1/2011 | Schitter | 52/578 |
| 7,886,497 | B2 | 2/2011 | Pervan | 52/588.1 |
| 7,980,043 | B2 | 7/2011 | Moebus | 52/588.1 |
| 8,375,672 | B2 | 2/2013 | Hannig | 52/588.1 |
| 8,806,832 | B2 | 8/2014 | Kell | 52/588.1 |
| 9,103,126 | B2 | 8/2015 | Kell | 52/578 |
| 2004/0128934 | A1 | 7/2004 | Hecht | 52/578 |
| 2004/0250492 | A1 | 12/2004 | Becker | 52/578 |
| 2005/0210810 | A1 | 9/2005 | Pervan | 52/578 |
| 2008/0236088 | A1 | 10/2008 | Hannig | 52/592.1 |
| 2008/0241440 | A1 | 10/2008 | Bauer | 428/33 |
| 2009/0133358 | A1 | 5/2009 | Hecht | 52/741.1 |
| 2010/0031594 | A1 | 2/2010 | Liu et al. | 52/403.1 |
| 2010/0083603 | A1 | 4/2010 | Goodwin | 52/589.1 |
| 2011/0131909 | A1 | 6/2011 | Hannig | 52/309.1 |
| 2012/0096801 | A1 | 4/2012 | Cappelle | 52/592.1 |
| 2012/0124932 | A1 | 5/2012 | Schulte et al. | 52/588.1 |
| 2012/0174521 | A1 | 7/2012 | Schulte | 52/588.1 |
| 2012/0266555 | A1 | 10/2012 | Cappelle | 52/309.1 |
| 2012/0317916 | A1 | 12/2012 | Oh | 52/588.1 |
| 2013/0036695 | A1 | 2/2013 | Durnberger | 52/309.3 |
| 2013/0097959 | A1 | 4/2013 | Michel | 52/588.1 |
| 2013/0160390 | A1 | 6/2013 | Stockl | 52/588.1 |
| 2013/0192158 | A1 | 8/2013 | Cappelle et al. | 52/588.1 |
| 2013/0247501 | A1 | 9/2013 | Thiers et al. | 52/588.1 |
| 2015/0218812 | A1 | 8/2015 | Kell | |

FOREIGN PATENT DOCUMENTS

| | | | | |
|---|---|---|---|---|
| EP | 0085196 | A1 | 8/1983 | A47G 27/02 |
| GB | 2436570 | A | 10/2007 | E04F 15/04 |
| WO | WO 01/098604 | A1 | 12/2001 | E04F 15/04 |
| WO | WO 04/053258 | A1 | 6/2004 | E04F 15/04 |
| WO | WO 10/015516 | A2 | 2/2010 | E04F 15/02 |
| WO | WO 12/126046 | A1 | 9/2012 | E04C 2/30 |

OTHER PUBLICATIONS

International Searching Authority, International Search Report—International Application No. PCT/AU2013/001073, dated Dec. 12, 2013, together with the Written Opinion of the International Searching Authority, 11 pages.

PANEL FOR COVERING A SURFACE OR SUPPORT AND AN ASSOCIATED JOINT SYSTEM

CROSS-REFERENCE TO RELATED APPLICATIONS

This application is a continuation of U.S. application Ser. No. 14/428,705, filed Mar. 17, 2015, which in turn is a National Stage of International Application No. PCT/AU2013/001073, filed Sep. 19, 2013, which in turn claims priority to Australian application No. 2012904096, filed Sep. 19, 2012 and claims priority to Australian application No. 2012904235, filed Sep. 27, 2012, the disclosures of which are incorporated by reference herein in their entirety.

TECHNICAL FIELD

The present disclosure relates to a panel for covering a surface or support such as floor, wall or frame. Also disclosed are joint systems of various structures and configurations enabling mechanical joining of the panels.

BACKGROUND ART

A typical panel for covering or lining a floor is in the form of a rectangular plank or strip of material having opposed substantially planar first and second major surfaces with a first and second pairs of opposite sides extending between the first and second major surfaces. Multiple panels are joined to form a floor covering. In order to join panels together each panel is provided with a joint system having joint members that extend from or along the sides. The joint members enable coupling of adjacent substrates.

Joint systems for flooring panels may be generally categorised as tongue and groove systems or vertical joint systems. In this context, the term "tongue" is understood in the industry as meaning 'a protrusion extending distally from a side of a panel spaced inwardly from the top and bottom surfaces of the panel'. This definition was provided by the Honourable Rudolph T. Randa, Chief Judge in the Markman Claim Construction decision in Order nos. 02-C-1266, 03-C-342, 04-C-121-Mar. 6, 2007 in relation to U.S. Pat. Nos. 6,006,486 and 6,490,836 assigned to Unilin Beheer B. V. Indeed in the Markman hearing Unilin themselves proposed the term "tongue" be construed as "a protrusion extending distally form a side spaced inwardly form the top and bottom surfaces and including at least one locking element". Similarly in US International Trade Commission Investigation no. 337-TA-545 it was held that 'tongue' means 'a coupling part extending from the edge of a board, where the coupling part provides primary coupling in the horizontal direction and primary locking the vertical direction' and 'groove' means 'a coupling part that cooperates with the tongue to connection two panels together'.

Tongue and groove systems are available in two main configurations, horizontal systems and lay down systems. In the horizontal system tongues and grooves of like panels are engaged by motion in a plane substantially parallel to a plane containing a major surface of the flooring panel (i.e. a horizontal plane). In a lay down system the tongue and groove are configured to engage by inserting the tongue of one panel into the groove of another like panel with the major surfaces of the respective panels at an acute angle to each other and subsequently pivoting the one panel relative to the other so that the panels are coplanar in order to effect the engagement of joints on adjacent substrates.

Vertical joint systems on the other hand require motion and/or force in a plane perpendicular to a major surface of the substrates to effect engagement of the joints. Thus it should be understood that the expression "vertical" in the context of the present type of joint system, and as used in this specification, does not mean absolutely vertical but rather substantially perpendicular to a major surface of a substrate. During such motion the panels are orientated generally parallel to an underlying surface/support on which they are to be laid.

The above reference to the Background Art is not intended to limit the application of the panels and joint systems disclosed herein.

SUMMARY OF THE DISCLOSURE

In a first aspect there is disclosed a panel for a surface covering system composed of a plurality of like panels, the panel comprising:

opposed substantially planar major first and second surfaces, and a plurality of sides extending between the first and second surfaces, the sides including a first pair of opposite sides, and a second pair of opposite sides;

a tongue and groove joint system comprising a tongue extending laterally parallel to the major surfaces from one of the sides of the first pair and a groove in another one of the sides of the first pair the groove extending parallel to the major surfaces into a body of the panel, the tongue and groove relatively configured to enable mutual engagement by locating the tongue of the panel in a groove of a second like panel; and a vertical joint system extending along opposite sides of the substrate and having mutually engagable male and female parts wherein the male part on one of the sides of the second pair of sides and the female part in on another of the sides of the second pair of sides, the male and female parts being configured to enable mutual engagement in response to a force applied in an engagement direction which is substantially perpendicular to the major surfaces;

the male part having: a male protrusion extending perpendicular to the major surfaces and provided with a distal end; and a male recess inboard of the male protrusion, the female part having: a female protrusion extending perpendicular to the major surfaces and provided with a distal end; and a female recess inboard of the female protrusion, wherein each protrusion has a rounded corner portion at each side of its distal end and the male and female parts are relatively configured so that when in a joined condition at least one space is formed between each protrusion and a surface of a recess in which the protrusion is engaged; and wherein the male and female parts are further relatively configured such that in when in a joined condition the one of the parts overhang the other of the parts about each of a first locking plane that passes through an outer most side of the male protrusion and a second locking plane that passes through an outer most side of the female protrusion, each of the first and second locking planes being perpendicular to the major surfaces.

In one embodiment the overhang of the male and female parts about the first locking plane is between 6% and 18% of the thickness of the panel measured perpendicular to and between the first and second major surfaces.

In one embodiment the overhang of the male and female parts about the second locking plane is between 6% and 18% of the thickness of the panel measured perpendicular to and between the first and second major surfaces.

In one embodiment the male protrusion comprises a planar surface that is contiguous with one of its rounded corner portions and is inclined at an angle γ in the range of 50°±30° and orientated to form part of a concavity on an outermost side of the male protrusion.

In one embodiment the male recess comprises a planar surface that is inclined at an angle φ in the range of 50°±30° and orientated to under lie a rounded corner portion on an outermost side of the female protrusion.

In one embodiment the male and female protrusion each comprise respective mutually facing planar surfaces that face each other when the parts are in a joined condition the respective mutually facing planar surfaces located between the first and second locking planes and lying in a plane that it substantially perpendicular to the major surfaces or inclined thereto in a direction to create a further overhang that acts to inhibit separation of the joined male and female parts.

In one embodiment the mutually facing planar surfaces that face each other have a face to face length of 6% to 18% of the thickness of the panel.

In one embodiment the mutually facing planar surfaces that face each other have a common plane of tangency extending at an angle in the range of 90° to 120° with reference to a plane containing a major surface such that the facing planar surface on the female part overhangs the facing planar surface on the male part when this angle is greater than 90°.

In one embodiment the panel is made of a plastics material including vinyl and PVC and has a thickness of less than 5 mm.

In one embodiment the panel has a thickness in the range of 4 mm to 2 mm inclusive.

In one embodiment the panel has a length to width ratio of less than 1:6 to 1:1.

In one embodiment the male part is provided with an inner most male locking surface on its male recess and the female part is provided with an outermost female locking surface on its male protrusion, the inner most male locking surface and the outermost female locking surface arranged to engage to create the second locking plane, and wherein the outermost female locking surface comprises a convexly curved portion that overhangs a convexly curved portion of the inner most male locking surface.

In one embodiment the inner most male locking surface and the outermost female locking surface are each provided with respective a planar surface portion located between their respective convexly curved portions and a common major surface, the respective plane surfaces being parallel to each other when male and female parts are in the joined condition and juxtaposed with the first major surfaces parallel to each other.

In one embodiment the planar surface of the inner most male locking surface lies inboard of a lateral most point on the convexly curved portion of the inner most male locking surface.

In one embodiment the planar surface of the outer most female locking surface lies inboard of a lateral most point on the convexly curved portion of the outer most female locking surface.

In one embodiment the respective parallel planar surfaces are spaced apart by a distance of between 0.02 mm and 0.2 mm inclusive.

In one embodiment the male and female parts are further configured to form an upper gap between two connected panels when the second major surfaces of the two panels are coplanar, the upper gap comprising a visible portion that is visible at the first major surfaces of two connected panels and extends both in a direction parallel to the first major surfaces and in a direction from the upper surface towards the second major surface and a second contiguous portion that extends from the visible portion to a first contact region between the connected panels.

In one embodiment the visible portion of the gap is widest at the first major surfaces of two connected panels and reduces in width in the direction from the first surface towards the second surface.

In one embodiment the gap is configured to prevent a direct line of sight from the first major surface to the first contact region when the gap is viewed from a standing position on the panels.

In one embodiment the gap follows a path of a configuration such that the direct line of sight impinges a surface of the first or second panel at a location intermediate of the upper surfaces and the first contact region; wherein the visible portion of the gap extends from the first major surface to the intermediate location and the second portion extends from the intermediate location to the first contact region.

In one embodiment the path comprises a bend at the intermediate a location, wherein the visible portion of the gap extends from the upper surfaces to the bend and the bend prevents the direct line of sight from the first major surface to the first contact region.

In one embodiment the bend is created by a surface portion one of the male and female parts that overlies a surface portion of the other of the male and female parts in a plane lying perpendicular to the major upper surfaces.

In one embodiment the female part comprises an inner surface having a first surface portion extending from the upper surface at an obtuse included angle, a second contiguous surface portion extending toward the lower major surface at a steeper angle than the first surface portion, and a contiguous third surface portion that extends toward the male part of a connected second panel.

In one embodiment the female part comprises a fourth surface portion that extends between the third surface portion and the first contact region.

In one embodiment the contact region comprises a datum surface formed on the female part and lying substantially parallel with the first major surface of the corresponding panel the datum surface forming a contact surface for the male part, the male and female parts arranged so that when the male part rests on the datum surface and the second major surfaces of respective corresponding connected panels are parallel, the respective first major surfaces of the connected panels are flush with each other.

In one embodiment the male part comprises an outer surface having first surface portion extending from the first major surface at an obtuse included angle, and an associated contiguous second surface portion extending toward the lower major surface at a steeper angle than the associated first surface portion, the second portion of the female part arranged to overhang the third surface portion of the male part.

In one embodiment the path is a linear path that is inclined relative at an acute angel relative to the first major surfaces, the acute angle arranged so that a direct line of sight impinges the surface of the first or second panel at the intermediate location, wherein the visible portion of the gap extends from the first major surfaces to the intermediate location and the second portion extends from the intermediate location to the first contact region.

In one embodiment the upper gap extends to a depth D1 measured perpendicular from the first major surface of a panel wherein: $0.3T \geq D1 \geq 0.1T$, where T is the thickness of the panel measured perpendicular to the first major surface.

In one embodiment the visible part of the upper gap extends to a depth of between 0.4D1 to 0.8D1.

In one embodiment of the panel the male and female parts are further configured to form a lower gap that extends from the contact region toward the second major surface.

In one embodiment the upper gap a minimum of 0.15 mm-0.2 mm measured parallel to the first major surface.

In one embodiment the lower gap a minimum of 0.15 mm-0.2 mm measured parallel to the first major surface.

In a second aspect there is disclosed a vertical joint system for a panel of a surface covering system the panel having a first major surface and an opposite second major surface and a first pair of opposite sides that lie between the first and second major surfaces, the vertical joint system comprising:

mutually engagable male and female parts wherein the male part is on one of the sides of the first pairs of sides and the female part in on another of the sides of the first pairs of sides, the male and female parts being configured to enable mutual engagement in response to a force applied in an engagement direction which is substantially perpendicular to the major surfaces;

the male part having: a male protrusion extending perpendicular to the major surfaces and provided with a distal end; and a male recess inboard of the male protrusion, the female part having: a female protrusion extending perpendicular to the major surfaces and provided with a distal end; and a female recess inboard of the female protrusion, wherein each protrusion has a rounded corner portion at each side of its distal end and the male and female parts are relatively configured so that when in a joined condition at least one space is formed between each protrusion and a facing surface of a recess in which the protrusion is engaged;

wherein the male and female parts are further relatively configured such that in when in a joined condition one of the parts overhang the other of the parts about each of a first locking plane that passes through an outer most side of the male protrusion and a second locking plane that passes through an outer most side of the female protrusion, each of the first and second locking planes being perpendicular to the major surfaces; and wherein the overhang of the male and female parts about the first and second locking planes is between 4% and 18% of the thickness of the panel measured perpendicular to and between the first and second major surfaces.

In a third aspect there is disclosed a vertical joint system for a panel of a surface covering system the panel having a first major surface and an opposite second major surface and a first pair of opposite sides that lie between the first and second major surfaces, the vertical joint system comprising:

mutually engagable male and female parts wherein the male part is on one of the sides of the first pairs of sides and the female part in on another of the sides of the first pairs of sides, the male and female parts being configured to enable mutual engagement in response to a force applied in an engagement direction which is substantially perpendicular to the major surfaces;

the male part having: a male protrusion extending perpendicular to the major surfaces and provided with a distal end; and a male recess inboard of the male protrusion, the female part having: a female protrusion extending perpendicular to the major surfaces and provided with a distal end; and a female recess inboard of the female protrusion, wherein each protrusion has a rounded corner portion at each side of its distal end and the male and female parts are relatively configured so that when in a joined condition at least one space is formed between each protrusion and a facing surface of a recess in which the protrusion is engaged;

wherein the male and female parts are further relatively configured such that in when in a joined condition one of the parts overhang the other of the parts about each of a first locking plane that passes through an outer most side of the male protrusion and a second locking plane that passes through an outer most side of the female protrusion, each of the first and second locking planes being perpendicular to the major surfaces; and the male protrusion comprises a planar surface that is contiguous with one of its rounded corner portions and is inclined at an angle $\gamma$ in the range of $50° \pm 30°$ and orientated to form part of a concavity on an outermost side of the male protrusion.

In a fourth aspect there is disclosed a vertical joint system for a panel of a surface covering system the panel having a first major surface and an opposite second major surface and a first pair of opposite sides that lie between the first and second major surfaces, the vertical joint system comprising:

mutually engagable male and female parts wherein the male part is on one of the sides of the first pairs of sides and the female part in on another of the sides of the first pairs of sides, the male and female parts being configured to enable mutual engagement in response to a force applied in an engagement direction which is substantially perpendicular to the major surfaces;

the male part having: a male protrusion extending perpendicular to the major surfaces and provided with a distal end; and a male recess inboard of the male protrusion, the female part having: a female protrusion extending perpendicular to the major surfaces and provided with a distal end; and a female recess inboard of the female protrusion, wherein each protrusion has a rounded corner portion at each side of its distal end and the male and female parts are relatively configured so that when in a joined condition at least one space is formed between each protrusion and a facing surface of a recess in which the protrusion is engaged;

wherein the male and female parts are further relatively configured such that in when in a joined condition one of the parts overhang the other of the parts about each of a first locking plane that passes through an outer most side of the male protrusion and a second locking plane that passes through an outer most side of the female protrusion, each of the first and second locking planes being perpendicular to the major surfaces; and wherein the male recess comprises a planar surface that is inclined at an angle $\varphi$ in the range of $50° \pm 30°$ and orientated to under lie a rounded corner portion on an outermost side of the female protrusion.

In a fifth aspect there is disclosed a vertical joint system for a panel of a surface covering system the panel having a first major surface and an opposite second major surface and a first pair of opposite sides that lie between the first and second major surfaces, the vertical joint system comprising:

mutually engagable male and female parts wherein the male part is on one of the sides of the first pairs of sides and the female part in on another of the sides of the first pairs of sides, the male and female parts being configured to enable mutual engagement in response to a force applied in an engagement direction which is substantially perpendicular to the major surfaces;

the male part having: a male protrusion extending perpendicular to the major surfaces and provided with a distal end; and a male recess inboard of the male protrusion, the female part having: a female protrusion extending perpendicular to the major surfaces and provided with a distal end; and a female recess inboard of the female protrusion, wherein each protrusion has a rounded corner portion at each side of its distal end and the male and female parts are relatively configured so that when in a joined condition at least one space is formed between each protrusion and a facing surface of a recess in which the protrusion is engaged;

wherein the male and female parts are further relatively configured such that in when in a joined condition one of the parts overhang the other of the parts about each of a first locking plane that passes through an outer most side of the male protrusion and a second locking plane that passes through an outer most side of the female protrusion, each of the first and second locking planes being perpendicular to the major surfaces; and the male and female parts are further configured to form an upper gap between two connected panels when the second major surfaces of the two panels are coplanar, the upper gap comprising a visible portion that is visible at the first major surfaces of two connected panels and extends both in a direction parallel to the first major surfaces and in a direction from the first major surface towards the second major surface and a second contiguous portion that extends from the visible portion to a first contact region between the connected panels.

In a sixth aspect there is disclosed a vertical joint system for a surface covering system the panel having a first major surface and an opposite second major surface that in use lies on or faces a support and at least two opposite sides that lie between the first and second major surfaces, the vertical joint system comprising:

male and female parts that extend along the first and second sides respectively, the male and female parts configured to enable two like panels to connect to each other with the male part of one panel engaging with the female part of a second panel in a manner to resist separation of the connected panels in a plane parallel to the first major surface and in a plane perpendicular to the first major surface;

the male and female parts further configured to form an upper gap between two connected panels when the second major surfaces of the two panels are coplanar, the upper gap comprising a visible portion that is visible at the first major surfaces of two connected panels and extends both in a direction parallel to the first major surfaces and in a direction from the first major surface towards the second major surface and a second contiguous portion that extends from the visible portion to a first contact region between the connected panels.

In a seventh aspect there is disclosed a flooring panel comprising:

an first major surface and an opposite second major surface that in use lies on or faces a support;

first and second edges that lie between the first and second major surfaces;

male and female parts that extend along the first and second edges respectively, the male and female parts configured to enable two like panels to connect to each other with the male part of one panel engaging with the female part of a second panel in a manner to resist separation of the connected panels in a plane parallel to the first major surface and in a plane perpendicular to the first major surface;

the male part having a recess formed in a direction from the first major surface toward the second major surface and a protrusion extending from the second major surface toward the first major surface and the female part having a recess formed in a direction from the second major surface toward the first major surface and a protrusion extending from the first major surface toward the second major surface; the protrusions of each parts of two like panels configured to fit within the recesses of the other to enable coupling of the two like panels by insertion in a direction perpendicular to the first major surfaces of the panels;

the recess of the male part having an inner most surface and the protrusion of the second coupling having an outer most surface, the male and female parts configured so that when the male part of one panel is engaged with the female part of a like panel the inner and outer surfaces are in mutual facing relationship and are spaced from each other in a direction parallel to the first major surfaces to provide rotational play enabling one of the connected panels to rotate by up to ±3° from a common lay flat condition relative to the other of the connected panels prior to bringing previously spaced portions of the inner and outer surfaces into contact with each other.

In an eight aspect there is disclosed a flooring panel comprising:

a first major surface and an opposite second major surface that in use lies on or faces a support;

first and second edges that lie between the first and second major surfaces;

male and female parts that extend along the first and second edges respectively, the male and female parts configured to enable two like panels to connect to each other with the male part of one panel engaging with the female part of a second panel in a manner to resist separation of the connected panels in a plane parallel to the first major surface and in a plane perpendicular to the first major surface;

the female part having a recess adjacent the first major surface and a protrusion spaced from the first major surface toward the first edge by the recess, and an inner female recess surface extending from the first major surface to a base of the recess, the inner female recess surface having a datum surface lying parallel to the first major surface;

the male part having a protrusion adjacent the first major surface and a recess inboard of the protrusion, the protrusion having an outer male protrusion surface extending from the first major surface toward the second major surface;

male and female parts further configured so that the when the male and female part of like panels are engaged an intermediate portion of the outer male protrusion surface abuts the datum surface, and respective portions of the inner female recess surface and the outer male protrusion surface extending from the first major surface to the datum surface are spaced from each other.

In a ninth aspect there is disclosed a flooring panel comprising:

an first major surface and an opposite second major surface that in use lies on or faces a support;

first and second edges that lie between the first and second major surfaces;

male and female parts that extend along the first and second edges respectively, the male and female parts configured to enable two like panels to connect to each other with the male part of one panel engaging with the female part of a second panel in a manner to resist separation of the connected panels in a plane parallel to the first major surface and in a plane perpendicular to the first major surface;

the female part having: an inner female surface extending from the first major surface toward the second major surface and including a datum surface lying parallel to the first major surface; and, a protrusion spaced form the inner female surface and extending from the second major surface toward the first major surface;

the male part having: an outer male surface extending from the first major surface toward the second major surface; and, a recess spaced from the outer male surface;

the male and female parts being further configured so that the when the male and female part of like panels are engaged, the recess contacts opposite sides of the protrusion, an intermediate portion of the outer male surface abuts the datum surface, and respective portions of the outer male and inner female surfaces extending from the first major surface to the datum surface are spaced from each other.

In a tenth aspect there is disclosed a flooring panel comprising:

an first major surface and an opposite second major surface that in use lies on or faces a support;

first and second edges that lie between the upper and second major surfaces;

male and female parts that extend along the male and second edges respectively, the male and female parts configured to enable two like panels to connect to each other with the male part of one panel engaging with the female part of a second panel in a manner to resist separation of the connected panels in a plane parallel to the first major surface and in a plane perpendicular to the first major surface;

the female part having a recess adjacent the first major surface and a protrusion spaced from the first major surface toward the first edge by the recess, and a recess surface extending from the first major surface to a base of the recess, the recess surface having a datum surface lying parallel to the first major surface;

the male part having a protrusion adjacent the first major surface and a recess inboard of the protrusion, and a protrusion surface extending from the first major surface toward the second major surface;

male and female parts further configured so that the when the male and female part of like panels are engaged, an intermediate portion of the protrusion surface abuts the datum surface, and respective portions of the recess surface and the protrusion surface from the datum surface to the recess base are spaced from each other.

The features of the embodiments of the first aspect of the disclosure as they relate to the vertical joint system of the first aspect or the associated male and female parts, may also constitute features the vertical joint system or the associated male and female parts of the second to tenth aspects.

BRIEF DESCRIPTION OF THE DRAWINGS

Notwithstanding any of forms which may fall within the scope of the panels and joint systems as set forth in the Summary, specific embodiments will now be described, by way of example only, with reference to the accompanying drawings in which:

FIG. 1*b* is an isometric view of the panel shown in FIG. 1*a;*

FIG. 1*c* is an enlarged view of one short end of the panel;

FIG. 1*d* is an enlarged view of one longitudinal side of the panel;

FIG. 1*e* is an enlarged view of an opposite longitudinal side of the panel;

FIG. 1*f* is an enlarged view of an opposite short side of the panel;

DETAILED DESCRIPTION OF SPECIFIC EMBODIMENTS

Figure 1A:
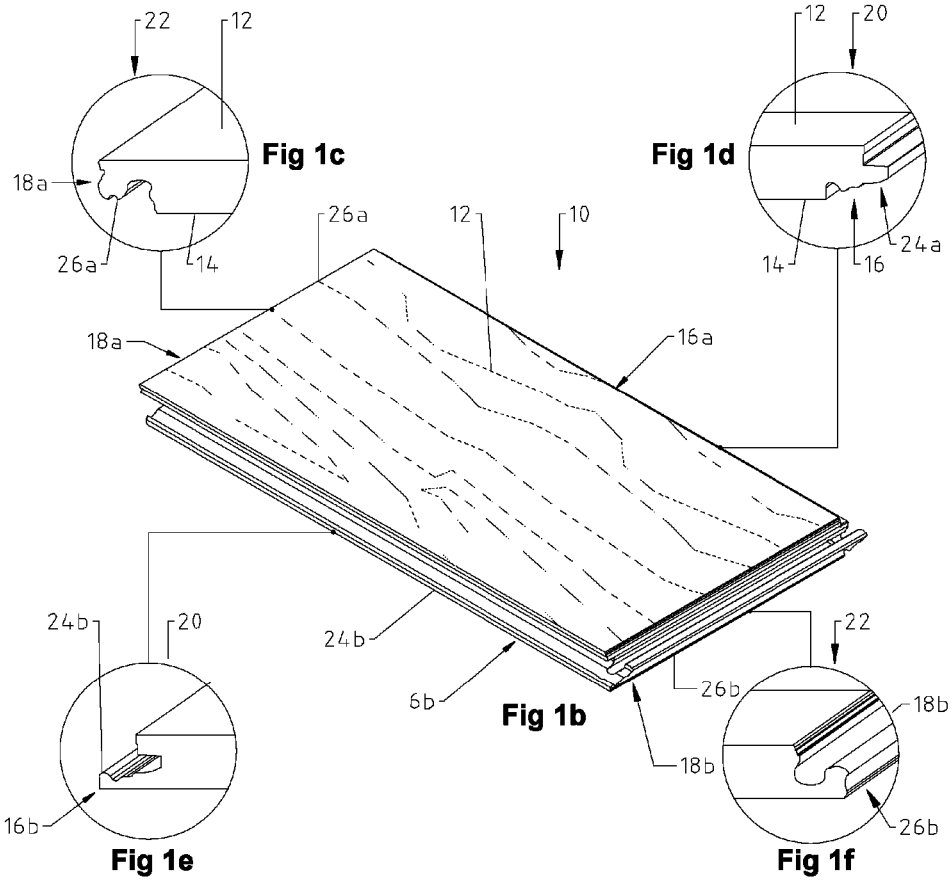
FIG. 1*a* is a plan view of a panel in accordance with a first embodiment of the disclosed panel and associated joint systems.

FIGS. 1*a*-1*f* depict an embodiment of a panel 10 for a surface or support covering system composed of a plurality of like panels. By way of example the panels may be used to cover or line a floor, a wall, a ceiling whether pitched or horizontal or a frame such as created by floor or ceiling joists and batons. However for ease of reference the panels will be described in the context of covering a floor.

The panel 10 is in the form of a plank or strip of material and has opposed substantially planar major first and second surfaces 12 and 14 respectively. The first surface 12 may be considered as an upper surface of the panel 10 and the second major surface 14 can be considered as the bottom surface. When the panel 10 is laid in a floor covering system the first major surface 12 is upper most while the second major surface 14 faces a substrate on which the flooring system is laid. A plurality of sides extend between the major surfaces 12 and 14. The sides include a first pair of opposite sides 16*a* and 16*b* and a second pair of opposite sides 18*a* and 18*b*. The first pair of sides 16*a* and 16*b* (hereinafter referred to in general as "sides 16") form the longitudinal sides of the panel 10. The second pair of sides 18*a* and 18*b* (hereinafter referred to in general as "sides 18") form the short or transverse sides of the panel 10. When the panel 10 is a rectangular panel, the sides 16 extend parallel to each other and perpendicular to the sides 18.

The panel 10 is formed with first and second joint systems 20 and 22 to enable engagement of a plurality of panels 10 along their sides 16 and 18. The first joint system 20 comprises a first member 24*a* extending along the side 16*a*, and a second member 24*b* extending along the side 16*b*. The members 24*a* and 24*b* (hereinafter referred to in general as "members 24") are relatively configured to enable them to engage each other. Depending on their particular form, the members 24 can interlock so as to resist separation in both a direction parallel to the major surfaces 12 and 14 and perpendicular to the major surfaces. In any event, the first member 24*a* of one panel is configured to engage a second member 24*b* on one or more an adjacent panels 10. Both of the joint systems 20 and 22 are formed integrally with the panel. That is the joint systems 20 and 22 do not require the insertion or attachment of separately made parts such a plastics or metal clips in order to perform their respective functions.

The second joint system 22 is formed with mutually engageable male and female parts Jm and Jf respectively. The male part Jm is formed on the side 18*a*, while the female part Jf is formed on side 18*b*.

The first and second joint systems 20 and 22 are of different configuration and operate in a different manner. In general, the first joint system 20 operates by locating the longitudinal sides 16*a* and 16*b* of adjacent panels 10 parallel and adjacent to each other and then inserting the first part 24*a* into the second part 24*b*. The part 24*a* may be considered to be a tongue that extends laterally along the sides 16*a* in a plane generally parallel to the major surfaces 12 and 14, while the second part 24*b* can be considered to be a groove formed along the opposed side 16*b*.

Depending on the specific configuration of the tongue and groove 24*a* and 24*b*, engagement can be effected either by a lay down method which is described in greater detail hereinafter, or by simple lateral sliding of two panels 10 in a common plane toward each other so that the tongue 24*a* locates into the groove 24*b*. The later engagement procedure will for example be possible where the tongue is a simple laterally extending tongue lying between upper and lower surfaces of the panel and having a generally rectangular configuration with planar upper and lower faces.

Figure 2:
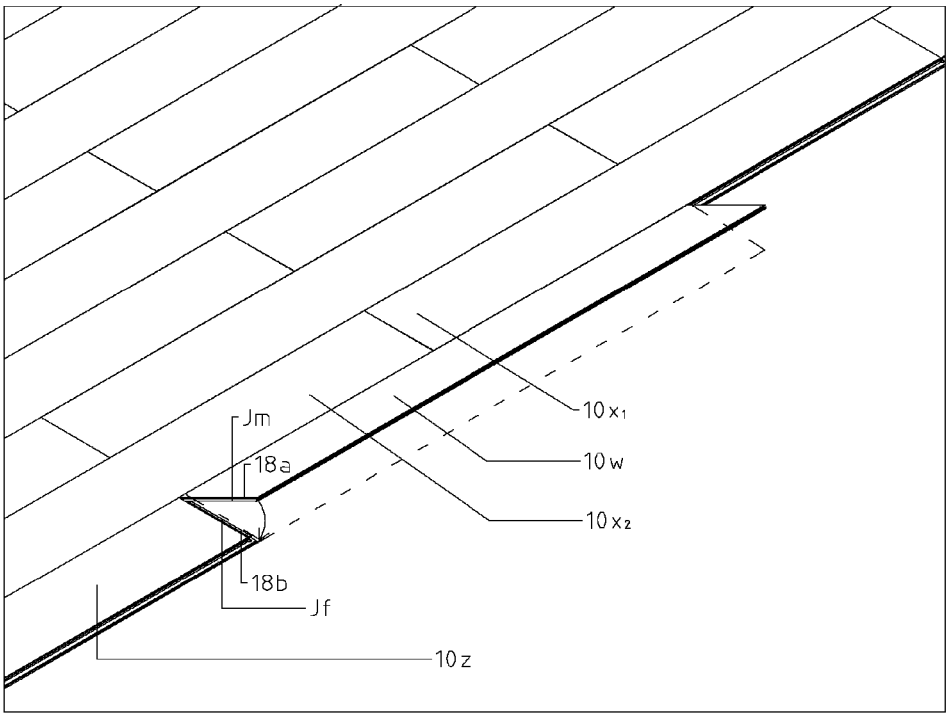
FIG. 2 illustrates a manner of engagement of a plurality of panels to form a floor.
Figure 3A:
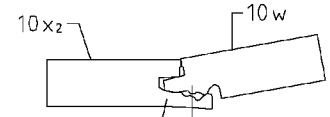
FIGS. 3*a*-3*c* depict the engagement of longitudinal sides of two panels.
Figure 3B:
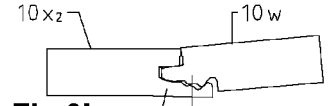
Figure 3C:
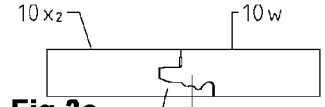

FIG. 2 illustrates the laying of a floor using a plurality of the panels 10. Here, the first joint system 20 engages via the lay down method. The floor in FIG. 2 comprising a plurality of panels 10 all of the same configuration including previously laid and engaged panels 10*x*1, 10*x*2, and 10*z*. Panel 10*w* is now being laid so as to engage each of the panels 10*x*1, 10*x*2, and 10*z*. The first and second members 24 (i.e. tongue 24*a* and groove 24*b*) are configured so that the panel 10*w* is inclined at an obtuse angle to the panels 10*x*1 and 10*x*2 to facilitate insertion of the tongue 24*a* into respective grooves 24*b*. Engagement of the first and second parts is complete by now laying down the panel 10*w* so that it is co-planar with the previously laid panels. This action is equivalent to pivoting the panel 10*w* relative to the panels 10*x*1, 10*x*2, and 10*z* so that they are co-planar. This process of engagement of the first joint system on the panels 10*x*1 and 10*x*2 with the panel 10*w* is depicted sequentially in FIGS. 3*a*-3*c*.

Figure 4A:
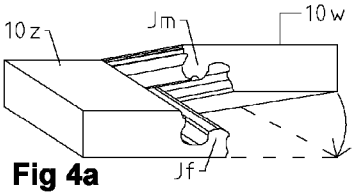
FIGS. 4*a*-4*c* depict sequentially the engagement of short sides of two panels.
Figure 4B:
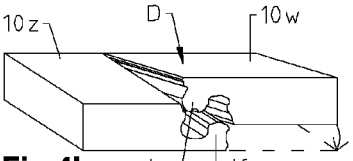
Figure 4C:
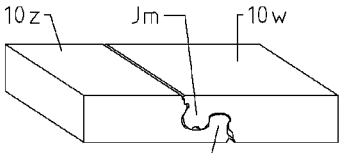

The male and female parts Jm and Jf of the second joint system 22 are configured to engage each other in response to a force applied in an engagement direction shown by arrow D which is substantially perpendicular to the major surfaces 12 and 14. The engagement of the male and female part of the second system on the panels 10*w* and 10*z* is depicted sequentially in FIGS. 4*a*-4*c*. This will be explained later.

The configuration of the first and second joints profiles 22 and 24 will now be described in greater detail.

Figure 5:
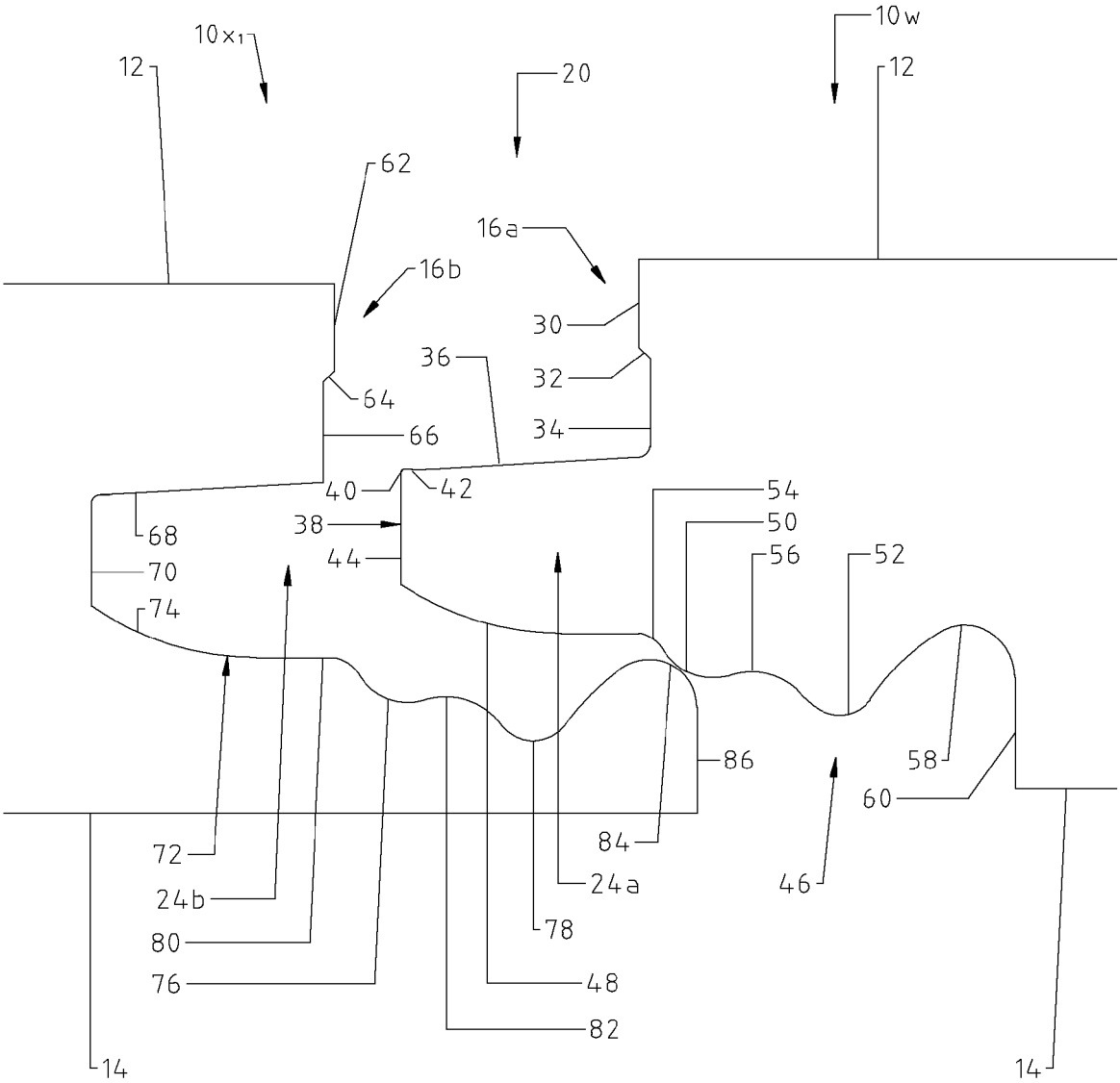
FIG. 5 is an enlarged view of the opposite longitudinal sides of the panel.

FIG. 5 depicts the first joint system 20 along different longitudinal sides on two identical panels 10 prior to engagement. For ease of reference these two panels are separately designated as panels 10*x*1 and 10*w*. Side 16*a* is depicted of panel 10*x*1 and side 16*a* is depicted of panel 10*w*. The first joint system 20 in general comprises a tongue 24*a* and a groove 24*b* along the sides 16*a* and 16*b* respectively. The tongue 24*a* extends generally laterally from side 16*a* and lies between the upper and major sides 12 and 14.

Looking at sides 16*a* first, it is seen that this side initially comprises a substantially vertical surface 30 depending at right angles from the major surface 12. Moving in the direction of the major surface 14, an inwardly sloped surface 32 is formed contiguously with the surface 30. The surface 32 slopes inwardly into the body of a panel 10. Thereafter there is a further substantially vertical planar surface 34 formed contiguously with the surface 32. A lower end of surface 34 terminates is formed contiguously with upper planar surface 36 of the tongue 24*a*. The surface 36 lies parallel to the major surface 12 and forms a right angle with surface 34. A small ridge 40 is formed on the upper surface 36 at a distal end 38 of the tongue 24*a*. A small sloped transition surface 42 extends between the ridge 40 and the surface 36. The transition surface 42 slopes at an obtuse angle relative to the upper surface 36.

The distal end 38 is formed by a planar surface 44 that extends substantially parallel to the surfaces 30 and 34, and perpendicular to the major surfaces 12 and 14. The planar surface 44 leads to an under surface 46 of the tongue 24*a*. The under surface 46 is formed with a wave like profile comprising contiguous convex and concave surfaces. In particular the wave like under surface 46 is formed with three successively lower troughs 48, 50 and 52 when viewed in a direction from the upper surface 12 toward the lower surface 14. Thus the term "successively lower" means either successively closer to the major surface 14, or successively more distant from the major surface 12.

In between the troughs 48 and 50 is a peak 54 and between the troughs 50 and 52 is a further peak 56. The peak 56 is below the peak 54. Following the trough 52 the wave like surface 56 is provided with a further peak 58 that is higher than both of the peaks 54 and 56. Thereafter, the under surface 46 is formed with a generally planar vertical surface 60 that leads to the major surface 14.

The side 16*b* immediately adjacent the upper surface 12 is formed with a substantially vertical downwardly extending surface 62. Moving in the direction of the corresponding major surface 14, and formed contiguous with the surface 62 is an inwardly sloped surface 64. The surface 64 slopes inwardly into the body of the panel. Contiguous with the surface 64 is a further substantially vertical planar surface 66. Surface 66 transitions at a right angle to a planar upper surface 68 of the groove 24*b*. The upper surface 68 extends inwardly of the body of panel for a distance longer than the distance between surfaces 34 and 44 of the tongue 24*a*. The surface 68 lies in a plane generally parallel to the major surfaces 12 and 14. At an innermost end of the surface 68, the groove 24*b* is formed with a contiguous substantially vertical surface 70. The lower end of the surface 70 is formed contiguously with a lower surface 72 of the groove 64*b*. The lower surface 72 has a wave like profile which is substantially although not precisely complementary to the wave like profile of surface 46.

When viewed in a direction form the upper surface 12 toward the lower surface 14, the wave like lower surface 72 is formed with a plurality of troughs 74, 76 and 78 which are sequentially lower (i.e. closer toward the major surface 14). The surface 72 is also formed with three peaks 80, 82 and 84. The peak 80 is between the two troughs 74 and 76; the peak 82 is between troughs 76 and 78; and the peak 84 follows from the trough 78. Following from the peak 84, the side 16*b* terminates with a vertical planar surface 86 that leads to the major surface 14.

The peak 84 is raised above or at a level higher than the peaks 80 and 82. Further, the peaks and troughs of the surfaces 46 and 72 are relatively located so that when the tongue 24*a* is fully engaged with the groove 24*b* the surfaces 46 and 74 from at least the troughs 48 and 72 to the peaks 58 and 84 are in substantial face to face contact. This configuration is shown for example in FIG. 3*c*. It will be appreciated that when the joint 20 is engaged in this manner the tongue 24*a* and groove 24*b* interlock to resist separation of the engaged panels 10*a* and 10*b* in both a direction perpendicular to the major surfaces 12, 14; and a direction parallel to the major surfaces 12 and 14. Also, when in the engaged configuration there is a gap between the planar surfaces 60 and 86; another gap between the planar surfaces 34 and 66; and a gap between surface 44 and 70. Planar surfaces 30 and 62 are in face to face contact.

Figure 6:
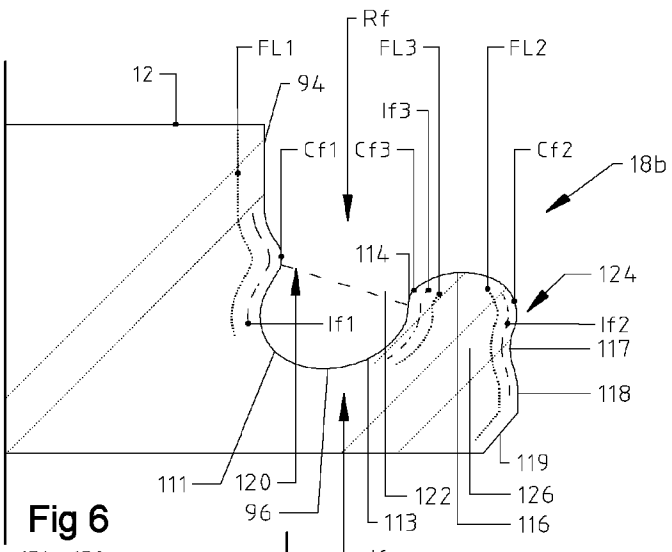
FIG. 6 is an enlarged view of one of the short sides of the panel.
Figure 7:
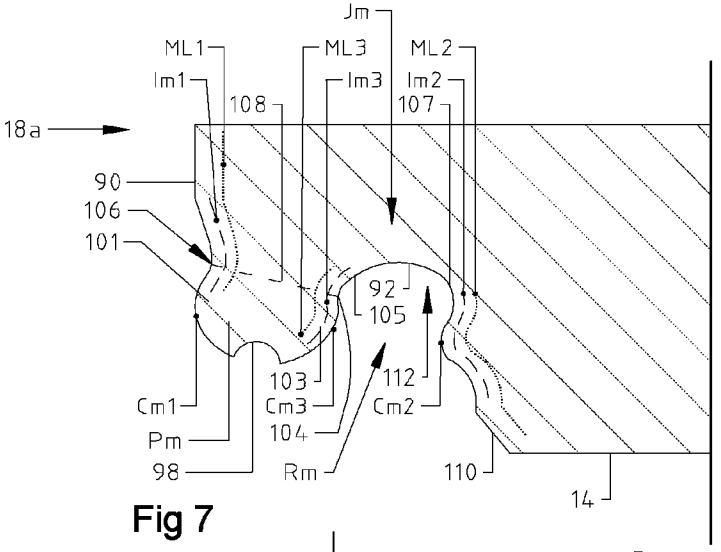
FIG. 7 is an enlarged view of an opposite short side of the panel.
Figure 8:
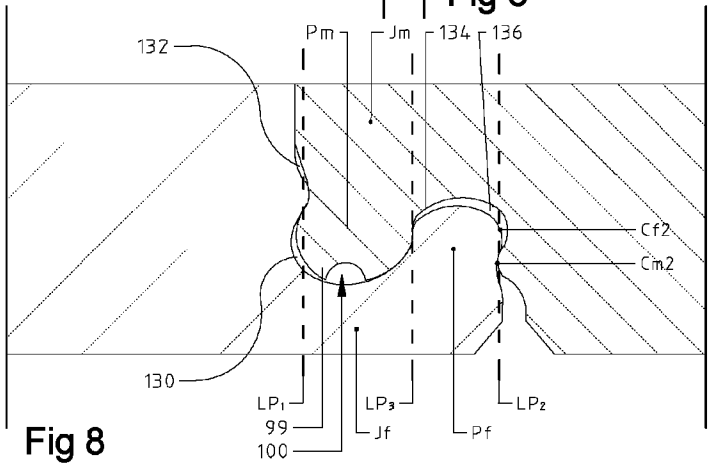
FIG. 8 illustrates the short sides of two panels in an engaged state.

The second joint system 22 is shown in more detail in FIGS. 6 to 8. As previously described, the second joint system 22 comprises a male part Jm and a female part Jf. The male part Jm is formed on the short or transverse side 18*a* of the panel 10 while the female part Jf is formed on the opposite short or transverse side 18*b*.

The male part Jm comprises a male protrusion Pm and a male recess Rm, while the female Jf comprises a female protrusion Pf and a female recess Rf. The male part Jm is notionally designated as the male joint by virtue of its protrusion Pm depending from the upper major surface 12. The second part Jf is notionally designated as the female joint by virtue of its recess Rf being configured to receive the protrusion Pm.

When describing features or characteristic common to all protrusions, the protrusions will be referred to in general in this specification in the singular as "protrusion P", and in the plural as "protrusions P". When describing features or characteristic common to all recesses, the recesses will be referred to in general in this specification in the singular as "recess R", and in the plural as "recesses R". When describing features or characteristic common to both part Jm and Jf, the parts will be referred to in general in this specification in the singular as "part J", and in the plural as "parts J".

The male part Jm has first (or outer most), second (or inner most) and intermediate male locking surfaces ML1, ML2 and ML3 respectively (referred to in general as "male locking surfaces ML"). Each of the male locking surfaces ML extends continuously in the general direction perpendicular to the major surfaces. Similarly the female part Jf has first (or inner most), second (or outer most) and intermediate female locking surfaces FL1, FL2 and FL3 respectively, (referred to in general as "female locking surfaces FL"). The male and female locking surfaces collectively and generally are referred to locking surfaces L. Each of the locking surfaces L extends continuously in the general direction perpendicular to the major surfaces.

The male locking surface ML1 extends from an edge of the major surface 12 adjacent the protrusion Pm and down the adjacent side of the protrusion Pm. The locking surface ML1 extends continuously in the general direction perpendicular to the major surface 12, without returning upon itself. Thus every point on the surface ML1 lies on a different horizontal plane. In contrast, in the event that a hook or barb like structure were provided then the corresponding surface would turn upon itself and a plane parallel to the major surface 14 would insect the surface at three different locations. Further no point along the surface ML1 extends in a lateral direction beyond a plane containing the adjacent edge of surface 12 and lying perpendicular to the surface 12.

The male locking surface ML2 extends from the second major surface 14 up along an adjacent side of the recess Rm to a point prior to the recess Rm. The intermediate male surface ML3 extends along a shared or common surface between a protrusion Pm and Rm.

As will be explained shortly, the first and second male and female locking surfaces engage about respective locking planes inhibiting vertical separation of engaged parts Jm and Jf. The intermediate male and female locking surfaces ML3 and FL3 may also be configured to form a third locking plane. Also, the locking surfaces L in various embodiments comprise inflexion surfaces which in turn may comprise transverse outward extending surfaces which may take the form of convex or cam surfaces, or bulges. The relationship between the locking surfaces L, inflexion surfaces and transverse outward extending surfaces will be apparent in the following description.

Looking at the configuration of the male and female parts Jm and Jf (referred to in general as "parts J") more closely, it will be seen that each of these parts is provided with two laterally spaced apart transversely outward extending surfaces or bulges. The transversely extending surfaces bulges may also be considered and termed as "cam surfaces" as they move across and in contact with each other and at times often with a rolling or pivoting action. The transversely extending surfaces are designated as Cm1 and Cm2 on the male part Jm and Cf1 and Cf2 on the female part Jf. In some embodiments transversely extending surfaces are smoothly curved convex surfaces. However as will be apparent from the following description is some embodiments the transversely extending surfaces are of other configurations. For example a transversely extending surface may be generally convex in that the surface is not continuously or smoothly curved for its entire length but is composed of one or more straight/planar surfaces. For ease of reference the transversely extending surfaces on the male part Jm will be referred to "surface Cmi" where i=1, 2 and similarly the transversely extending surfaces on the female part Jf will be referred to "surface Cfi" where i=1, 2.

The surface Cm1 is formed on an outermost side of male protrusion Pm while the surface Cm2 is formed in an innermost side of male recess Rm. Similarly the surface Cf2 is formed on an outermost side of female protrusion Pf while the surface Cf1 is formed in an innermost side of the female recess Rf. (For ease of description the surfaces Cm2 and Cm1 will be referred to in general as "surfaces Cm"; surfaces Cf1 and Cf2 will be referred to in general as "surfaces Cf"; and collectively the surfaces Cm2, Cm1, Cf1 and Cf2 will be referred to in general as "surfaces C").

The protrusion Pm is provided with rounded or curved corners by virtue of the smoothly curved can surfaces Cm1 and Cm2. Likewise the protrusion Pf is provide with rounded or curved corners by virtue of the smoothly curved can surfaces Cf2 and Cf3. Also the distal ends of the protrusions Pm and Pf between their respective corners are each of a generally convex shape or configuration.

FIG. 8 depicts the second joint system 22 and in particular male and female parts Jm and Jf in an engaged state. As is evident when the parts J are engaged their respective transversely extending surfaces Cm2, Cm1, Cf1 and Cf2 are located relative to each other to form respective first and second locking planes LP1 and LP2 which inhibit the separation of the engaged parts in a direction opposite the engagement direction.

Each locking plane LP1, LP2 lies parallel to the engagement direction D. The transversely extending surfaces Cm1, Cf1, Cm2, Cf2 associated with each locking plane extend laterally toward each other from opposite sides of the locking plane with the transversely extending surfaces of the second or female part (i.e. Cf1 and Cf2) overhanging the transversely extending surfaces of the first or male part (i.e. Cm1 and Cm2). This inhibits separation of the engaged parts Jm and Jf. It will also be noted that at least one of the transversely extending surfaces associated with each locking plane has a curved profile. In this instance the both surface Cm1 and Cf1 associated with locking plane LP1, and both surfaces Cf2 and Cm2 associated with locking plane LP2 have convexly curved profiles.

During the engagement of the parts Jm and Jf the surfaces Cm1 and Cm2 pass and snap over the surfaces Cf1 and Cf2. This action is enabled by one or both of resilient compression of the protrusions Pm and Pf and resilient tension in the recesses Rm and Rf as the surfaces Cm pass the surfaces Cf in response to application of the force F. Whether there is one or both of resilient compression of the protrusions Pm and Pf and resilient tension in the recesses Rm and Rf during the engagement process is dependent on the material from which the panel 12 is made. (As explained later after engagement there may not necessarily be any substantive compression or tension in the joint.) For example in the case of a panel made from a very stiff or hard material such as compressed bamboo or non-compressed bamboo (hereinafter referred to in general as "bamboo") during engagement there would be very little compression of the protrusions P but tension in the recess R which results in its opening or widening would allow for the engagement.

The ability for the protrusions P to enter the recesses R may be assisted by optional provision of a lubricant such as but not limited to wax, graphite, talcum powder, petroleum jelly such as marketed under the trade mark VASELINE and other oil based products, water based products, silicon based products on the parts Jm and Jf. In particular it is believe that lubricants such as petroleum jelly and other oil based products, water based products, silicon based products are well suited to panels made from plastics material including vinyl, PVC and Luxury Vinyl Tile "LVT". When applying petroleum jelly to plastics material panels, the jelly can first be heated to transition from its room temperature solid state to a liquid state product. The liquid state product is then sprayed onto one or both if the parts Jm and Jf and subsequently allowed to cool and reform as a solid coating on the parts Jm and Jf. This may be achieved by use of a machine such as or similar to the flooring wax machine KFL 1300 manufactured by the WUXI SHENGJIN MACHINERY Co. LTD.

When the panels 10 are made of hard wood, bamboo or manufactured hard wood such as, laminates, MDF, HDF, the provision of the lubricant, particularly in the case of wax, also assists completing a mechanical engagement between the joints Jm and Jf by filling voids or other spaces formed by virtue of the non-complementary configuration of the joints Jm and Jf. In addition to the materials mentioned above, embodiments of the panels 10 disclosed herein may be made from other materials such wood plastic composite (WPC), masonry plastic composite, bamboo plastic composite and plastics materials including vinyl and Luxury Vinyl Tile ("LVT"); and natural or synthetic rubber and rubber compounds. The wood or wood bases panels are typically rigid whereas the plastics and composite material (including plastic composites) panels may be either rigid or pliable depending on their specific composition. Also while a plastics panel may be quite rigid it may nonetheless have pliable joint systems 20 or 22. This may arise either due to the use of multiple layers of different types of materials in the panel or simply due to the joint systems being of reduced material thickness to the remainder of the panels.

One example of a pliable plastics material that may be used for the surface covering panels is described in U.S. Pat. No. 8,156,710. In brief this panel comprises of a wear layer, a pattern layer, a base layer, and a backing layer including a bottom surface. The base layer is made of a mixture comprised of ilmenite powder and is sandwiched between the pattern layer and the backing layer, so that the base layer is covered on one side by the pattern layer and on an opposing side by the backing layer. However the pattern layer and the backing layer do not include ilmenite. The bottom surface of the backing layer is exposed and includes a plurality of hexagonal shaped devices that form a honeycomb structure. In use the honeycomb structure contacts an underlying surface on which the panels are laid.

An example of a plastics composite material that may be suitable for manufacture of the disclosed panels is described in GERFLOR European publication number EP2611961.

This publication describes a floor covering of the type including skid-resistant particles in the surface layer and is characterized in that the coating consists of a flexible and resilient material, and in that said particles are made of a ground glass core coated all or part of its surface with a metal coating, the particles being sprinkled in a flexible PVC base without finishing work.

Yet another example of a plastics material suitable for manufacture of the disclosed panels is described in WINDMOLLER publication no. US 2008/0138560. This document describes a floor panel in the form of a multilayer, rectangular laminate with a soft core of plastic, a décor film on the upper side of the core, a transparent finishing layer and a transparent lacquer layer applied on the finishing layer as well as a back-pull layer on the back of the core.

Embodiments of the parts Jm and Jf and the tongue and groove 24*a* and 24*b* and be provided along sides of such a panel to form a lay down surface covering system. Alternately the parts Jm and Jf can be formed on each of two adjacent sides to form a vertical surface covering system form such panels. In addition the panels may be provided with printed (including but not limited to laser printed, electrostatic printed, or direct ink/paint printed) patterns on their, when laid, visible or face up surface, which in the present embodiments is the surface 12. As an alternative surface décor or patterns may be provided by application of printed plastic film or paper film either of which may be adhered to the upper surface of the panel. When paper film is used it is typically overlayed with a protective clear sealant or plastics film.

The surfaces Cm and Cf constitute portions of respective inflexion surfaces, which in turn form portions of respective locking surfaces L. Specifically, the surface Cm1 constitutes a part of an inflexion surface Im1 (indicated by a phantom line) which in turn forms part of an outer most locking surface ML1 (indicated by broken dot line) on an outer most side of the protrusion Pm.

The surface Cm2 constitutes a portion of inflexion surface Im2 (indicated by a phantom line) which in turn forms part of an inner most locking surface ML2 (indicated by broken dot line) on an inner most side of the male recess Rm and depends generally in the direction D from near a root surface 92 of the recess Rm.

The surface Cf2 constitutes part of an inflexion surface If2 (indicated by a phantom line) which in turn forms part of outer most locking surface FL2 (indicated by broken dot line) formed on an outer most side of the projection Pf and extending generally in the direction parallel to the direction D.

The surface Cf1 constitutes part of the inflexion surface If1 (indicated by a phantom line) which in turn forms part of an inner most locking surface FL1 (indicated by broken dot line) on an inner most side of female recess Rf. Surface FL1 extends from a surface planar 94 that depends at right angles form major surface 12 on side 18*b*. The surface FL1 extends toward a root surface 96 of the recess Rf.

Looking at FIG. 8, it will be seen that the surfaces Cm1, Im1 and ML1 engage the surfaces Cf1, If1 and FL1 respectively; and the surfaces Cm2, Im2 and ML2 engage the surfaces Cf2, If2 and FL2 when the joints Jm and Jf are engaged. The engagement of these surfaces forms or creates the first and second locking planes LP1 and LP2. The locking planes LP1 and LP2 form the inner and outer most locking planes of the joint system 22 and lies in planes perpendicular to the major surfaces 12, 14. These locking planes provide resistance to joint separation in both vertical and horizontal directions.

The first and second male locking surfaces ML1 and ML2, and indeed the associated surfaces Cm1 and Cm2 and corresponding inflexion surfaces Im1 and Im2 constitute at least a part of the extreme (i.e. innermost and outermost) transversely extending and inflexion surfaces of the male part Jm. The first and second female locking surfaces FL1 and FL2, and the associated surfaces Cf1 and Cf2 and inflexion surfaces If1 and If2 constitute at least a part of the extreme transversely extending and inflexion surfaces of the female part Jf. These extreme transversely extending and inflexion surfaces form respective surface pairs which create the extreme (i.e. inner most and outer most) locking planes LP1 and LP2 in mutually engaged joints Jm and Jf. This is clearly evident from FIG. 8. Specifically the surface pairs are in this embodiment: Im1 and If1, or Cm1 and Cf1; and, Im2 and If2, or Cm2 and Cf2.

The surfaces Cm1 and Im1 form part of an outermost side surface of the protrusion Pm. The protrusion Pm has a generally ball like or bulbous profile which depends in the direction D from major surface 14. A small notch 98 is formed at a distal end 99 of the protrusion Pm. Save for the notch 98 the distal end 99 of the protrusion Pm facing the root 96 of recess Rf has a surface of a generally convex configuration and is smoothly rounded or curved. This in part arises from the provision of curved surfaces or corners 101 and 103 on opposite sides of the distal end 99. The surfaces 101 and 103 form part of the surfaces Cm1 and Cm3 respectively. When the parts Jm and Jf are engaged the notch 98 forms a reservoir 100 against the root surface 96 of the recess Rf. The first male locking surface ML1 comprises the combination of surface 90 and the inflexion surface Im1.

The notch 98 and corresponding reservoir 100 may be used for various different purposes. These include but are not limited to receiving adhesive and/or sealing compound; acting as a reservoir for debris which may have fallen into the recess Rf during installation, or both. It is expected that most debris falling into the recess Rf will collect at the lowest point on the root 96 and thus be captured in the subsequently created reservoir 100. In the absence of such a feature, it may be necessary to clean the recess Rf for example by blowing with compressed air, use of a vacuum or a broom to remove debris which may otherwise interfere with the engagement process.

The surface 103/Cm3 leads to a contiguous planar portion 104 that extends generally perpendicular to the major surface 12.

The surface 104 leads to a concavely curved surface or corner 105 of recess Rm and associated root surface 92. A further concavely curved surface or corner 107 is formed on an opposite side of the recess Rm. The inflexion surface Im3 is a "shared" surface between the protrusion Pm and recess Rm and comprises corners 103 and 105 and planar surface 104. The intermediate male locking surface ML3 is substantially co-extensive with the inflexion surface Im3.

It will be noted that the protrusion Pm is formed with a neck 106 having a reduced width in comparison to other portions of the protrusion Pm. It will be seen that the surface Cm1 is adjacent an outer most side of the neck 106. Moreover, a portion of the inflexion surface Im1 adjacent the planar surface 90 forms the outer most side of the neck 106. Further, a portion of the inflexion surface Im3 forms the opposite side of neck 106. In this embodiment a line 108 of shortest distance across the neck 106 is inclined relative to the major surface 12.

The root surface 92 smoothly curves via its corner 105 to meet with and join inflexion surface Im2. The surface Im2 extends generally in the direction D leading to an inclined planar surface 110 which leads to the major surface 14. The second male locking surface ML2 extends from above the inflexion surface Im2 and along the surface 110 to the major surface 14.

The recess Rm is formed with a neck 112 between the surfaces Cm2 and Cm3. A line of shortest distance across the neck 112 is also inclined relative to the major surface 12.

Looking at the configuration of the joint Jf (see FIG. 6) on side 18*b* of panel 10, it can be seen that the surface Cf1 and corresponding inflexion surface If1 extend generally in the direction D from the planar surface 94. The inner most locking surface FL1 comprises the combination of surfaces 94 and If1. The inflexion surface If1 leads to the root surface 96 of recess Rf. The root surface 96 has opposite rounded corners 111 and 113, and forms a vertical arrestment surface for the protrusion Pm. Moving in a direction toward the protrusion Pf the corner 113 leads to planar surface 114. The planar surface 114 lies in a plane substantially perpendicular to major surface 12 and leads to convexly curved surface Cf3.

Surface Cf2 forms one rounded corner of distal end 116 of the protrusion Pf. The distal end 116 has a second opposite rounded and convexly curved corner Cf2. By virtue of the surfaces Cf2 and Cf3 the distal end 116 is of a generally convex shape or configuration. Following the surface Cf2 is a concave surface 117 that leads to a planar surface 118 that is perpendicular to the surface 14. Thereafter there is a planar tapered surface 119 that leads to the major surface 14. The outer most locking surface FL2 on the protrusion Pf comprises the combination of surfaces Cf2 and 117.

The recess Rf is configured to receive the protrusion Pm. Moreover, the recess Rf is formed with a neck 120. The neck 120 forms a restricted opening into the recess Rf. A line 122 of shortest distance across the neck 120 is in this embodiment inclined relative to the major surface 12. More particularly, the line 122 is inclined at substantially the same angle as the line 108.

The protrusion Pf like protrusion Pm is of a ball like or bulbous configuration. Further, similar to the protrusion Pm, the protrusion Pf is formed with a neck 124 of reduced width. A line 126 of shortest distance across the neck 124 is inclined to the major surface 12. However in this embodiment the line 126 is inclined at a different angle to the lines 108 and 122.

The male and female joints Jm and Jf are of different shape and configuration. That is, these joints are not symmetrical or non-complementary so that when a protrusion P of one part is engaged by a recess R of the other part, one or more spaces or gaps are formed between the engaged parts. For example, with reference to FIG. 8, gaps 130, 132, 134, and 136 are shown. Gap 130 is between surface Cm1 and a portion of the recess Rf below the surface Cf1. Gap 132 exists between an upper part of the surface Cf1 and an adjacent side of the protrusion Pm. Gaps 134 and 136 are formed between the root surface 92 of recess Rm and the surface 116 of the protrusion Pf. The gaps 134 and 136 are on opposite sides of a peak of the surface 116.

The provision of the spaces or gaps assists in: the engagement and disengagement of parts Jm and Jf; accommodating dimensional changes in the panels for example due to changes in temperature or humidity; and enabling a degree of movement between the joints Jm and Jf to accommodate for uneven substrates on which panels 10 may be laid.

As further shown in FIG. 8, in this particular embodiment when the joints Jm and Jf are engaged, the protrusion Pf is contacted on opposite sides by the joint Jm. In particular, the surface Cm2 contacts the protrusion Pm in a region adjacent and below the surface Cf2, while the two planar surfaces 104 and 114 contact each other. The planar surfaces 104 and 114 together may form an intermediate locking plane LP3 and is sometimes also known as a common plane of tangency. Locking of the parts Jm and Jf in the in the plane LP3 may arises is there is sufficient contact to generate friction between the surfaces 104 and 114. However the locking may be enhanced or alternately provided by inclining the surfaces 104 and 114 in the manner so that when the male part Jm is engaged with the female part Jf, the surface 114 is located above or otherwise overhangs the surface 104. This creates an overhang that inhibits vertical separation.

Further when the male and female parts Jm and Jf are engaged the surface Cm1 on protrusion Pm abuts a lower portion of the surface Cf1. The second joint system 22 may be manufactured to either have the surfaces 90 and 94 in contact when the male and female parts Jm and Jf are engaged; or optionally to have a small gap (explained in greater detail later in relation to a further embodiment) there between. When the small gap is present, then the ends 18*a* and 18*b* of adjacent engaged panels 10 at a location immediately adjacent the major surfaces 12 do not contact each other.

The process of engaging the male and female parts Jm and Jf is shown in FIGS. 2 and 4*a*-4*c*. These Figures depict a panel 10*w* being engaged with panels 10*x*1, 10*x*2 and 10*z*. Panels 10*x*1 and 10*x*2 are on the same side of panel 10*w* and are collectively referred to herein after as panels "10*x*". Each of the panels 10*w*, 10*x* and 10*z* have the same configuration as panel 10. The panel 10*w* is inclined at an obtuse angle to panels 10*x* and the tongue 24*a* has been inserted into the groove 24*b* of panels 10*x*. The panel 10*w* is located so that its side 18*a* is adjacent and located directly above the side 18*b* of panel 10*z*. The side 18*a* is provided with the male part Jm while the side 18*b* is provided with the female part Jf.

An initial small length of the male part Jm is inserted into the female part Jf immediately adjacent the panel 10*z*. This is achieved by applying a downward force D on the surface 12 of panel 10*w*. This force results in the recesses Rm and Rf resiliently opening to receive the protrusions Pm and Pf. In particular, during this process the surface Cm1 contacts and rolls or otherwise passes over the surface Cf1, while the surface Cm2 contacts and passes or otherwise rolls over the surface Cf2. Due to their relative disposition, the surface Cm1 passes over the surface Cf1 before the surface Cm2 passes over the surface Cf2. Also as the protrusions Pm and Pf are being received in their respective recesses Rm and Rf, the planar surfaces 104 and 114 contact and slide over each other. By applying a force or pressure in the direction D on the panel 10*w* progressively along the side 18*a* as a panel 10*w* is being laid down, the entire length of the male part Jm progressively engages the length of the female part Jf.

Once the necks of the protrusions P have passed through the necks of the corresponding recesses R, the recesses R resiliently spring back and contact the opposite sides of the engaged protrusion P. In this way, the engagement of the parts achieved in a progressive manner similar to that used for sealing plastic bags. Further, the passing of the necks of the protrusions Pm and Pf past the necks of the recesses Rm and Rf produces a snap lock of the male and female parts Jm and Jf.

To release engaged joints Jm and Jf of panels made from hard rigid materials such as wood, a panel containing the male part Jm is rotated relative to adjacent connected panel to partially disengage the protrusions Pm and Pf from their recesses Rf and Rm. This may be considered as a "dislocation" in similar terms as to that understood for human body joints in that there remains a degree of coupling or engagement but this is not full coupling or engagement. Thereafter a downward force applied to the panel with the female part Jf will result in full disengagement. The amount of force required to achieve the engagement and disengagement of the male and female parts Jm and Jf can be managed by appropriately dimensioning the protrusions P and recesses R.

For panels made from a pliable material such as vinyl and PVC, or at least having pliable joint systems 22 simply pulling up along the side having the male part Jm will release the engaged.

As an alternative for any panel materials (e.g. wood based panels and LVT panels), the engaged parts Jm and Jf can be disengaged by sliding one panel relative to another while keeping the pales in the same plane.

Due to the configuration of the male and female parts Jm and Jf the transverse joint between panels 10 is able to resist accidental decoupling which at times prevalent with LVT floor panels having different joint systems. The prevalence of this decoupling arises due to LVT floor panels being relatively thin, for example approximately 2-3 mm, and made from plastics material which becomes increasingly pliable as temperature increases.

Figure 9A:
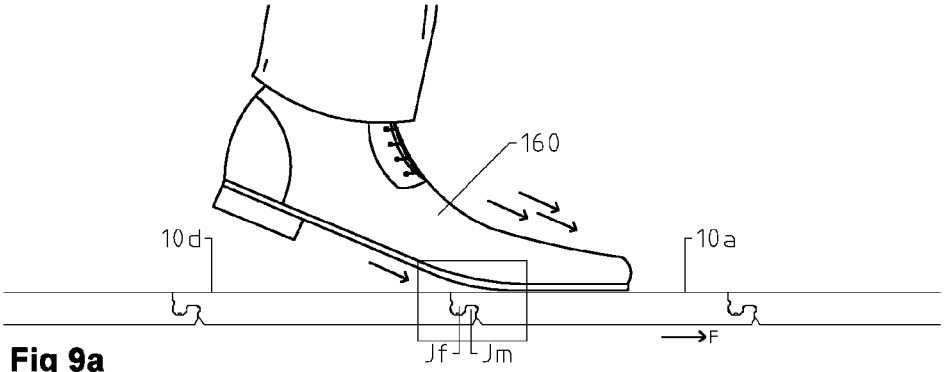
FIG. 9*a* depicts a person walking on a floor composed of the panels.
Figure 9B:
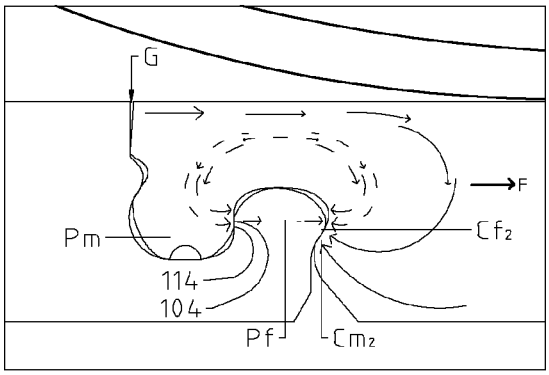
FIG. 9*b* depicts the effect on the joints at the short sides of two joined panels of the person walking on the floor.

FIGS. 9*a*-9*d* depict a scenario where a force is applied between the sideways joined panels 10*w* and 10*z* in a direction which tends to separate the panels. FIG. 9*a* shows a person stopping quickly on the floor covering with their shoe 160 contacting the panel 10*w* in a manner so as to apply a lateral force F on the panel 10*w* tending to move the panel 10*w* away from the panel 10*z*. When the panels 10 are made from a plastics material such as LVT this has the effect of causing deformation and movement of the parts Jm and Jf. This is predominantly manifested by the part Jm rotating slightly in a clockwise direction as well as moving laterally away from the panel 10*z*. This leads to the momentary creation of a gap G between the panels 10*w* and 10*z*. During this process there may also be a slight opening of the recess Rm.

Also, as the panel 10*w* is being moved slightly in a direction of the force F the protrusion Pm which abuts the protrusion Pf by virtue of contacting surfaces 104 and 114 also moves the protrusion Pf slightly in a direction F. During this movement the surface Cf2 remains in contact with the surface Cm2. Consequentially at all times the protrusion Pf remains contacted on opposite sides in the recess Rm. This assists in preventing decoupling of the parts Jm and Jf in response to the force F. In effect the joint system 22 is self-supporting because lateral force causes substantially uniform displacement of the recess Rm and the protrusion Pf.

In contrast in other joint systems where a substantive space exists between a feature equivalent to the protrusion Pf and feature equivalent to the recess Rm on an outermost side of the protrusion Pf, the protrusion Pf may be able to pivot into that space which consequentially results in an opening of the recess Rf. This in turn may allow decoupling and separation of the male and female parts Jm and Jf.

Figure 9C:
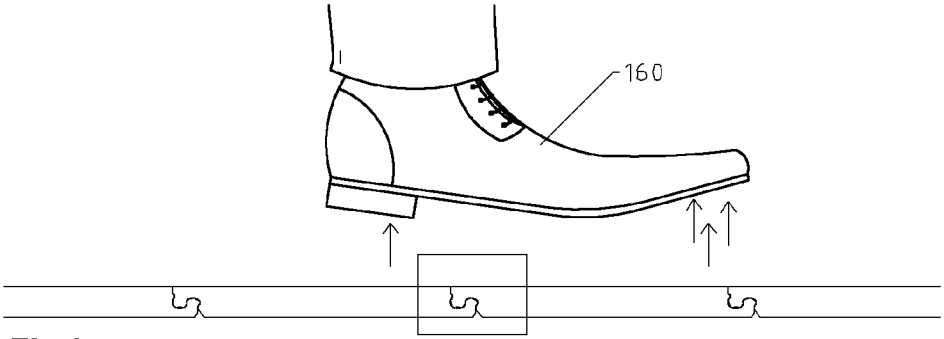
FIG. 9*c* depicts a foot of a person being lifted from a floor composed of the panels.
Figure 9D:
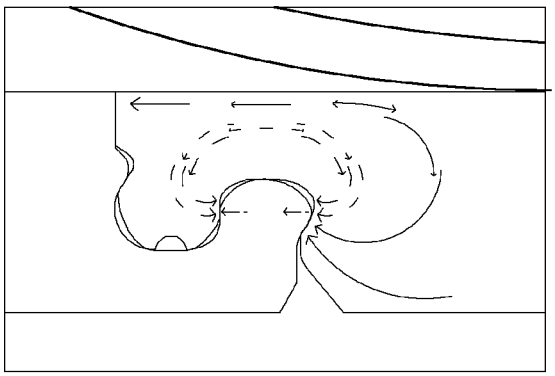
FIG. 9*d* depicts the effect of the release of the person's foot from the floor in the region of a join between the short sides of two panels.

As shown in FIGS. 9*c* and 9*d* once the shoe 160 has been lifted from the panel 10*a* and the force F removed, the resilience of the material from which the panels 10 are made and the inherent structure of the joint system 22 results in a springing back of the male and female parts Jm and Jf to their normal state. This is facilitated at least in part by the provision of the curved corners of the recess Rm.

The second joint system 22 can be made with male and female parts of numerous different configurations which nonetheless operate in a substantially identical manner and in particular form a vertical joint system. Example of such male and female parts are described in international application no PCT/AU2012/000280 the contents of which is incorporated herein by way of reference. However several further new configurations will now be disclosed.

The following disclosed joint systems 22*a*-22*d* can be applied to panels of various thicknesses (for example 2 mm-20 mm). However some are particularly well suited to very thin panels of a thickness for example of 2-4 mm. Due to material properties and manufacturing techniques the joint systems for very thin panels (e.g. 2-4 mm) are well suited for panels are made from plastics or composite materials such as vinyl, PVC or WPC (although they may still be applied to rigid or hard materials). Such thin panels have manufacturing/commercial benefit in terms of using less material for manufacture and providing greater meterage per container. For example a shipping container can carry twice the meters of say a 3 mm thick flooring panel than 6 mm thick flooring panel.

Figure 10A:
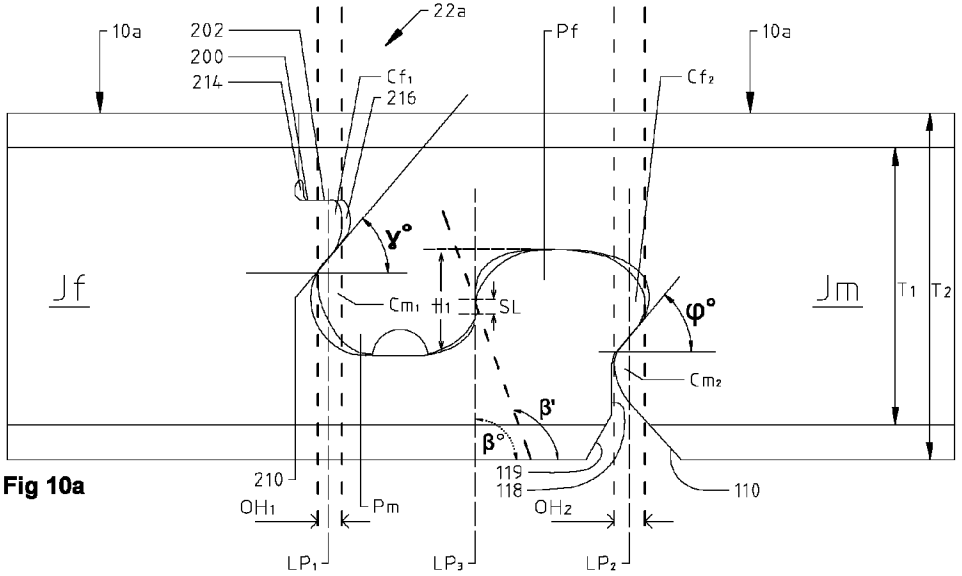
FIG. 10*a* illustrates a second form of vertical joint system that may be incorporated in a second embodiment of the panel.
Figure 10B:
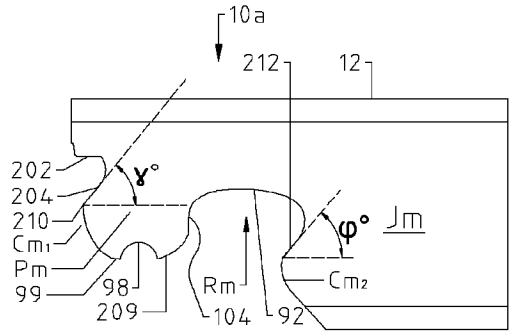
FIG. 10*b* depicts a male part of the vertical joint system shown in FIG. 10*a;*
Figure 10C:
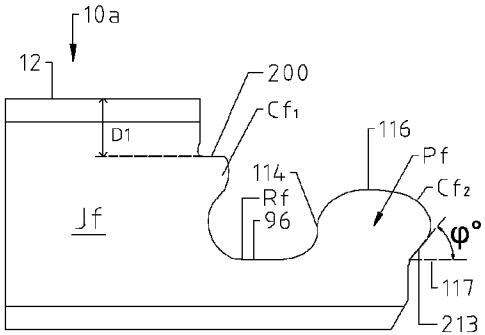
FIG. 10*c* illustrates a female part of the vertical joint system shown in FIG. 10*a;*

FIGS. 10*a*-10*c* illustrates a further embodiment of a second joint system 22*a*. In describing the joint system 22*a* features which are the same or equivalent to features in the joint system 22 will be denoted with the same reference numbers except that for ease of reference the panel on which the system 22*a* is incorporated will be designated as panel 10*a*.

The joint system 22*a* comprises a male part Jm and a female part Jf. In FIG. 10 the parts Jm and Jf are depicted in an engaged condition and on each of two separate panels 10*a*. When the joint system 22*a* is incorporated in panels for a lay down flooring system as depicted in FIGS. 1-4 the joints Jm and Jf will be formed on opposite transverse or short sides 18 of the panel. (However as will be explained in greater detail later in this specification the joint system 22*a* can be used on all four sides of a panel 10*a* to produce a true vertical flooring surface covering system similar to those disclosed in aforementioned International application no. PCT/AU2012/000280).

FIG. 10*a* shows the opposite transverse sides 18 of two adjacent panels 10*a* in a joined condition. Each panel 10*a* is depicted in two thicknesses, T1 and T2. By way of example only, the thickness T1 may be 4 mm while the thickness T2 may be 5 mm. It will be noted that irrespective of the thickness T1 or T2, the configuration and operation of the joint system 22*a* and in particular the male and female parts Jm and Jf are the same.

The male part Jm has a protrusion Pm and an adjacent inboard recess Rm. The female part Jf has a protrusion Pf and a recess Rf. The parts Jm and Jf are relatively configured so that when engaged at least inner most and outer most locking planes LP1 and LP2 are formed. These locking planes are in substantially the same location as those in the embodiment of the system 22 depicted in FIG. 8. It will be further noted that the parts Jm and Jf are non-complimentary or symmetrical so that a plurality of gaps are formed between the parts Jm and Jf when engaged. Thus the male and female parts Jm and Jf of system 22*a* (as with the parts Jf and Jm of system 22) do not provide a "form fit".

A substantive additional feature of the joint system 22*a* in comparison to the system 22 is the provision of a female joint datum surface 200 that lies parallel to the surface 12 and is arranged to abut a portion 202 of the male part Jm when the parts Jm and Jf are engaged. Moreover, the datum surface 200 and the part Jm are relatively configured so that when in abutment, the surfaces 12 of corresponding joined panels 10*a* are substantially flush (assuming that the panels 10*a* are laid on a flat substrate or underlying surface). Thus, the datum surface 200 provides a datum to facilitate joining of panels 10*a* in a manner so that their respective first major surfaces lie flush with each other. To this end the datum surface 200 is formed a prescribed and known vertical distance D1 from the surface 12 of the corresponding panel 10*a*.

The surface 200, prior to engagement with part Jm, is exposed and extends laterally from an edge of the surface 12. Thus surface 200 can be directly contacted by a planar surface 202 formed on the male part Jm when the part Jm is inserted in a direction perpendicular to the surface 12 into the female part Jf. The surface 202 is also a planar surface and lies parallel to the surface 12 of the panel 10*a*. The surface 202 is formed a distance substantially equal to the distance D1 from the surface 12. By provision of the datum surface 200 it is not required for the protrusions P to have face to face contact at their distal ends 99, 116 with the root surfaces 92, 96 of the recesses R in order to provide flush surfaces 12 across the joint system 22*a*. Nevertheless in the system 22*a* as shown in FIG. 10 the distal ends of the protrusions Pm and Pf are shown as contacting or immediately adjacent the root surfaces of the recesses Rf and Rm.

The parts Jm and Jf in system 22*a* are provided with planar surfaces 104 and 114 respectively as per the corresponding surfaces of parts in system 22. The common plane of tangency/locking plane LP3 extends at an angle β of 90° with reference to the surfaces 12 of the panels 10*a*. As previously described however this angle may be varied so that the surface 114 overlies the surface 104 to create an overhang that inhibits vertical separation. This is shown more clearly in FIG. 10*a* by way of the plane LP3'. This plane is inclined at an angle β' toward the datum surface 200. In this instance the plane LP3' and the corresponding surfaces 104 and 114 can be considered as being "inverted". In some embodiments the angle β may fall within the range of 90° to 120° or any sub range within this range for example 95° to 105°.

In this embodiment the face to face length SL of the surface 104 and 114 along the common planes of tangency LP3 lies in the range of 6%-18% of the panel thickness. In one example SL=0.36 mm for each of T1=4 mm and T2=5 mm. Thus in these instances SL=9% of T1 and SL=7.2% of T2.

A further difference between the system 22 and 22*a* is the provision of a planar surface portion 204 on the surface Cm1 at an intermediate location between the surface 202 and distal end 99 of the protrusion Pm. A contiguous surface portion 208 of Cm1 between the planar surface 204 and the distal end 99 remains curved. Accordingly a small nib or point 210 is formed on surface Cm1 at the junction of the surfaces 204 and 208. The surface 204 may be inclined at an angle γ in the range of 50±30°, or any sub range there between. Nevertheless the protrusion Pm at opposite sides of the distal end 99 maintains rounded corners. The nib or point 210 created by virtue of the provision of the planar surface 204 may provide greater separation resistance in the vertical direction between join panels 10*a*.

The provision of the nib 210 may assist in providing greater resistance to vertical separation between the male and female parts Jm and Jf. There is an overhang OH1 of the female part Jf over the male part Jm in a region between the datum 202 and the nib 210. More particularly, the overhang OH1 is the transverse or lateral distance between: a line perpendicular to the surface 12 that intersects the nib 210; and, a further line that extends perpendicular to the surface 12 and is tangent to a lateral most extensive point of the surface Cf1. The overhang OH1 is may range from 4% to 18% (or any sub range within that range) of the thickness of the panel 10*a* for panels with a thickness less than or equal to 6 mm (for example 6 mm, 5 mm, 4 mm, 3.5 mm, 3 mm, 2.8 mm 2.2 mm and 2 mm).

In the male part Jm of system 22*a* the surface profile of the inner most side of the recess Rm is modified by the provision of a planar surface 212 leading to and comprising a part of the surface Cm2 in the male part Jm. The surface 212 is inclined at an angle φ in the range of 50°±20°, or any sub range there between. The part Jf has a planar surface portion 213 in the concavity 117 which is also inclined at angle φ and overlies surface 212. Moreover the surfaces Cf2 and Cm2 are arranged to provide an overhang OH2 in the range from 4% to 18% (or any sub range within that range) of the thickness of panel 10*a* for panels with a thickness less than or equal to 6 mm (for example 6 mm, 5 mm, 4 mm, 3.5 mm, 3 mm, 2.8 mm, 2.2 mm and 2 mm). The overhang OH2 is the lateral overhang of the surface Cf2 over the surface Cm2.

The overhang of the surface Cf2 over Cm2 may also be calculated in terms of the height H1 of the protrusion Pf above the root surface 96 of the recess Rf. This overhang is designated as the overhang OHp and in this instance is in the order of 30%±10%.

It will also be noticed that the joint system 22*a* is arranged to produce a gap 214 between the parts Jm and Jf at a location below the surface 12 but above the datum 200. A further gap 216 is created between the parts Jm and Jf adjacent the surface Cf1.

In a specific but non limiting example for the panels 10*a* of FIG. 10*a* with a thickness T1 of 4 mm:

γ=50°
φ=50°
OH1=0.35 mm (=8.75% of T)
OH2=0.45 mm (=11.25% of T)
H1=1.53 mm and therefore OHp=0.45 mm (=29% of H1)
SL=0.36 mm (=9% of T)

Figure 11A:
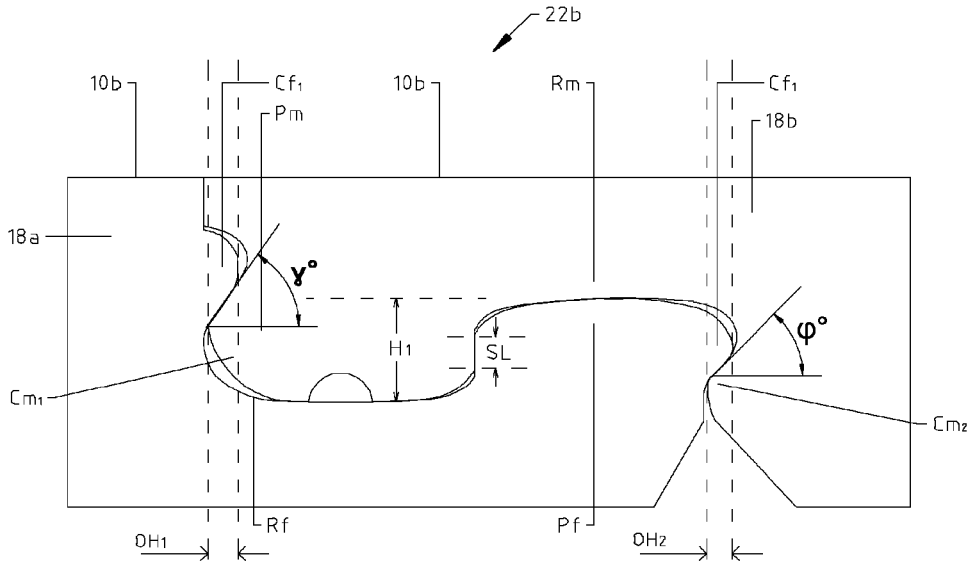
FIG. 11*a* depicts a third form of the vertical joint system that may be incorporated in a third embodiment of the panel.
Figure 11B:
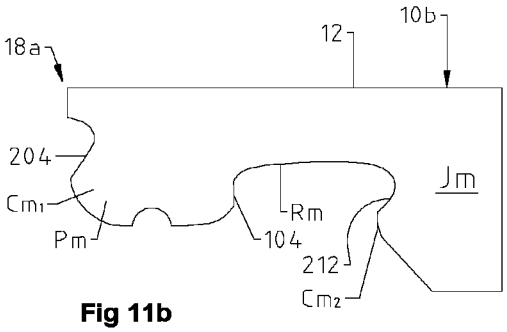
FIG. 11*b* depicts a male part of the vertical joint system shown in FIG. 11*a;*
Figure 11C:
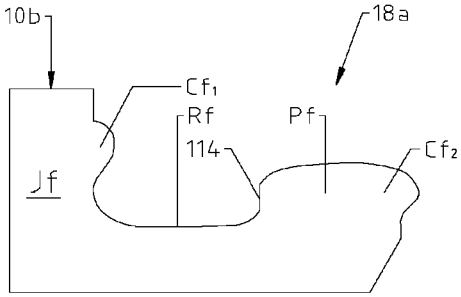
FIG. 11*c* illustrates a female part of the vertical joint system shown in FIG. 11*a;*

FIGS. 11*a*-11*c* depicts a further embodiment of the second (vertical) joint system designated as 22*b*. In describing the joint system 22*b* features which are the same or equivalent to features in the joint system 22 or 22*a* will be denoted with the same reference numbers except that for ease of reference the panel on which the system 22*b* is incorporated will be designated as panel 10*b*. The second joints 22*b* are particularly well suited for very thin panels 10*b* for example in the order of 2-2.2 mm. Such panels may be made of materials such as plastics including vinyl, PVC, bamboo plastic composites, or WPC.

The system 22*b* has a male part Jm comprises a male protrusion Pm and a male recess Rm inboard of the protrusion. The protrusion Pm extends downwardly from the surface 12 of corresponding panel 10*b* adjacent an outer most edge formed at the junction of surfaces 12 and 90. Female part Jf comprises an outermost protrusion Pf extending upwardly from the surface 14 of panel 10*b* and an inboard recess Rf. As with the previously described second joints systems, the system 22*b* can be used on the two opposed transverse sides 18*a*, 18*b* of a panel in a lay down surface covering system or all four sides 16*a*, 16*b*, 18*a* and 18*b* of a panel to form a full or true vertical panel system.

The joint systems 22, 22*a* and 22*b* have many similarities and operate in substance in the same way each being vertical joint systems. However there are differences in their respective specific configurations. The joint system 22*b* is formed so that the male part Jm has planar surfaces 204 and 212 at corresponding locations to the same surfaces in the joint system 22*a*. Due to the relative thinness of the panel 10*b* the angles γ and φ as well as the overhangs OH1, OH2 and OHp are different to those of the joint system 22*a*. Nevertheless the angles γ and φ and overhangs still lie in same range as specified above for system 22. This arises from the flattening of the protrusions Pm and Pf and consequential widening of the recesses Rf and Rm to accommodate the reduced material thickness of the panel 10*b* while maintaining vertical grab or decoupling resistance.

In the specific example of a panel 10*b* on which joint system 22*b* is provided having a thickness T of 2.2 mm:

γ=56°

φ=45°

OH1=0.2 mm (=9.1% of T)

OH2=0.19 mm (=8.6% of T)

H1=0.69 mm and therefore OHp=0.19 mm (=27.5% of H1)

SL=0.32 mm (=14.5% of T)

Notwithstanding the provision of the planar surfaces 204, 104, 114, and 212 in system 22*b* there is at least one rounded corner at locations where the male and female parts contact each other during the engagement process; and gaps between the parts Jm and Jf after full engagement. Moreover each of the protrusions Pm and Pf in system 22*b* are provided with rounded corners on opposite sides of their distal ends.

Figure 12A:
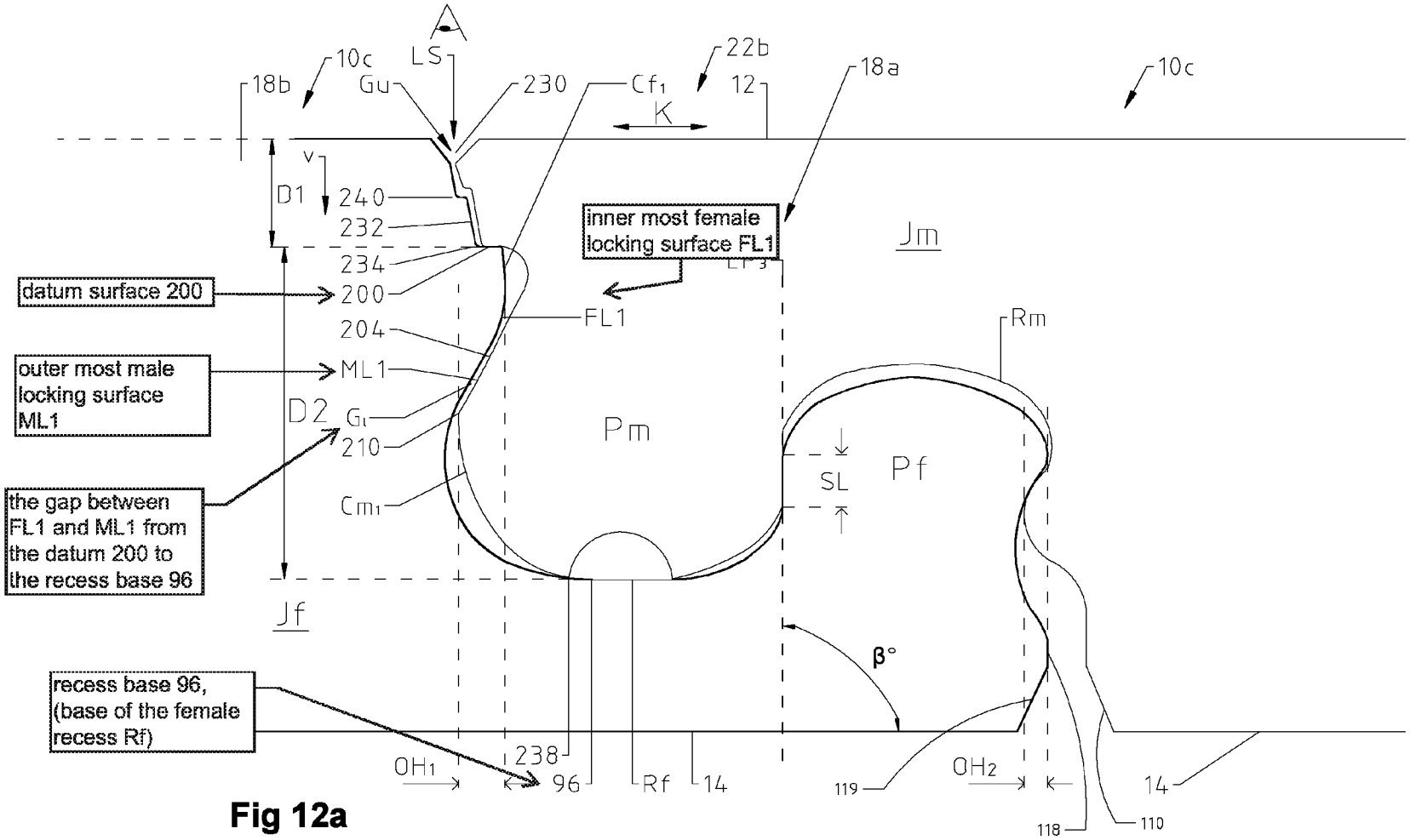
FIG. 12*a* illustrates a fourth form of vertical joint system that may be incorporated in a second embodiment of the panel.
Figure 12B:
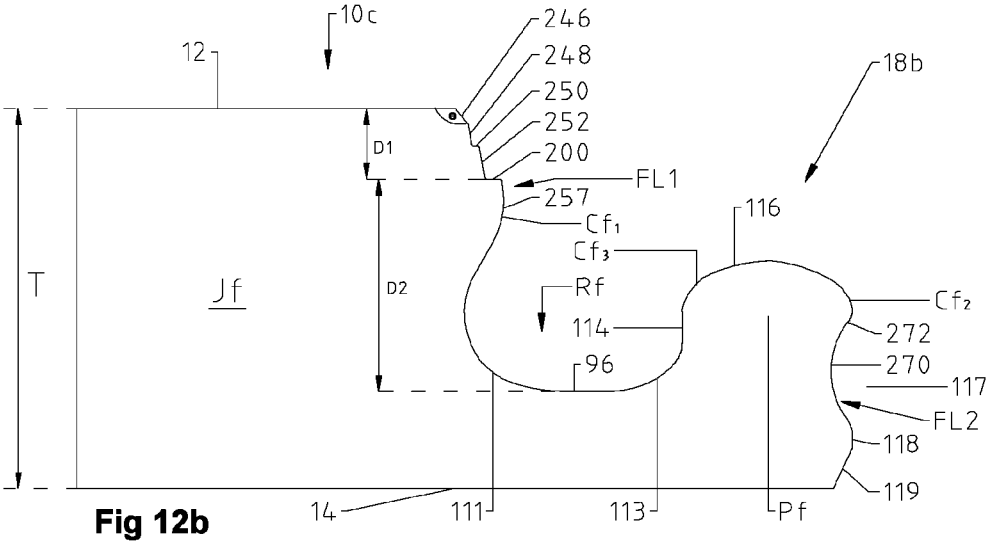
FIG. 12*b* depicts a male part of the vertical joint system shown in FIG. 12*a;*
Figure 12C:
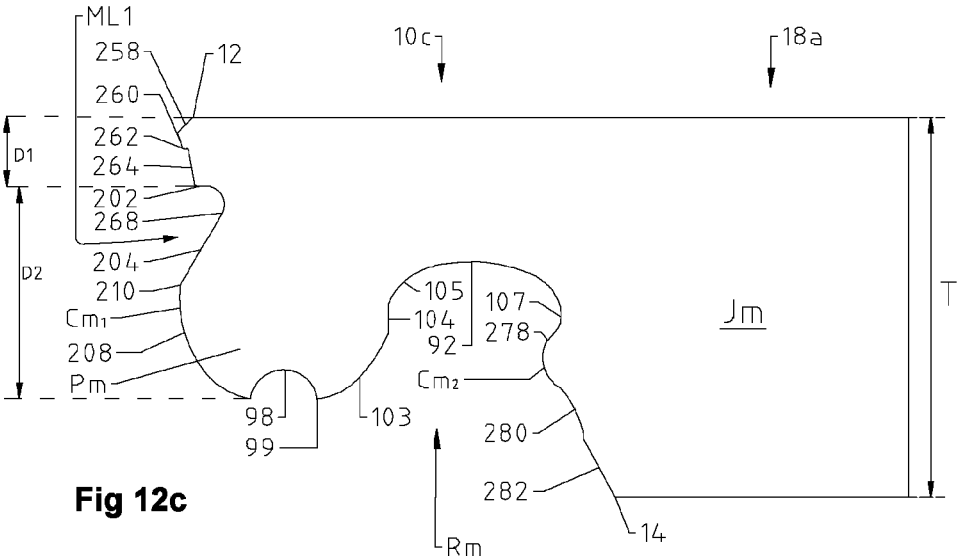
FIG. 12*c* illustrates a female part of the vertical joint system shown in FIG. 12*a;*

FIGS. 12*a*-12*c* show a further embodiment of a second (vertical) joint system 22*c*. In describing the joint system 22*c* features which are the same or equivalent to features in the joint systems 22, 22*a* or 22*c* will be denoted with the same reference numbers except that for ease of reference the panel on which the system 22*c* is incorporated will be designated as panel 10*c*. As with the previously described second joints systems, the system 22*c* can be used on the two opposed transverse sides 18*a*, 18*b* of a panel in tongue and groove lay down or horizontal surface covering system or alternately all four sides 16*a*, 16*b*, 18*a* and 18*b* of a panel to form a panel for full or true vertical surface covering system.

As will be seen from these Figures, the male and female parts Jm and Jf are configured to form an upper gap Gu between the connected panels 10*c* when the respective lower major surfaces 14 are co-planar. The upper gap Gu has a visible portion 230 that is visible from the upper surfaces 12 of the connected panels 10*c*. The visible portion 230 extends in a lateral direction K parallel to the upper surfaces 12; and also in a downward direction V, from the upper surface 12 toward the lower surface 14.

The gap Gu also includes a second contiguous portion 232 that extends from the visible portion 230 to a first contact region 234 between the connected panels 10*c*.

Thus, when the parts Jm and Jf are engaged with each other the visible portion 230 of gap Gu will appear along the adjacent sides of the respective joined panels 10*c* containing the parts Jm and Jf. Accordingly there is no lateral abutment between the panels 10*c* at the mutually facing surfaces ML1 and FL1 along the sides having the joint system 22*c*. Thus notwithstanding any coupling forces that may exist between the joints Jm and Jf when engaged with each other, these forces do not bias or urge the corresponding sides of the joined panels together, and more particularly do not cause contact and are not designed to cause contact between the adjoined panels in the vicinity or region of the upper surfaces 12. It should be noted that this effect will also occur when the system 22*c* is incorporated on all four sides of a panel to form a full vertical surface covering system. In that event there is in substance no contact in the direction K parallel to the surfaces 12 between the panels 10 across an interface where the upper surfaces of the panels lies closest together when the male and female parts Jm and Jf are mutually engaged and lie in mutually coplanar juxtaposition. There is however contact in a perpendicular direction V at least at the contact region 234.

From FIG. 12*a* it is also evident that the male and female parts Jm and Jf are configured to produce a lower gap GI that extends from the contact region 234 to, in this embodiment, a second contact region 238 between the parts Jm and Jf. The second contact region 238 also provides contact in the direction V in the vicinity of the root surface 96 recess Rf in the female part Jf.

The upper and lower gaps Gu and GI assists in enabling connected panels 10*c* to rotate, one relative to the other, from a coplanar or common laid flat position in both a positive and negative direction up to approximately 3°. More particularly the gaps and the configuration of the joints enables rotation in one direction rotates the upper surfaces toward each other by up to 3°; and rotation in an opposite direction that rotates the lower surfaces toward each other by up to 7°-10°. This rotation may be of greater benefit when the system 22*c* is used on all four sides of a panel creating a vertical panel/surface covering system, than when applied only to the transverse sides 18*a*, 18*b* of a lay down surface covering system.

The upper gap Gu is widest at the upper surfaces 12 of the two connector panels 10*c* and reduces in width in the direction V from the upper surface 12 to the lower surface 14. Further, the gap Gu is configured to prevent a direct line of sight LS from the upper surface 12 to the first contact region 234 when the gap Gu is viewed from a standing position on the panels 10*c*. The obstructing of the direct line of sight mentioned above is facilitated in the embodiment shown in FIG. 12*a* by forming the gap Gu to follow a path such that the direct line of sight impinges on a surface of the side of one of the panels 10*c* at a location intermediate the upper surface 12 and the first contact region 234. Indeed this defines the visible portion 230 of the upper gap Gu. The second portion 232 of the gap Gu extends from this intermediate location to the first contact region 234.

The line of sight LS impinges on a surface of the side 18*b* of the female part Jf at a location intermediate the upper surface 12 and the first contact region 234. In this embodiment the path of the upper gap Gu is formed with a bend at the intermediate location 240 that prevents a direct line of sight LS from the upper surface 12 to the first contact region 234.

The female part Jf has an inner female joint surface FL1 that extends from the upper surface 12 in a generally downward direction V toward the lower surface 14. The male part Jm has an outer male joint surface ML1 that extends from the upper surface 12 down the side 18*a* toward the lower surface 14. The joint surfaces MI1 and FL1 are arranged so that when the male and female parts Jm and Jf are engaged the surfaces FL1 and ML1 face each other and are spaced apart by the upper gap Gu and the lower gap GI. Thus, in the direction K which lies parallel to the surfaces 12, the surfaces FL1 and ML1 are spaced apart. There is contact between the surfaces FL1 and ML1 however this contact is at the first and second contact regions 234 and 238 and is in relation to parts of the surfaces FL1 and ML1 that lie in plane substantially parallel to a plane of the surface 12.

With reference to FIG. 12*b* the inner female joint surface FL1 is composed of a plurality of contiguous surface portions. A first portion 246 extends from the upper surface 12 of a corresponding panel 10*c* at an obtuse included angle θ and in a general downward direction toward the lower surface 14. A second contiguous surface portion 248 extends from the surface 246 toward the lower surface 14 but at a steeper angle than the first surface portion 246. Contiguous with the second surface portion 248 is a third surface portion 250. The surface portion 250 extends generally toward the male part Jm of connected second panel 10*c* and, in this embodiment lies in a substantially horizontal plane. Contiguous with the third surface portion 250 is a fourth surface portion 252 that again extends downwardly toward the lower surface 14 and at an angle substantially parallel to that of second surface portion 248. The fourth surface portion 252 transitions at an angle of slightly more than 90° to the first datum surface 200 that forms part of the first contact region 234. The datum surface 200 extends in a plane substantially parallel to the upper surface 12.

A distant end of the datum surface 200 transitions at an angle of about 90° to a fifth surface portion Cf1. The surface Cf1 initially curves in a slightly convex manner to a lateral most point 257 before smoothly transitioning to a concave curve. This combination of curves forms an inflection in the outer female joint surface FL1 between the first and second contact regions 234, 238. Thus the inner female joint surface FL1 comprises the surfaces 246, 248, 250, 252, 200 and Cf1, and point 257.

With reference to FIG. 12*c* the outer male joint surface ML1 likewise comprises a plurality of contiguous surface portions. A first surface portion 258 extends at an obtuse included angle θ from the upper surface 12. This is followed by a contiguous second surface 260 that extends in a direction substantially perpendicular to the upper surface 12. This is then followed by a third surface portion 262 that cuts back inwardly into the male part Jm and extends substantially parallel to the surface portion 250. A third surface portion 262 leads to a fourth surface portion 264 that is inclined at an angle substantially parallel to that of the surface portion 252 and extends toward the contact region 234. The surface portion 264 turns at an angle of just over 90° to datum surface portion 202. The surface portion 202 lies on a plane substantially parallel to the upper surface 12 and is configured to abut with face to face contact with the datum surface 200. The surface 202 transitions to a smoothly curved concave surface 268. Surface 268 extends to the planar surface 204. The planar surface 204 meets at an inflexion point or nib 210 with a smoothly curved convex surface 208. The surface 208 forms a rounded corner of the protrusion Pm and leads to distal end 99 of the protrusion Pm and the second contact region 238. Thus the outer male joint surface comprises the surface portions 258, 260, 262, 264, 202, 204, and 208 including the intermediate inflexion point and nib 210. The surface Cm1 comprises the surfaces 204 and 208.

There is no direct line of sight from the upper surface 12 to the bottom of the gap Gu due to (a) the surface portion 260 overhanging the surface portion 250 when viewed in the direction of the line of sight LS; and (b) the juxtaposition and orientation of surfaces 250 and 262 which cooperate to form the bend 240. These individually or in combination may be considered as forming the intermediate location where the visible portion 230 of gap Gu transitions to the contiguous second (invisible) portion 232. It will be further noted that in the direction K (substantially parallel with the upper surface 12) the inner female joint surface FL1 and outer male joint surface ML1 are separated by the upper gap Gu and the lower gap GI.

The datum surface 200 provides a datum to facilitate the joining of panels 10*c* in a manner so that the upper surfaces 12 are flush with each other. To this end the datum surface 200 is formed a prescribed and known vertical distance D1 (shown in FIG. 12*b*) from the upper surface 12 of the corresponding panel 10*c*. This sets a thickness of a portion of the male part Jm of the panel 10*c* from the surface 12 to the surface 202. By ensuring that these two distances are substantially the same, when the surface 202 abuts the surface 200 to form the contact region 234, surfaces 12 of adjoining panels 10*c* should be flush with each other.

The inner female joint surface FL1 forms an inside surface of the female recess Rf and transitions in the region of the second contact area 238 to the root surface 96. The surface 96 has concave rounded corners 111 and 113 spaced by an intermediate planar surface portion that is generally parallel to the upper surface 12. The corner 113 transitions to the planar surface 114 that extends perpendicular to the upper surface 12. The surface 114 then leads to a domed distal end surface or head 116 of the protrusion Pf forming a smooth rounded convex corner Cf3.

The domed head 116 transitions to an outer female joint surface FL2. The surface FL2 includes a smooth rounded corner Cf2 that is contiguous with the domed head 116 and a subsequent contiguous concavely curved surface 270. The curvature and juxtaposition of the surfaces Cf2 and 270 is such to create a small but distinct transition point 272 there between in the concavity 117. An end of the surface 270 nearest the lower surface 14 is formed contiguously with a planar surface 274. The surface 274 extends in a plane perpendicular to the upper surface 12. Thereafter, the outer female joint surface FL2 tapers back into the side 16 via a planar inclined surface 276. The surface 276 subsequently transitions to the lower surface 14.

With reference to FIG. 12*c* the outer male joint surface ML1 forms an outer surface of the male protrusion Pm. Inboard of the protrusion Pm there is formed the male recess Rm. The protrusion Pm extends from the upper surface 12 toward the lower surface 14. Conversely, the recess Rm extends from the lower surface 14 toward the upper surface 12. That is, the protrusion Pm and the recess Rm extends generally in the opposite directions both of which are perpendicular to the upper surface 12.

The distal end 99 of protrusion Pm is formed with the notch or groove 98 and has (save for the notch 98) a generally convex shape or configuration. The distal end 99 transitions via a smooth rounded surface 103/Cm3 on protrusion Pm to planar surface 104 extending perpendicular to the upper surface 12. The surface 104 transitions to a convexly curved root surface 92 creating a curved dome like roof of the recess Rm. The concave surface root surface 92 creates smoothly curved corners 105 and 107 on opposite sides of the recess Rm. The corner 107 transitions to a convexly curved surface Cm3. The curvature of the corner 107 and surface Cm2 and their juxtaposition are such that at the resultant inflection is not, in this embodiment, smoothly curved but rather is formed with a small nib or point 278. The surface Cm2 leads to a shallow convex surface 280 and subsequently to a planar tapered surface 282. The surface 282 slopes in a direction inward of the panel 10*c* and terminates at the lower surface 14.

From FIGS. 12*a*-13*b* it can be seen that the upper gap Gu extends for a depth D1 from the upper surface 12. The lower gap GI extends for a distance D2 from the first contact region 234 to the second contact region 238. The depth D1 coincides with the depth of formation of the datum surface 200 on the female part Jf. This depth also coincides with the perpendicular distance between the upper surface 12 and the surface 202 on the male part Jm. The distance D2 corresponds with the vertical distance between the datum surface 200 and the commencement of the horizontal portion of the root surface 96.

In this embodiment, though it need not necessarily be so, the depth D2 is also the vertical depth of the portion of the male protrusion Pm from the plane of surface 202 to the commencement of the horizontal portion of the distal end 99. In this regard in alternate embodiments the straight line or perpendicular distance between the surface 202 and the distal end 99 may be D2−Δ where Δ>0 mm; for example Δ=0.2 mm, or 0.5 mm, or 1 mm. In such an arrangement the protrusion Pm will have a depth less than that of the recess Rf so that the distal end 99 will be spaced from the root surface 96.

It will also be noted that the actual length of the gaps Gu and GI is greater than the depths D1 and D2 respectively. In the present embodiment this arises due to the gaps Gu and GI following paths that comprise one or more bends; and/or comprise sections that extend in an inclined path relative to the perpendicular of the panel 10.

Embodiments of the panel 10*c* bearing the joint system 22*c* may be provided with various relationships between the D1, D2 and the overall thickness T of the panel 10. Examples of such relationships are as follows:

In one embodiment the depths D1, D2 and D3 may have a following relationship;

$$0.3T \geq D1 \geq 0.1T$$

$$0.7T \geq D2 \geq 0.4T \text{ and}$$

$$0.85 \geq D1 + D2 \geq 0.65T$$

Further, the visible portion 230 of the upper gap Gu may extend it to a depth of between 0.4 D1 to 0.8 D1.

The above relationships are exemplary only as to possible ranges and is not intended to limit embodiments to only these ranges. Specifically, the above disclosed ranges are intended to delimit the boundary of these other ranges but to also include any sub-range within the above disclosed ranges. Further this relationship between D1, D2 and T applies to all embodiments having the datum surface 200 such as system 22*a*.

In one example, T=12 mm, D1=2.26 mm and D2=6.78 mm. However, it is envisaged that the panel 10 may be made of various thicknesses from about 20 mm for example for a timber or wood based panel, down to at least 2.0-2.2 mm for panels made from for example plastics materials, including vinyl, PVC, bamboo plastic composites and wood plastic composites.

The transverse separation between the inner female joint surface FL1 and outer male joint surface ML1 is a minimum of about 0.1 mm-0.2 mm for panels with a thickness at least in the range of 12 mm to 2 mm inclusive (and any sub range within that range) for example 12 mm, 10 mm, 8 mm, 6 mm, 5 mm, 4 mm, 3.5 mm, 2.8 mm, 2.2 mm and 2 mm. Indeed this separation may also be used for panels having a thickness of up to about 20 mm.

The male and female parts of the vertical joint systems 22, 22*a* and 22*b* described above, and system 22*d* described later in this specification may each be modified to incorporate an upper gap Gu of the same or similar structure and configuration as that described in relation to the system 22*c*.

In each embodiment of the second joint system 22 (i.e. systems 22, 22*a*, 22*b* and 22*c*) the respective recess and protrusions on the male and female parts Jm and Jf are configured to engage each other in a direction perpendicular to the surface 12 and provide resistance to separation of corresponding joined panels 10 in planes both perpendicular and parallel to the surface 12. Thus assuming that the panel 10 is laid say on a floor, this will provide both horizontal and vertical separation resistance. It should however be recognised that gravity and the weight of the panel 10 itself also aids in preventing vertical separation.

When the male recess Rm engages the female protrusion Pf there is initially an elastic widening of the recess Rm to enable the surface Cm2 to pass or roll down the surface Cf2. Additionally or alternately, the passage of the protrusion Pf into the recess Rm may be achieved by an elastic compression of the protrusion formed by the surface Cm2 and/or the portion of the protrusion Pf adjacent to surface Cf2. It would be appreciated by those skilled in the art that the engagement process will involve an over centre snap action as a lateral most extensive point of the surface Cm2 passes the laterally most extensive point of surface Cf2. This is accompanied by a relatively rapid seating of the surface Cm2 in the concavity 117. Simultaneously, the planar surfaces 104 and 114 are located in facing relationship.

As in the system 22*a* and 22*b* the surfaces 104 and 114 of system 22*c* have a common plane of tangency LP3 that lies at the angle β with respect to the lower surface 14 of a corresponding panel where 110°≥β≥90°.

In each of the embodiments of the second system 22 (i.e. 22, 22*a*, 22*b* and 22*c*) the male and female parts Jm and Jf are configured so that when engaged horizontal separation is resisted by the abutment or at least very close positioning of at least the surfaces 104 and 114; and the surfaces Cf2 and Cm2. Accordingly there is no ability for any appreciable lateral movement between joint panels 10 due to the abutment of these surfaces. Vertical separation is also resisted by, in addition to the force required to counteract the action of gravity: (a) the force required to distort or spring open the recess Rm so as to cause the surface Cf2 to ride up and over surface Cm2; and (b) the abutment or eventual abutment (in the event of system 22*c* due to gap GI) of the surface Cm1 with the surface Cf1.

Notwithstanding the above, it should also be noted that in some embodiments it is not a requirement for there to be any substantive pressure exerted by the opposite sides of the recess Rm on the protrusion Pf when the parts Jm and Jf are engaged. More specifically in such embodiments, there is no requirement for the coupling to generate a force such as to cause the upper surfaces 12 of adjoining panels 10 to bear against each other to form a gap free continuous surface.

Indeed, such contact is impossible with the embodiment of system 22*c* and panel 10*c* due to the provision of the upper gap Gu. Further in system 22*c* there is no force generated by engagement of the joints Jm and Jf in any of the systems 22 that will result in an abutment of the inner female joint surface FL1 and the outer male joint surface ML1 in planes that lie parallel to the surface 12. The only abutment between the surfaces is in planes that extend perpendicular to this surface 12 being in the regions 234 and 238.

In each of embodiments of the systems 22-22*c*, once the parts Jm and Jf are engaged, there is no portion of either part that is maintained in a bent or a partially bent condition relative to its pre-coupling configuration. That is not to say that a portion of a joint may not be under some compression if the opposite sides of the recess do exert some pressure on the protrusion Pm. But compression and bending are very different and result in different effects. It clearly possible and very common for an article to be under compression but not to be bent.

Figure 1A:
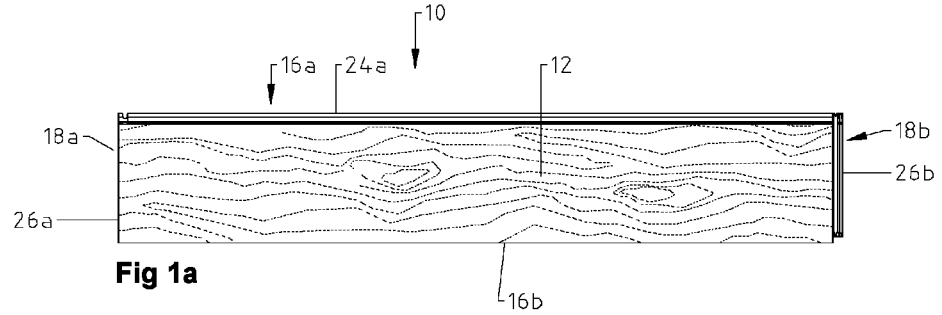
Figure 13A:
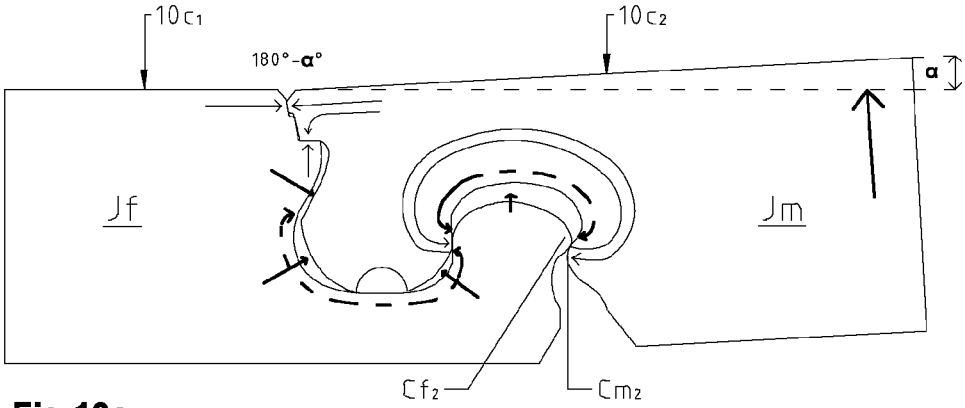
FIG. 13*a* illustrates the effect of relative rotation in a first direction of the joined panels shown in FIG. 12*a;*
Figure 13B:
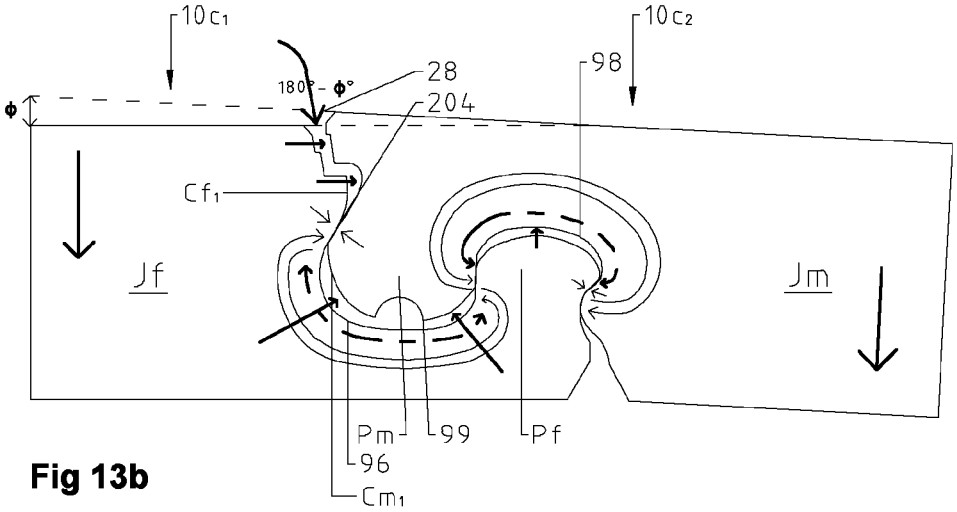
FIG. 13*b* illustrates the effect of relative rotation in an opposition direction of the joined panel shown in FIG. 12.

In the system 22*c* the gaps Gu and GI may assists in facilitating a rotational motion of joined panels 10*c* relative to each other. This property may be more useful when the system 22*c* is used on all four sides of a panel to form a vertical surface covering system than when used on the transverse ends only for a lay down system as depicted in FIGS. 1-3. The effect of the rotational motion is depicted in FIGS. 13*a* and 13*b*. In FIG. 13*a* one panel 10*c*2 is shown coupled with a panel 10*c*1 but rotated by +α° relative to the panel 10*c*1. The designation of a positive degree of rotation is intended to denote a relative rotation between panels 10 such that the upper surfaces 12 of the panels are rotated toward each other. In FIG. 13*a* this is represented by the excluded or outer angle between the surfaces 12 of panels 10*c*1 and 10*c*2 reducing from a common laid flat condition of 180° to 180°−α°.

Figure 14A:
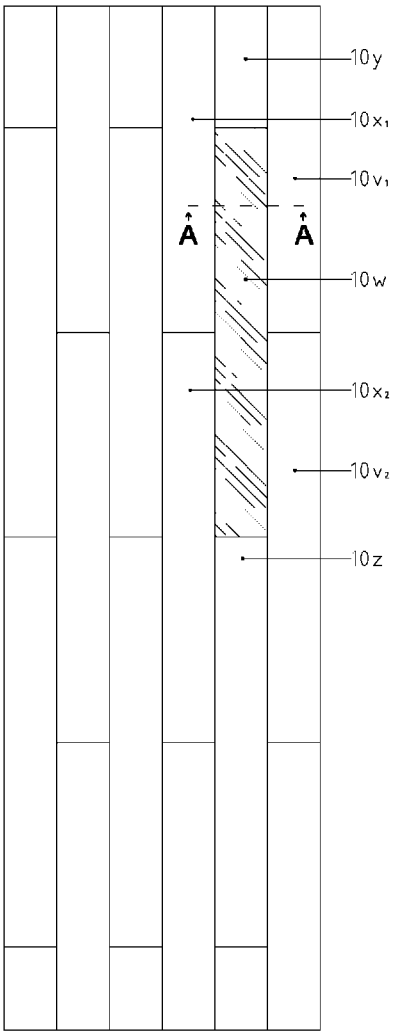
FIGS. 14*a*-14*s* depict a sequence of steps for the removal and replacement of an embodiment of the disclosed panel, made of a rigid materiel such as natural timber, bamboo or wood laminate having any one of the disclosed vertical joint systems on all of its sides.
Figure 14C:
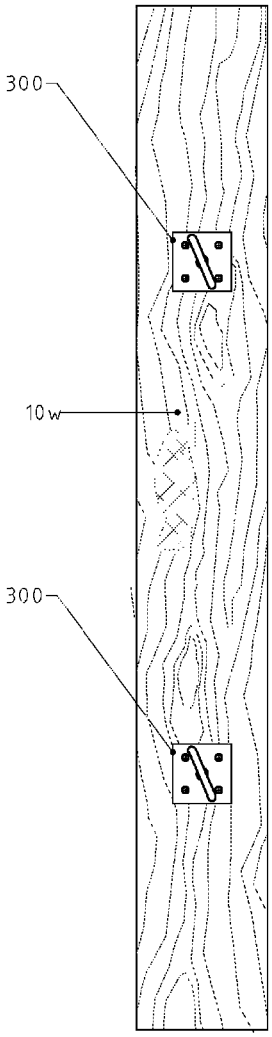
FIGS. 14*t*-14*y* depict a sequence of steps for the removal and replacement of a disclosed panel being made of plastics material and having any one of the disclosed vertical joint systems on all of its sides.
Figure 14B:
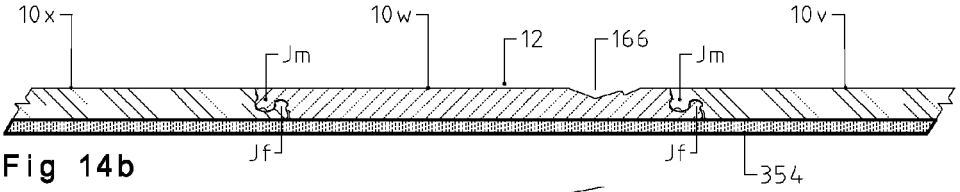
Figure 14D:
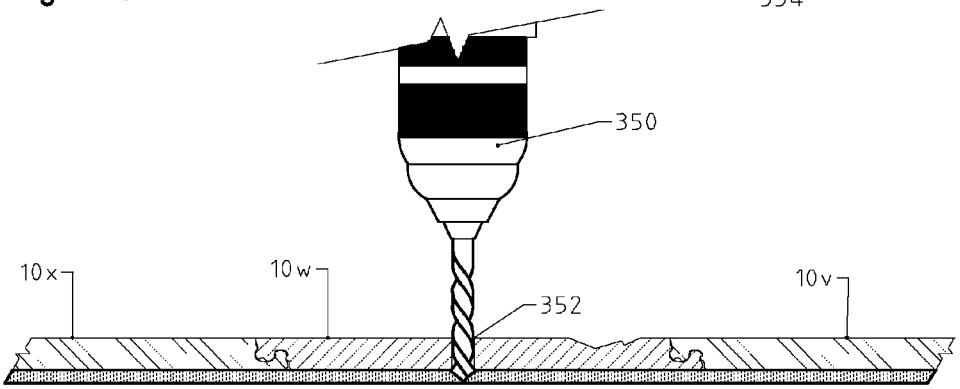

FIG. 13*b* illustrates rotation in an opposite direction where the panel 10*c*2 is rotated by −φ° relative to the panel 10*c*1. The designation of a negative degree of rotation is intended to denote a relative rotation between panels 10 such that the upper surfaces 12 of the panels are rotated away from each other; or equivalently the lower surfaces 14 are rotated toward each other. In FIG. 14*b* this is represented by the excluded or outer angle between the surfaces 12 of panels 10*c*1 and 10*c*2 increasing from a common laid flat condition of 180° to 180°+φ°.

Thus, if the panels 10*c*1 and 10*c*2 are initially in a common laid flat condition which would correspond to a situation where their respective lower surfaces 14 are coplanar, the panels can rotate by −α° to +φ° relative to the other from that initial lay flat condition. The maximum of α° and φ° are not the same, rather the maximum of the angle φ° is greater than the maximum of α°. In one example α°≤3° (i.e. α° is up to 3°); while φ°≤7° to 10° (i.e. φ has a maximum, of up to about 7° to 10°).

The ability for the panels to rotate by ±3° (i.e. α=φ=3°) is useful to accommodate the laying of panels on undulating or uneven surfaces. The ability for the panel rotate by up to −7° to −10° (i.e. φ=7° to 10°) facilitates decoupling or removal of connected panels particularly for a vertical surface covering system where the system 22*c* is used on all sides of a panel (e.g. part Jm on two adjacent sides such as 16*a* and 18*a* and part Jf on the remaining two adjacent sides 16*b* and 18*b*).

With reference to FIG. 13*a*, it will be seen that when the panel 10*c*2 is rotated α=+3° relative to the panel 10*c*1, eventually portions of the inner female joint surface FL1 and the outer male joint surface ML1 that were previously spaced by the upper gap Gu come into contact. The pivoting or rotational motion is at least to an extent levered about the first contact region 234. As the panel 10*c*1 is rotated in a positive direction there is increased pressure between the datum surface 200 and overlying surface 202. As the pivoting action continues eventually the surface 260 will come into contact and abut the surface 248 and the surface 264 will abut the surface 252. While this is occurring the surface Cf2 will commence to slide up the surface Cm2, and the planar surface 114 will also slide up along and relative to the surface 104. However, the sliding motion of the surface Cf2 over the surface Cm2 will terminate prior to the laterally outer most point of Cm2 passing the laterally outer most point of Cf2 thereby maintaining a vertical grab.

With reference to FIG. 13*b*, when the panel 10*c*2 is rotated by φ=−3° the upper gap Gu widens and the inner female joint surface FL1 comes into contact with the outer most male joint surface ML1 at a location below the first contact region 234. This is accompanied by a lifting of the distal end 99 from the root surface of recess Rf. Additionally, the surface Cm2 slides down the surface Cf2 toward the lower surface 14 of the panel 10*c*1. Horizontal separation remains inhibited due to the locating of the protrusions Pm and Pf in the recesses Rf and Rm respectively. Vertical separation is also maintained by action of the engagement of: the surface 204 with the surface Cf1; and, the surface Cm2 with the surface Cf2.

When the panels are formed with the female and male joints Jm and Jf of any of the second systems 22-22*c* extending along each of two sides of a panel such that for example male part Jm along sides 16*a* and 18*a* and the female part Jf along sides 16*b* and 18*b*, the panel 10 is a true vertical panel and can be installed and withdrawn by motion in a plane perpendicular to the surface 12. As is understood by those in the art this means that the panels are disposed in an orientation such that their major surfaces 12, 14 are substantially parallel to the substrate onto which the panels are to be laid (and thus parallel to any previously laid panels) and applied or coupled by application of a force substantially perpendicular to the plane of the major surfaces 12, 14. Removal occurs in a similar but reverse manner where a panel connected on all four sides with other panels is lifted or moved away from the connected panels in a direction substantially perpendicular to the plane of the surfaces 12, 14. This is done in a manner such that the lifted panel remains substantially parallel to its laid flat or adjoined condition while it is being lifted.

The procedure for engagement and disengagement of panels provided with the second joint systems 22, 22*a*, 22*b* and 22*c* when provided on all four sides of a panel (i.e. for a vertical surface covering system) is the same as described in detail in applicant's international publication number WO 2012/126046 (PCT/AU2012/000280). Nevertheless, the process will also be briefly described here with particular reference to the system 22*c*.

The engagement of the female and male parts Jm and Jf of a plurality of panels 10 is a particularly simple process. This process is the same irrespective of the material from which the panel is made, e.g. wood, manufactured wood, bamboo, plastics materials or composite materials. The protrusion Pm to be located above and in rough alignment with the recess Rf and consequently for the recess Rm to be located roughly above the protrusion Pf. It should be noted that at this time the panels to be engaged lie either substantially coplanar, or with the panel to be engaged will lie in a slight negative plane with reference to a previously laid panel. This is shown for example in FIGS. 14*p*-14*r*.

A downward pressure is applied in a direction perpendicular to the surface 12. This has the effect of springing open the recess Rm temporarily to snap over the protrusion Pf and also temporarily elastically opening the recess Rf to accommodate the protrusion Pm. This results in the panels moving with a combined motion both laterally toward each other and vertically toward each other. This motion is arrested when the surface 202 abuts the datum surface 200. This provides a self-flushing feature of the panel 10 where the surfaces 12 of the adjoined panels 10 should now be flushed with each other on the assumption that the panels 10 are laid on a flat substrate. (With systems 22 and 22*b* where there is no datum surface 200, this vertical motion is arrested by the distal end 99 of protrusion Pm abutting the root surface 96 of recess Rf.)

Once engaged, no portion of either the male or female parts Jm and Jf will be in a bent condition with reference to its unjoined or disengaged configuration for any of systems 22-22*c*. Further, the engagement of the protrusion Pf in the recess Rm does not generate a tension force which brings together the upper surfaces 12 on the panels 10*c* for system 22*c*. Assuming a flat substrate, upper and lower gaps Gu and GI exist between the respective facing surfaces FL1 and ML1 of the connected panels 10*c*. The only contact in this mutually facing region is in a direction perpendicular to the surface 12 by way of contact between surfaces 200 and 202 in the first contact region 234, and between the distal end 99 and root surface 96 of recess Rf. There is no contact between portions of the surfaces FL1 and ML1 a direction K parallel to the surface 12.

The process of removal of a damaged panel when the panel is made of a rigid material such as hard wood, bamboo, laminate, HDF or MDF laminate or manufactured wood will now be described with particular reference to FIGS. 14*a*-16*b*. (The removal process for panel made of pliable materials such as vinyl and PVC will be described later.) As will become evident from the following description the removal process of a damaged panel relies on the relative rotation enabled between the joined panels by virtue of the configuration of the joint system 10. FIGS. 14*a*-14*s* depict in sequence various steps in the removal and replacement of a damaged panel. The removal and replacement is facilitated by use of an extraction system which comprises in combination a jack 300 shown in FIGS. 15*a* and 15*b* and a wedge tool 302 shown in FIGS. 16*a* and 16*b*.

The jack 300 is a simple hand screw jack which is applied to a panel being removed. The screw jack 300 is provided with an elongated threaded shaft 304 provided at one end with a cross bar handle 306. The thread of the shaft 304 is engaged within a threaded boss 308 formed centrally on a square clamp plate 310. The boss 308 overlies a through hole in the plate 310 through which the shaft 304 can extend. Distributed about the plate 310 are four through holes 312 for receiving respective fastening screws 314.

The wedge tool 302 comprises a wedging block 316 coupled at one end to a handle 317. The wedging block 316 is formed with a base surface 318 which in use will bear against a surface on which the panels 10 are installed, and an opposite surface 320 which lies beneath and contacts the lower surface 14 of the panel 10 adjacent the panel being removed. The surface 320 includes the relatively inclined portion 322 and a land 324 that lies parallel to the base surface 318. The inclined portion 322 extends from a leading edge 326 of the wedge block 316 toward the handle 317. The handle 317 is bent intermediate of its length and has a free end 330. Notwithstanding the bend the handle 317 lies in a plane through a line of symmetry of the wedge block 316.

FIG. 14*a* depicts an area of flooring including a damaged panel 10*w* which is connected along each side with adjacent panels 10*v*1, 10*v*2, 10*x*1, 10*x*2, 10*y* and 10*z*. Each of the panels 10 have a male part Jm along one longitudinal side and one short or transverse side; and a female part Jf along the other longitudinal side and the other short or transverse side.

In order to replace the damaged panel 10*w*, a drill 350 (see FIG. 14*d*) is used to drill a hole 352 through the panel 10*w* for each jack 300 used in the extraction process. As illustrated in FIGS. 14*c*-14*k* each hole 352 is formed along a longitudinal centre line of the panel 10*w*. The hole 352 is formed of a diameter sufficient to enable the passage of shaft 304. The length of the panel 10*w* being removed dictates the number of jacks 300 that may be required. Thus in some instances, extraction can be effected by the use of one jack 300 whereas others may require two or more jacks. In this particular instance two jacks 300 are used as shown in FIG. 14*c*, but for ease of description the extraction process refers to only one of the jacks 300.

Figure 14E:
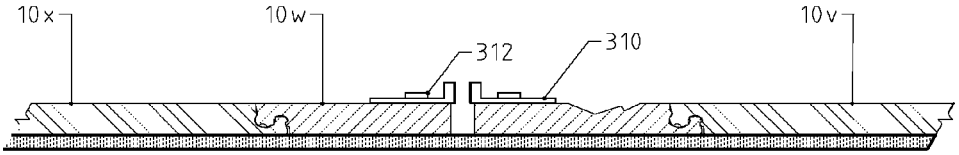
Figure 14F:
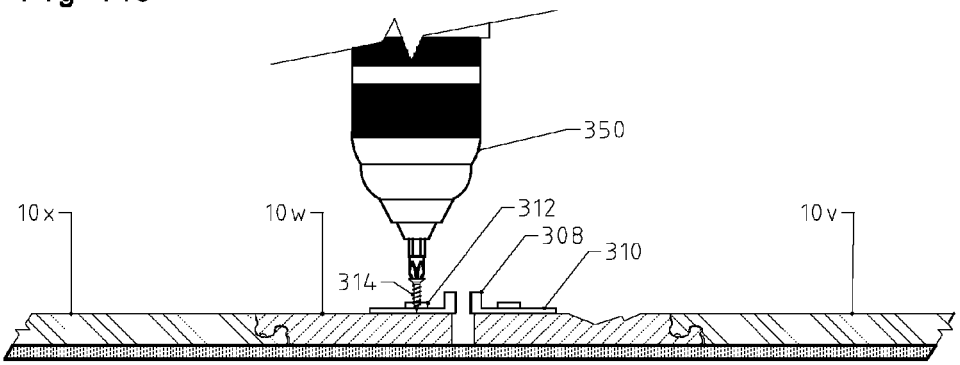

Upon completion of the hole 352, the clamp plate 310 is placed on the panel 10*w* with its boss 308 overlying the hole 352 hole as shown in FIG. 14*e*. The plate 310 is fixed to the panel 10*w* by way of the four self-tapping screws 314 that pass through corresponding holes 312. This is illustrated in FIG. 14*f*. The screws may be screwed in by using a screw bit in place of the drill bit in the drill 350; or by using a manual screwdriver.

Figure 14G:
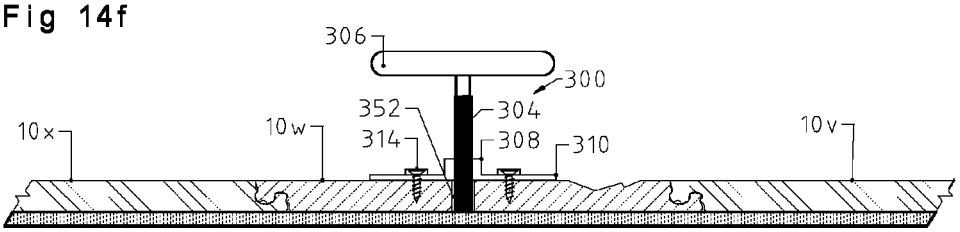
Figure 14H:
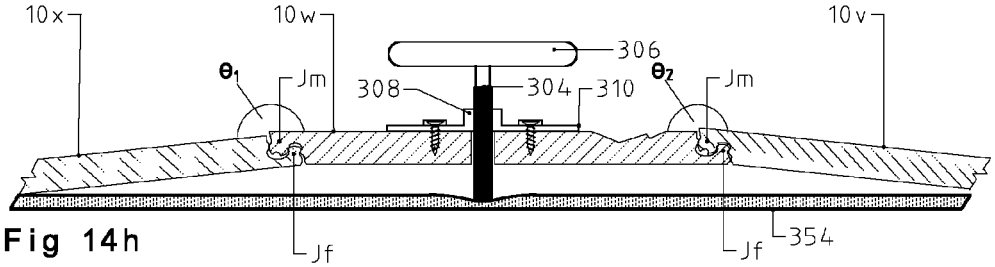

The next stage in the removal process is shown in FIGS. 14*g* and 14*h* involves engaging the shaft 304 with the threaded boss 308 and then screwing down the shaft 304 by use of the handle 306 to lift the panel 10*w* above underlying surface 354. It should be immediately recognised that this action requires the relative rotation negative rotation described above with reference to FIG. 13*b*. Although, as will be explained shortly the negative rotation goes beyond the 3° of FIG. 13*b* and to about 7° to 10°. The negative rotation relative to panel 10*w* and is experienced by panels 10*v*1, 10*v*2, 10*x*1 and 10*x*2, along the longitudinal sides and by panels 10*y* and 10*z* on the short sides. There will also be a relative positive rotation of the panels connected to the panels 10*v*1, 10*v*2, 10*x*1 and 10*x*2 distant the panel 10*w*.

The jack 300 is operated to lift the damaged panel 10*w* vertically upward by a distance sufficient to effect a negative rotation between the damaged panel 10*w* and the adjacent adjoining panels. During this lifting the panel 10*w*, as depicted in the Figures, remains parallel to its original connected condition where it lays flat on the surface 354. The negative rotation is in the order of 7°-10°. This is explained with particular reference to FIG. 14*h* which shows an angle $\theta 1=180+\varphi$ between the upper surfaces 12 of panels 10*v*1 and 10*v*2 (hereinafter referred to collectively as panels 10*v*) and 10*w*; and an angle $\theta 2=180+\varphi$ between upper surfaces 12 of panels 10*w* and of panels 10*x*1 and 10*x*2 (hereinafter referred to collectively as panels 10*x*). Prior to lifting of the panel 10*w*, it should be understood that the angles θ1 and θ2 will be 180° assuming that the surface 354 is flat. Further as is evident from the Figures during the lifting $\theta 1=\theta 2$. Indeed this follows from the panel 10*w* being lifted vertically as distinct from being lifted at an angle or inclined disposition relative to the surface 354. The amount by which the angles θ1 and θ2 exceed 180° during the disengagement is equated to the angle φ° of negative rotation of the panels during this process. For example if angle θ1 (and thus θ2) is say 187° then the relative negative rotation between panels 10*a* and 10*b* is $\varphi°=7°$.

It will be understood by those skilled in the art that vertically raising of any prior art system having a lateral projection (e.g. a tongue) that seats in a groove or recess of an adjacent panel is virtually impossible without breaking the tongue or fracturing the panel with the groove. Thus this action if attempted with a prior art system is very likely to result in the damaging (for example fracturing of the tongue) of one more panels which were not previously damaged or in need of replacement.

The ability for the panels 10 to be removed by vertical lifting is a direct result and consequence of the configuration of the parts Jm and Jf. It will also be recognised by those skilled in the art that the relative movement between panels 10 being disengaged is directly opposite that of "lay-down" tongue and groove panels; and even then such systems can only be disengaged where the disengaged panel already has one free longitudinal side that is not connected to an adjacent panel. Embodiments of the present panel 10 and male and female engaging parts Jm and Jf provide the ability to disengage a panel connected on all four sides with other panels without damaging those panels by virtue of this vertical lifting. Further the repair of a floor can now be achieved in a world's best practice manner fully reinstating the integrity of the floor without the need to peel back the entire floor from one wall to the damaged panel(s), and/or hire a professional installer.

The jack 300 mechanically lifts and self supports the panel 10*w* and all other panels 10 connected to it. Thus the installer does not need to rely on their own strength to lift and hold the panels. In contrast some prior art systems use suction cups for example as used by glaziers to hold glass sheets to grip a panel to be removed. The installer must then use their strength to lift the panel. While this is difficult enough it becomes impossible if the panel is also glued to the surface 354. The jack 300 which provides a mechanical advantage is able to operate in these circumstances. In addition as the jack self supports the panels 10 the installer is free to use both hands in the repair process and indeed is free to walk away from the immediate vicinity of the panel 10*b*.

The jack 300 is operated to lift the panel 10*w* vertically upwards to a location where the negative rotation between the panel 10*w* and adjacent panels 10*v* and 10*x* is in the order of 7° to 10°. This is the position shown in FIGS. 14*h* and 17*d*. In this position, there is partial dislocation of the parts Jm and Jf between panels 10*w* and 10*v*. With particular reference to FIG. 17*d* this partial dislocation arises from the surface Cm1 riding along surface Cf1 with the point 210 snapping past a laterally most extensive point 257 on the surface Cf1. Notwithstanding this dislocation the panels remain engaged due to the pinching of protrusion Pf between opposite surfaces of the recess Rm.

The jack 300 can be provided with a scale to give an installer an indication of the when the negative rotation is in the order of 7° to 10°. The scale could comprise for example a coloured band on the shaft 304 which becomes visible above the boss 308 when shank has been screwed down to lift the panel sufficiently to create the above mentioned negative rotation. Several bands could be provided on the shank for panels of different thickness.

Figure 14I:
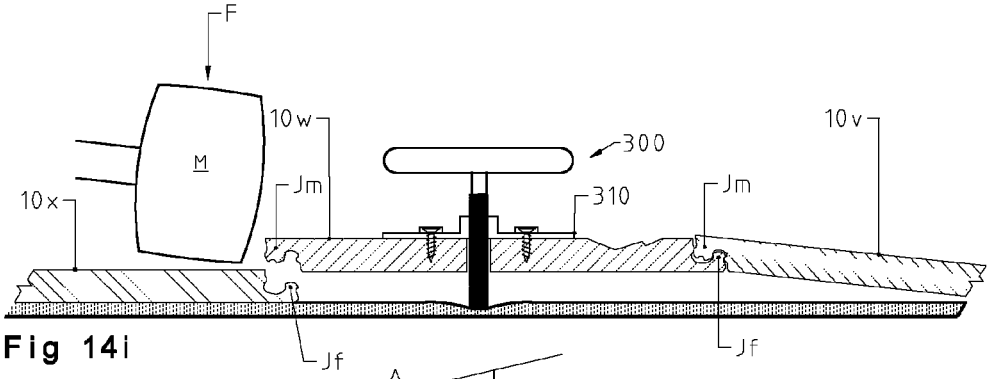

In order disengage panel 10*w* one must first disengage whichever of the panels 10*v* or 10*x* has its female part Jf engaged with panel 10*w*. In this instance this is panel 10*v*. Working above the panels 10 an installer will not immediately know that it is panel 10*v*. But this can be easily determined by either: lightly tapping on both panels 10*v* and 10*x*; or, applying light hand pressure and feeling for joint movement. Due to the orientation of the joints this tapping will result in panel 10*w* fully disengaging in the vicinity of the tapping. Thereafter as shown in FIG. 14*i*, applying a downward force or pressure on the panel 10*w* at other locations along its length will result in a total disengagement of parts Jm and Jf on the panels 10*w* and 10*v*.

The interaction between the respective surfaces on the parts Jm and Jf on the panels 10*w* and 10*v* from the position where the panels are fully engaged and lie on the same plane as shown in FIG. 14*f* to the point of disengagement shown in FIG. 14*i* will be described in more detail with reference to FIGS. 17*a*-17*e*.

Figure 17A:
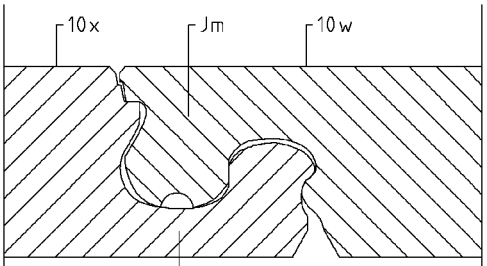
FIGS. 17*a*-17*f* depict in sequence the disengagement of male and female parts of a vertical joint system that may be incorporated in embodiments of the panel.
Figure 17D:
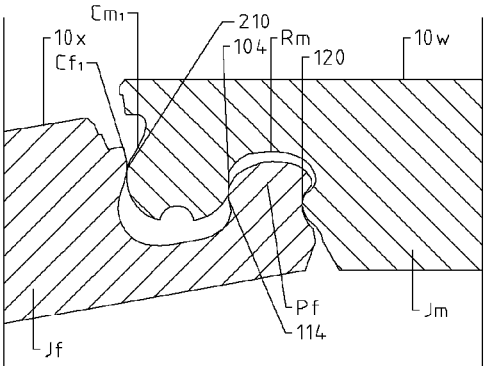
Figure 17B:
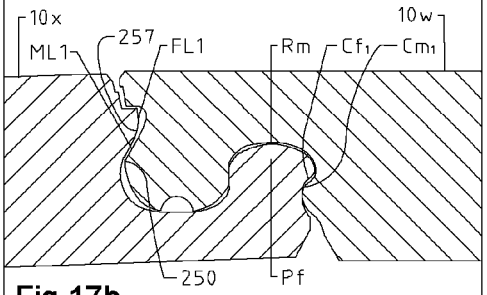
Figure 17E:
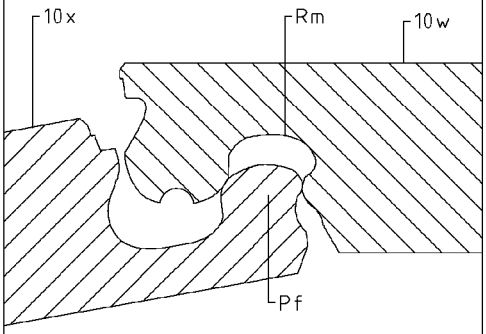

FIG. 17*a* illustrates the panels 10*w* and 10*v* along their joined sides prior to operation of the jack 300. This equates with the relative juxtaposition of the panels shown in FIGS. 14*a*, 14*b*, and 14*d*-14*g*. As the jack 300 is operated to progressively lift the panel 10*w* from the surface 354, there is a gradual rotation between the respective parts Jm and Jf. FIG. 17*b* illustrates the part Jm of panel 10*w* and part Jf of panel 10*v* at relative rotation of approximately −2°. Here the upper gap Gu commences to open up and the recess Rm rotates about the domed head of the protrusion Pf. This has the effect of sliding the surface 104 in a generally upward direction along surface 114 and the surface Cm2 riding down and pressing harder against surface Cf2. Thus as this part of the disengagement proceeds there is increased compression on or pinching of the protrusion Pf. The rotational freedom to move in this manner is facilitated at least in part by the lower gap GI between the inner female joint surface FL1 and the outer male joint surface ML1. Also this rotation is now pivoted in the contact region of surface Cm2 and Cf2.

Figure 17C:
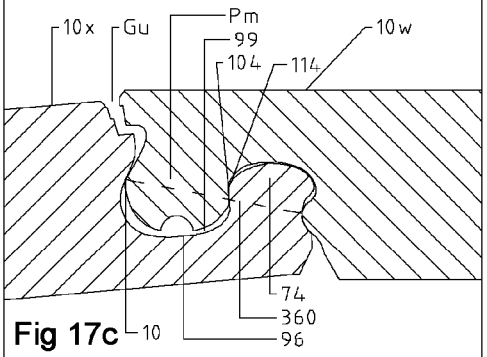

FIG. 17*c* shows the effect of continued lifting of the panel 10*w* to a position where the relative negative rotation between the panels 10*v* and 10*w* is about 5°. Here the opening of the upper gap Gu is more pronounced and the surface Cm1 contacts the surface Cf1 in the region of the point 57. That is, a portion of the inner female joint surface FL1 and a portion of the outer male joint surface ML1 between the previous upper and lower contact regions 234 and 238 come into contact with each other. The distal end surface 99 is lifted from the root surface 96. The surface 104 continues to ride up surface 114 there is increased pressure exerted by surface Cm2 on surface Cf2. Moreover because the protrusion Pm now contacts the opposite surfaces of the recess Rf not only is there compression in the protrusion Pf, there is also compression in the protrusion Pm. Indeed there is increased tension and pressure along a "line" 360 containing contact points between the surfaces MI1 and FL1; 104 and 114; and Cm2 and Cf2.

Continued operation of the jack 300 increases the angle between the panels 10*v* and 10*w* to approximately −7° as shown in FIG. 17*d*. At this point, the point 210 has elevated up past the lateral most point 57 on surface Cf1/FL1. This releases some of the tension in the connected panels 10 at the parts Jm and Jf and would ordinarily be indicated to the installer by an audible "clunk". However the protrusion Pf remains compressed or pinched on opposite sides by the recess Rm. Thus while at this −7° disposition, the parts Jm and Jf are still partially engaged and in the absence of any external force, maintain vertical and horizontal locking of the panels 10*v* and 10*w*.

Figure 17F:
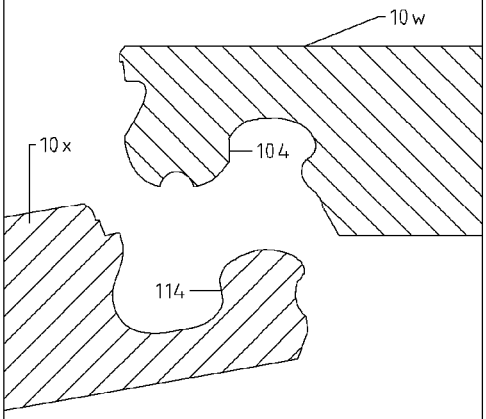

The application of a downward pressure or force on the panel 10*v* results in one or both of: compressing the protrusion Pf; or, opening of the recess Rm to enable the protrusion Pf to escape the recess Rm. Now the panel 10*v* is free to fall back to the surface 354 as shown in FIG. 17*f* and FIG. 14*i*. Thus at this point in time the panels 10*v* and 10*w* are fully disengaged.

Figure 14J:
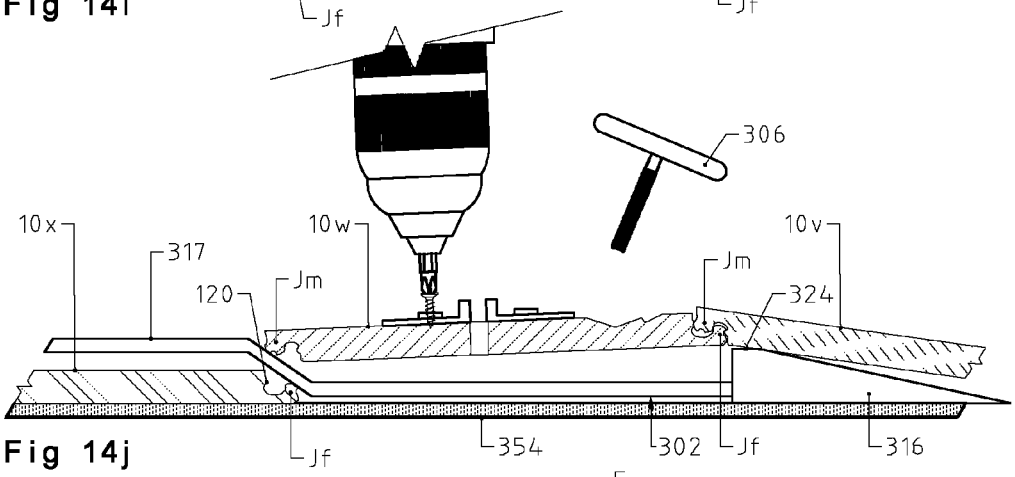

However removal of the panel 10*w* also requires disengagement of the part Jf of panel 10*w* from the part Jm of panel 10*x*. This process is shown in FIGS. 14*j* to 14*l*.

Immediately after disengagement of panels 10*w* and 10*v*, the panel 10*w* is held above surface 354 by the jack 300. To continue the replacement process the panel 10*w* is lowered back to the surface 354 by unscrewing shaft 304 from the boss 308 of the clamp plate 310. An installer next grips and lifts the joint Jm of panel 10*w* to insert the wedge tool 302 between the disengaged joints of the panels 10*w* and 10*v* and push it to a position where the land 324 of surface 320 is in contact with the major surface 14 of panel 10*x* and inside of the joints Jm and Jf. This is shown in FIG. 14*j*.

Disengagement of the panel 10*w* from the panel 10*x* is now effected by initially rotating the panel 10*x*10*w* by about −7° to −10° to effect a disengagement of the surface Cm1 of panel 10*x* from the surface Cf1 in the joint Jf of panel 10*w*. The wedge tool 302 is configured to assists the installer in achieving this rotation. This is also depicted in FIG. 14*j*. Moreover when the wedge block 316 is under the under panel 10*x* slightly inboard of its joint Jm, and the panel 10*w* is rotated in the anti-clockwise direction toward the handle 317, the panel 10*w* will rotate or pivot by 7° to 10° prior to or by the time it abuts the handle 317. The reaching of this position is ordinarily denoted by an audible "clunk" as the surface Cm1 passes from below to above surface Cf1. This juxtaposition of the joints Jm and Jf is as shown in FIG. 17*d*.

Figure 14K:
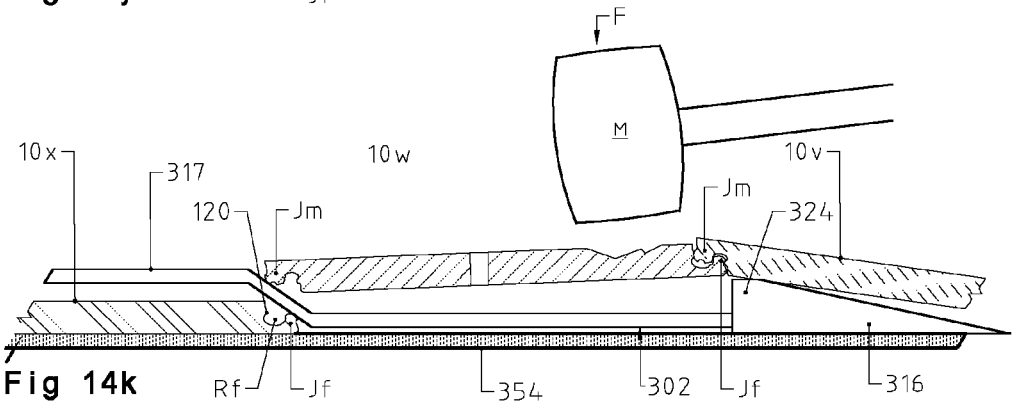
Figure 14L:
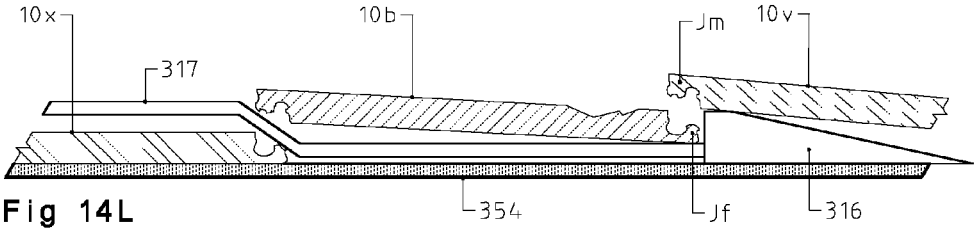
Figure 14M:
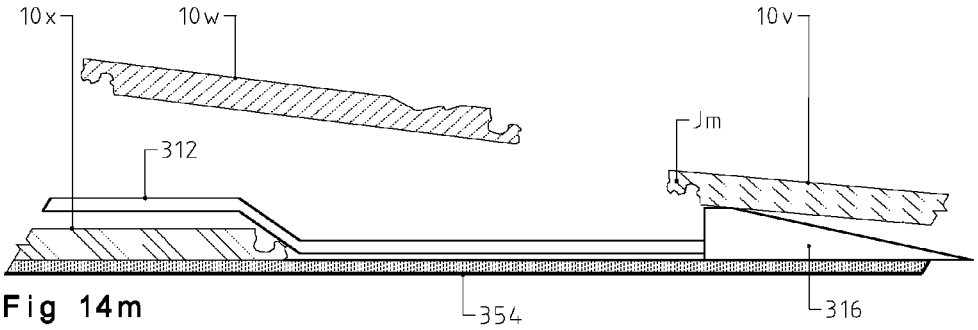
Figure 14N:
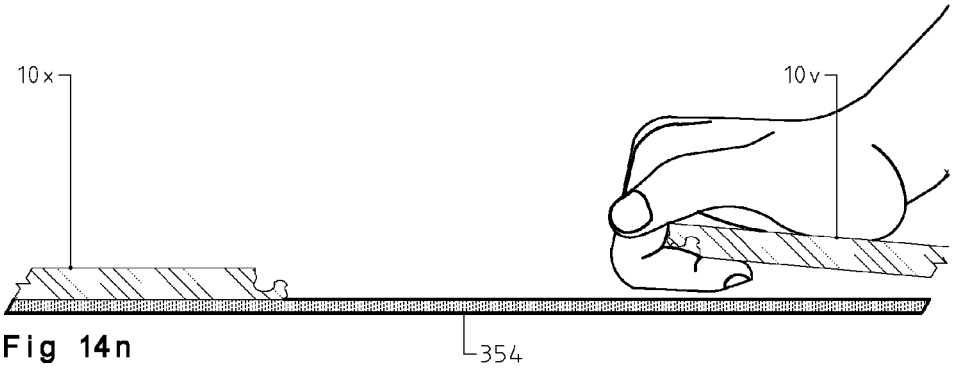
Figure 14O:
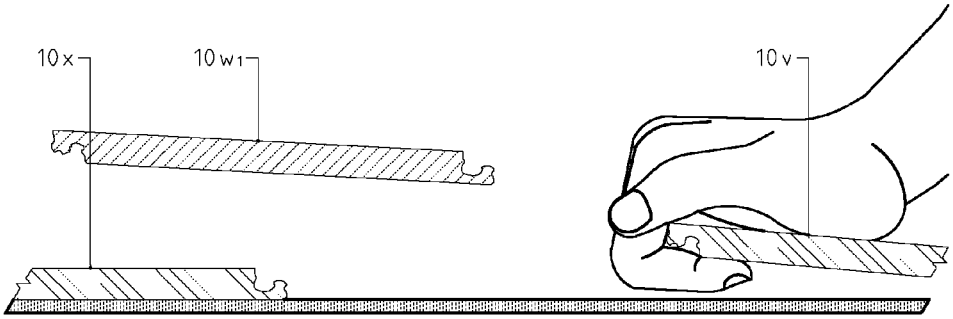
Figure 14P:
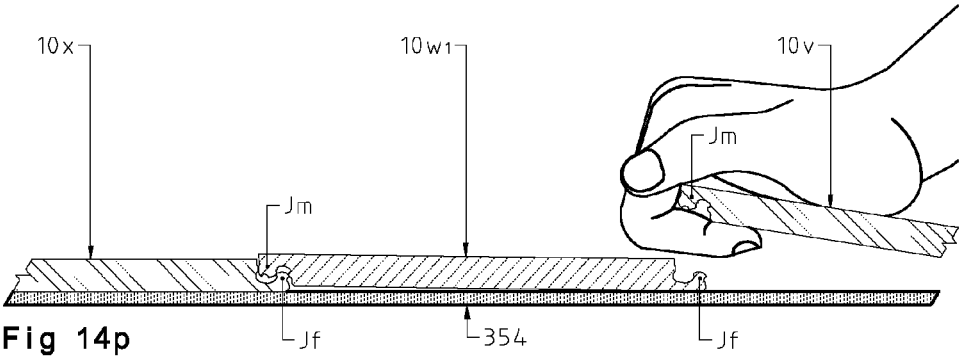

Subsequent application of downward pressure or force for example by way of rubber mallet M or pushing by hand as shown in FIG. 14*k* will result in total disengagement of the joints Jf and Jm of panels 10*w* and 10*x* respectively as shown in FIG. 14*i*. Now the damaged panel 10*w* is totally disengaged from both adjacent panels 10*w* and 10*x* and can be removed.

To replace the damaged panel 10*w* with a new panel 10*w*1 an installer now removes the wedge tool 302, lifts the edge of panel 10*x* by hand and slides a new panel 10*w*1 beneath the raised panel 10*x* so that the joint Jm lies above the joint Jf. The opposite side of panel 10*w*1 rests on panel 12*a*. This sequence of events is shown in FIGS. 14*m*-14*p*.

Figure 14Q:
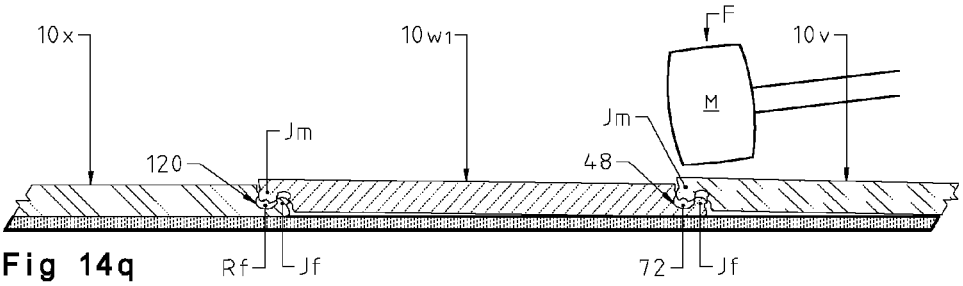

The installer now lowers the panel 10*x* onto the panel 10*w*1. When this occurs, the male joint Jm of panel 10*x* rests on the neck 120 of female joint Jf of panel 10*wi*; and the joint Jm of panel 10*w*1 will rest on the neck 120 of the joint Jf of previously laid panel 10*v*. This is shown in FIG. 14*q*.

Figure 14R:
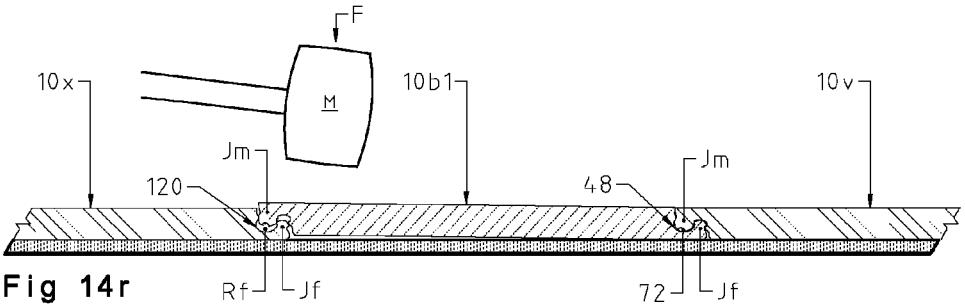
Figure 14S:
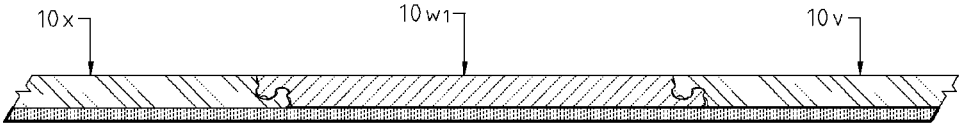

To fully engage the panel 10*w*1 downward force or pressure is applied on the male joints Jm of panels 10*x* and 10*w*1. This can be done in either order, i.e. panel 10*x* then panel 10*w*1 or panel 10*w*1 then panel 10*x*. FIG. 14*q* shows the configuration when joint Jm of panel 10*x* is first engaged with joint Jf of panel 10*w*1. FIG. 14*r* depicts the joint Jm of panel 10*w*1 now engaged with joint Jf of panel 10*v*, reinstating the floor as shown in FIG. 14*s*.

It should be understood that the force described in the previous paragraph for engaging panels 10*w*1 and 10*v* is applied progressively along the length of the panels. Thus the parts Jm and Jf are progressively engaged along the panels 10. While this occurs a first length of the panels is fully engaged while a second length is fully disengaged. Progressively the first length increase and the second length decreases until the full length of the panels is engaged. This is different to the process of engaging a tongue and groove joint in a lay down system where generally the full length of a tongue must be fully located in a groove before the laying down of the panel with the tongue can occur. This can become problematic when engaging long panels as there are often some panels which are bowed or otherwise of imperfect manufacture which requires several installers to push, tap and wriggle the full length of the tongue in the groove before lying down.

When the panels are made of a plastics or composite material such as vinyl and PVC the removal process is much simpler and does not require the jack 300 or wedge tool 302. Rather all that is needed is a box cutter or Stanley knife to cut a corner of the a connected panel 10, lift up the cut corner to create an access hole, then insert ones fingers into the hole and pull up the panel to progressively disengage the engaged parts Jm and Jf. However one difference with in this process is that due to the flexibility and pliability of the panels and/or the male and female parts, the angle between joined panels to effect disengagement is higher, for example 10°-40°. Indeed the presently disclosed vertical joints system is adaptable as described later and shown in FIG. 18 to deliberately require the much higher relative angle between engaged panels to effect disengagement for pliable/plastics panels.

Figure 14T:
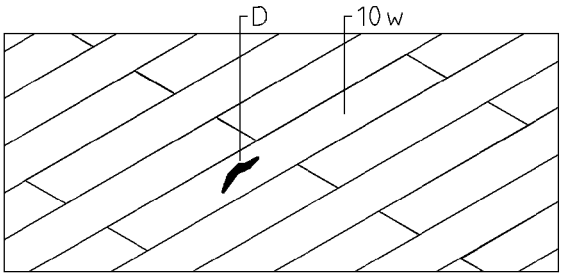
Figure 14U:
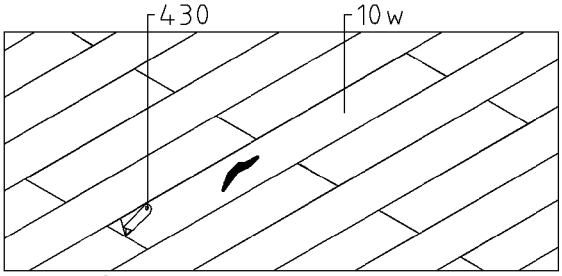

FIGS. 14*t*-14*x* depict a sequence of steps for replacing a panel 10*w* made from a plastics material and having one of the joint systems 22-22*c* on all four sides and thus forming a true vertical system. FIG. 14*t* depicts a floor composed of a plurality of panels in which one panel 10*w* sustains surface damage D. All of the panels are formed with the same vertical joint system (one of systems 22-22*c*).

Figure 14V:
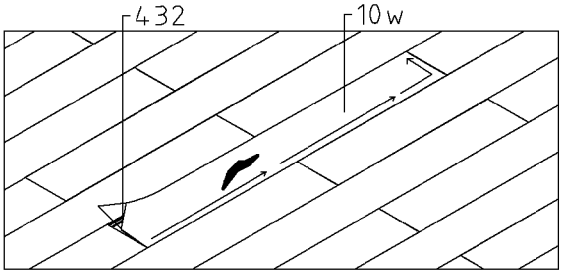
Figure 14W:
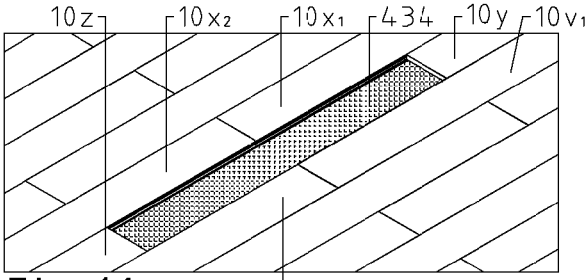

To replace the panel 10*w* a box cutter or Stanley knife 430 is used to cut and remove a small corner piece of the panel 10*w*. FIG. 14*v* depicts a panel 10*w* with a cut corner 432. Indeed this Figure depicts the cut corner being pulled upwardly from the remainder of the floor. When the corner of panel 10*w* has been cut and removed, a person can insert a number of fingers through an access hole formed by the removal of the corner. With the fingers laying underneath the panel 10*w* a person can now exert upward pressure so as to progressively disengage the parts Jm and Jf of adjoining panels. When this is done, the panel 10*w* can be removed leaving a void 434 as shown in FIG. 14*w*.

Figure 14X:
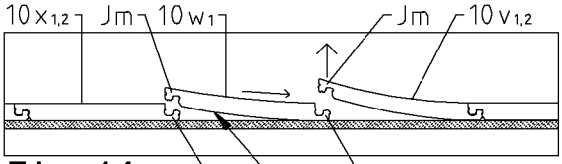
Figure 14Y:
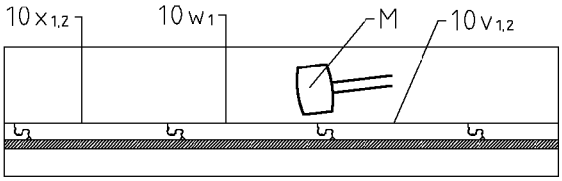
Figure 15A:
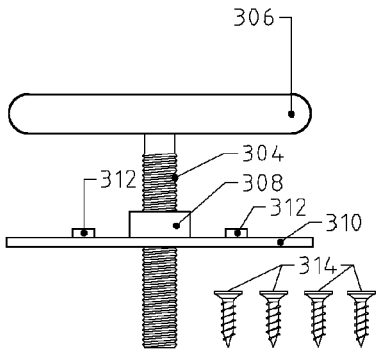
FIG. 15*a* is a side elevation of a jack that may be used in the removal of a panel in accordance with the sequence of steps shown in FIGS. 14*a*-14*s;*
Figure 15B:
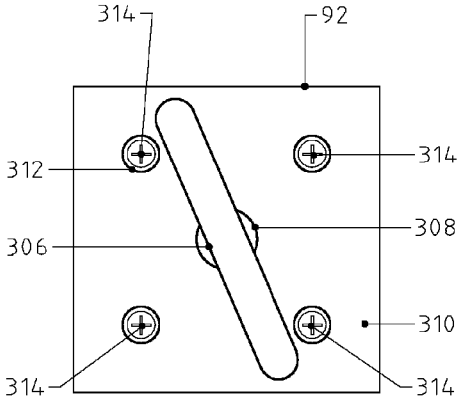
FIG. 15*b* is a plan view of the jack shown in FIG. 15*a;*
Figure 16A:
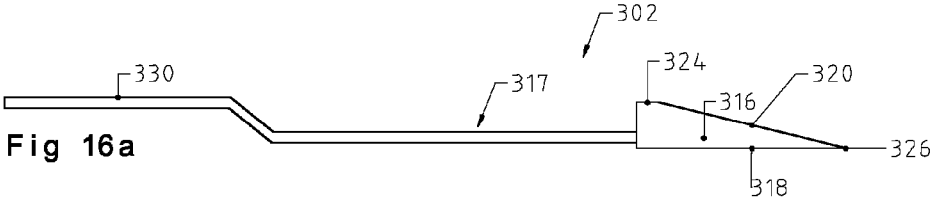
FIG. 16*a* is a side elevation of a wedge that may be used in conjunction with the jack shown in FIGS. 15*a* and 15*b* for the removal of an engaged panel.
Figure 16B:
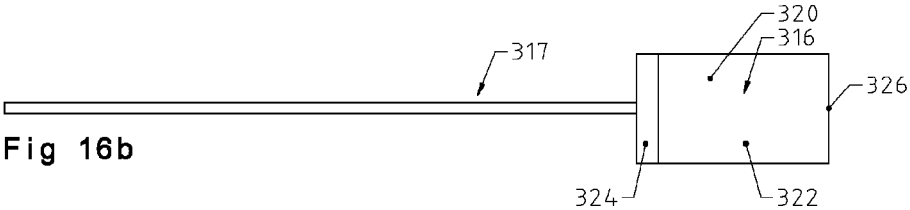
FIG. 16*b* is a top elevation of the wedge shown in FIG. 16*a;*

FIG. 14*x* illustrates a fresh panel 10*w*1 being inserted into the void 434. When inserting the fresh panel 10*w*1 adjacent panels 10*v*1 and 10*v*2 (as well as end wise adjacent panel 10*z*) are lifted to enable the female part Jf along two adjacent sides of the panel 10*w* to lie beneath the male parts Jm of the panels 10*v*1, 10*v*2 and 10*z*. Simultaneously, the panel 10*w* is orientated so that its parts Jm on its two other adjacent sides lie immediately above the parts Jf of adjacent panels 10*x*1, 10*x*2 and 10*y*. Thereafter, as shown in FIG. 14*y*, in order to reinstate the floor to its original condition downward pressure is applied along the overlying parts Jm and Jf so as to re-engage the panel 10*w*1 with each of the six adjacent joining panels 10*x*1, 10*x*2, 10*y*, 10*v*1, 10*v*2 and 10*z*.

Figure 18:
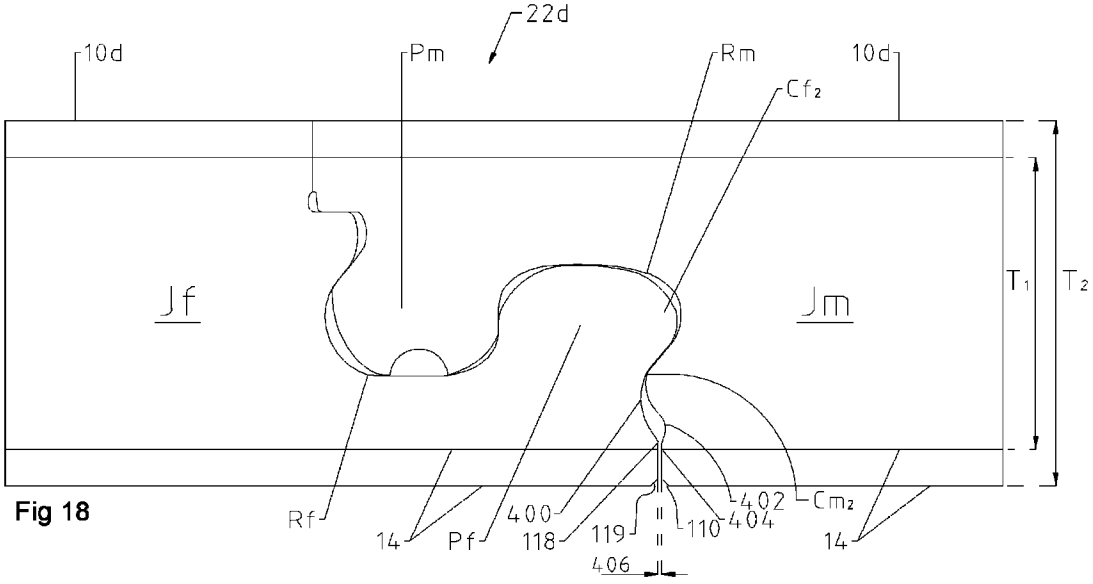
FIG. 18 illustrates a further embodiment of a vertical joint system that may be incorporated in a fifth embodiment of the panel.

FIG. 18 shows an embodiment of a vertical joint system 22*d* specifically adapted for use with panels made from plastics or otherwise pliable materials including but not limited to vinyl, PVC, the material of herein before disclosed U.S. Pat. No. 8,156,710, and pliable plastic composites. The system 22*d* can be used (a) on two sides for a lay down surface covering system (b) on all four side of a rectangular/square true vertical surface covering system. FIG. 18 shows the system 22*d* for two different panel thickness T1 an T2 which for example may be 4 mm and 5 mm respectively, although the panel is not limited to these thicknesses and may for example have a thickness of 12 mm to 2 mm.

The system 22*d* differs from system 22*a* only in the configuration of the part Jm in the region of the surfaces 118 and 119; and part Jf in the region of surfaces Cm2 and 110. This difference in configuration is provided to cause the parts Jf and Jm of engaged panels 10*d* to come into contact with each other in the vicinity of surfaces 119 and 110 at small relative angular displacement between panels, at a small degree of bending of either one of the joined panels. It is believed that this effect may be helpful in reducing peaking or unintended gapping in panels made from plastics or composite materials such as vinyl.

In the system 22*d* for the part Jf the concavity 117 below the surface Cf2 curves inwardly to an inner most point 400 then curves outwardly to a planar surface 118 that is perpendicular to surface 14. The surface 118 lies inboard of the lateral outermost point of the surface Cf2. For a panel thickness T1 the surface 118 leads directly to major surface 14. But for a panel of thickness T2 the surface 118 leads to a short inclined surface 119 and then directly to surface 14.

In the part Jm below the surface Cm2 there is a concave recess 402 which then leads to a planar surface 404. The surface 404 is perpendicular to the major surface 14. The surface 404 lies inboard of the lateral outermost point of the surface Cf2. For a panel thickness T1 the surface 404 leads directly to major surface 14. However for a panel of thickness T2 the surface 404 leads to a short inclined surface 110 which then leads directly to surface 14.

The surface 118 from part of the outer most female locking surface FL2. The surface 404 forms part of the inner most male locking surface ML2.

Irrespective of the panel thickness T1 or T2 the surfaces 118 and 404 are parallel to each other and spaced by a small gap 406. For a panel of thickness from 5 mm to 2 mm the gap 406 may be up to from 0.02 m to 0.2 mm. The idea here is that the surfaces 118 and 404 will be brought into contact with each other after minimal relative rotation of joined panels 10*d* or bending of an individual panel. This contact will set up internal forces within the joined panels 10*d* that assist in reducing the likelihood of peaking and gapping at the upper surface 12 and vertical separation of the engaged parts Jm and Jf of panels 10*d*.

Figure 19A:
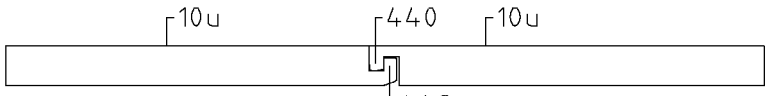
FIGS. 19*a*-19*c* depict the phenomenon of peaking that may occur in panels made from plastics material and provided with prior art joint systems.

The above effect is illustrated in FIGS. 19*a*-20*c*. FIGS. 19*a*-19*c* depict a prior art "drop lock" which is often used in laydown systems to facilitate engagement of the short or transverse sides of two panels 10*u*. The drop lock comprises male and female hook parts 440 and 442 respectively on opposite short sides of the panels 10*u*. The male hook 440 fits inside the female hook 442 with resistance to vertical motion being provided mainly by way of a compression fit between the hook parts 440 and 442. This produces a frictional resistance between the panels 10*u* against vertical separation.

FIG. 19*a* depicts the drop lock when good quality panels 10*u* are laid on a well prepared underlying surface or substrate and there is no peaking between the panels 10*u* at their short sides which contain the hook parts 440 and 442.

Figure 19B:
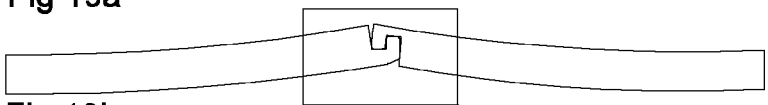
Figure 19C:
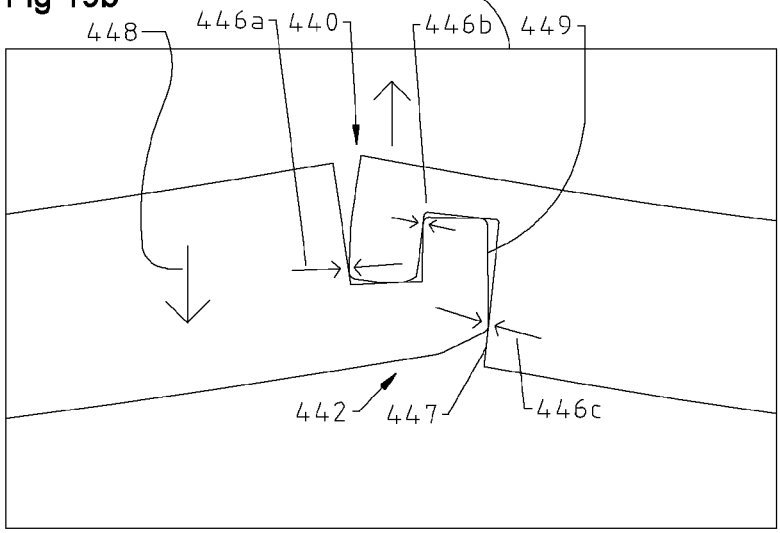

FIG. 19*b* however depicts the scenario when peaking occurs. The peaking may occur for various reasons including: poor manufacturing quality which may arise for example for from use of recycled floor materials or the emission of stabilising layers within the substrate; uneven loading on the surface formed by the panels 10*u*, for example by reason of the dragging of heavy furniture or equipment; thermal expansion in hot weather conditions; or poor quality underlying substrate.

When peaking occurs, the transverse sides of the panels 10*u* which contain the parts 440 and 442 lift up from the underlying substrate. This has the effect of opening up of the hook parts 440 and 442. In turn this substantially compromises the strength of the join created by the engaging parts 440 and 442. The peaking may continue until at least a surface 447 of the part 440 contacts a surface 449 of part 442. Due to the substantial gap between these surfaces when the parts are in their designed engaged juxtaposition shown in FIG. 19*a* the degree of peaking may be relatively substantial. This is illustrated in particular in FIG. 19*c* which depicts that engagement is now essentially only at three spaced apart point locations 446*a*, 446*b* and 446*c*. As a result, the compression forces between the panels 10*u* which generate friction opposing the vertical separation of the parts 440 and 442 is greatly reduced to friction at three contact points 446*a*-446*c*. Thus any downward force now applied to the panel 10*u* having the illustrated female hook part 442 in the downward direction is illustrated by arrow 448 may result in a separation of the entirety of the joint between the panels 10*u*.

Figure 20A:
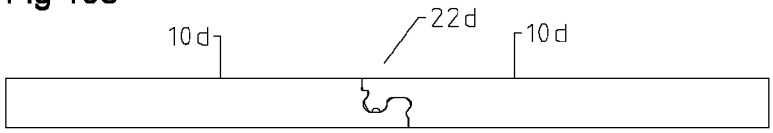
FIGS. 20*a*-20*c* illustrate the phenomenon of peaking of panels made from plastics material having joint systems in accordance with the vertical joint depicted in FIG. 18.
Figure 20B:
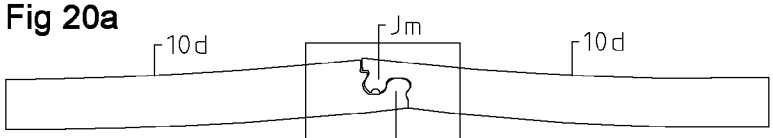
Figure 20C:
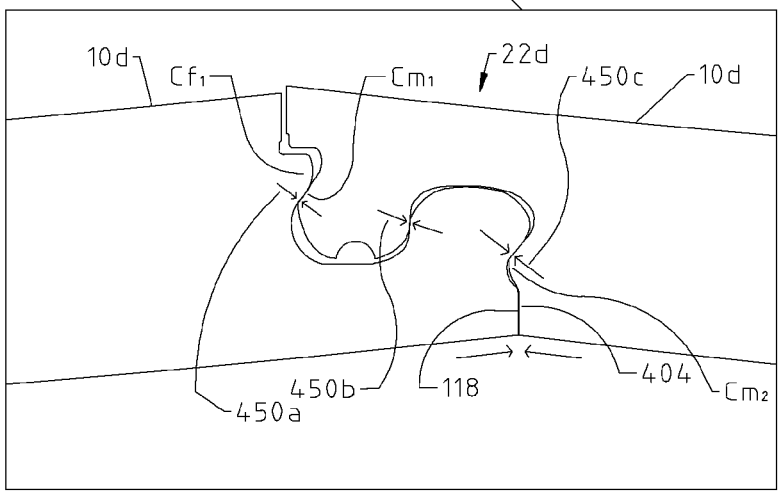

FIGS. 20*a*-20*c* depict a similar scenario where panels 10*d* are connected utilising the joint system 22*d*. Thus FIG. 20*a* depicts the joint panels 10*d* in an ideal situation. FIG. 20*b* depicts the effect of peaking. This is shown in an enlarged form in FIG. 20*c*. The abutment of surfaces 118 and 404 when peaking occurs results in an increase in compression at the locations 450*a*-450*c*. It should be noted however that in particular locations 450*a* and 450*c* a mechanical lock remains due to the overhang of surfaces Cf1 and Cf2 over the surfaces Cm1 and Cm2. Additionally there is now increased pressure between surface 104 and 114. The abutment of the surfaces 118 and 404 at a relatively small degree of rotation between the parts Jm and Jf cause a clamping effect at the locations 450*a*-450*c* so that the joined panels 10*d* maintain very effective grip between each other and substantially reduces any substantive opening of the recesses Rm and Rf. Such an opening may otherwise occur if it were not for the abutment of surfaces 118 and 404 because the panels 10*d* would be able to otherwise rotate further prior to contact.

As a result of the above in order to disengage the joined parts Jm and Jf of system 22*d* in plastics or pliable panels a greater degree of angular offset or rotation between joined panels 10*d* is required than the 7°-10° described in relation to FIGS. 14*a*-14*s*. This is because the properties of the material form which the panel 10*d* is made can accommodate a high degree of angular offset or rotation without causing disengagement. Of course this is a positive feature because it is this that provides the advantages of the system 22*d* over the prior art in terms of unintended disengagement during peaking.

The above described modifications to the in the configuration of the part Jm in the region of the surfaces 118 and 119; and part Jf in the region of surfaces Cm2 and 110 for system 22*a* to arrive at the system 22*b* may also be applied to each of the systems 22, 22*b* and 22*c*.

Referring back to FIG. 2 it is common for surface covering panels to be made with a length to width ratio of about 1:6 to 1:8 (i.e. ratio of length of side 16 to length of side 18). Thus for example a panel with of a length (i.e. side 16) of say 1200 mm may have a width (i.e. side 18) 150 mm (ratio 1:8) to 200 mm (ratio 1:6). In the lay down configuration the tongue and groove system 20 is invariable along the longitudinal sides 16 while the vertical system 22 is along the shorter transverse sides 18. Due to the brick bonding (i.e. staggered) laying pattern the short sides are not, particularly in the prior art, required to provide substantial vertical separation resistance. This resistance being predominately provided by the tongue and groove of system 20 on the longitudinal sides. As such in the prior art vertical resistance can be provided on the short sides by way of say a compression fitting or joint.

Various companies manufacture proprietary clips to provide engagement of flooring panels. The company Välinge licenses a developed clip (known as the "5G" clip) that is inserted into one of the short side and is arranged to engage an opposite short side of another panel. This provides a mechanical joint or engagement that gives very good vertical separation resistance. Such clips can be used in wood based, plastics or composite material panels. Nevertheless the inclusion of this or other types of clips does add to manufacturing costs. The clips can be inserted by a dedicated machine that can be bolted onto one specific manufacture's profiling machine. For manufacturers that use other profiling machines the clips by and large are inserted by hand. Also at times the clips can dislodge during transport of panels and either need to be re-inserted manually at the point of use; or simply left missing thus degrading the quality of the engagement. Another drawback of such clips is that they often become damaged during disengagement of panels.

To provide context to this discussion it is estimated that about 275 million square meters of flooring with this type of clip is manufactured each year. Thus having a joint system, particularly, though not limited to use, for the transverse sides of a lay down surface covering system that avoids the costs of the clip and its insertion as well as being able to be engaged and disengaged multiple time without damage or degradation of quality of the engagement provides massive benefits to manufacturers, retailers and consumers.

The vertical system 22-22*d* provide an integrated (i.e. formed as one piece with the panels 10) mechanical locking system for panels 10. The mechanical locking provided by the overhanging surfaces of parts Jm and Jf enables panels to be manufacture in previously unavailable sizes and configuration such as 1 m×1 m tiles or panels of length to width ratio of less than 1:6 to 1:1; for example 1:5 to 1:1 or 1:4 to 1:1 or 1:2 to 1:1. This is the case even for laydown systems where the joint 22-22*d* is only on two opposed sides (with the tongue and groove on the other two sides).

Embodiments of the above described panels 10 particularly when having joint systems 22-22*d* on all sides (thus forming a true vertical surface covering system) are also well suited to application of a pre-laid re-stickable flexible adhesive to provide the benefits of a direct stick flooring system while avoiding their disadvantages. The expression "re-stickable adhesive" throughout the specification and claims is intended to mean adhesive which is capable of being able to be removed and re-adhered, does not set or cure to a solid rigid mass and maintains long term (e.g. many years) characteristics of flexibility, elasticity and stickiness. The characteristic of being re-stickable is intended to mean that the adhesive when applied to a second surface can be subsequently removed by application of a pulling or shearing force and can subsequently be reapplied (for example up to ten times) without substantive reduction in the strength of the subsequent adhesive bond. Thus the adhesive provides a removable or non-permanent fixing. The characteristics of flexibility and elasticity require that the adhesive does not solidify, harden or cure but rather maintains a degree of flexibility, resilience and elasticity. Such adhesives are generally known as fugitive or "booger" glues and pressure sensitive hot melt glues. Examples of commercially available adhesives which may be incorporated in embodiments of the present invention includes, but are not limited to: SCOTCH-WELD™ Low Melt Gummy Glue; and GLUE DOTS™ from Glue Dots International of Wisconsin.

Others have in the past used glues to adhere flooring panels to an underlying surface or substrate. In particular adhesives have been used to glue wooden floor boards to an underlying surface. However to the best of the inventor's knowledge, all such systems use glues which are specifically designed to set or cure to a solid unyielding bonded layer. In the art of timber or wooden flooring, this is known as "direct stick" flooring. Some have proposed to utilize adhesives which take up to an hour or two to set or cure to enable installers to move the flooring panels during installation to ensure correct alignment. Indeed others propose using adhesives which may take up to 28 days to fully cure or harden.

Some consumers prefer direct stick flooring to floating flooring as it provides a harder more solid feel and significantly does not provide bounce when being walked on and does not generate noise such as creaking or squeaking. A disadvantage however of the direct stick flooring is that it is very messy to apply, and once the adhesive has cured, which it is specifically designed to do, removal and/or repair of one or more damaged panels is problematic. The removal of a direct stick panel generally requires the use of power tools to initially cut through a section of the panel, and then much hard labour in scraping the remainder of the plank and adhesive from the underlying subsurface. This generates substantial dust and noise and of course usually comes at substantial expense due to the associated time required.

Use of the re-stickable adhesive as described hereinabove with the panels 10 provides a semi-floating surface covering system having the benefits of both traditional floating surface coverings and direct stick coverings but without the substantial disadvantages of direct stick surface coverings. Specifically, the use of the re-stickable adhesive eliminates bounce and noise often found with conventional floating flooring, but still provides a degree of cushioning due to the flexible and elastic characteristics of the adhesive which does not set or cure. Further the characteristics of the adhesive also enable movement of panels 10 due to changes in environmental condition such as temperature and humidity. This is not possible with direct stick flooring. Indeed recently, the world market has been having problems with direct sticking of compressed bamboo substrates due to the completely rigid and inflexible bond created by the traditional adhesives. Accordingly, should the compressed bamboo need to move or expand due to variations in environmental conditions it is restricted from doing so by the direct stick adhesive. Consequently it has been suggested by multiple flooring associations around the world that compressed bamboo should not be direct stuck to substrates but limited to application in floating floor systems which enable it to move in response to dynamic seasonal changes.

The benefits and advantages of the use of re-stickable adhesive as herein before described in their own right give rise to a floor covering systems comprising substrates which may be tessellated and on which the adhesive is applied. Such systems do not necessarily require the tongue and groove or vertical joints systems of the type described hereinabove and may also be used with other types of joints systems. Indeed in certain circumstances, it is believed that the re-stickable adhesive concept gives rise to a surface covering system with joint-less substrates. Thus in one embodiment there would be provided a semi-floating surface covering system which comprises a plurality of substrates each substrate having first and second opposite major surfaces, the first major surface arranged to lie parallel to and face a surface to be covered; a quantity of re-stickable adhesive as herein before described bonded to the first major surface; and one or more release strips covering the removal adhesive.

The tackiness/holding strength of adhesive material need only be sufficient to prevent lifting or separation between the panel 10 and from the underlying surface under normal use conditions while enabling removal of a panel if required (for example to repair a floor) with use of a simply tool such as a lever. The idea here is to not hold the panel 10 down so hard that it cannot be removed in one piece and/or without the use of a power tool.

All such modifications and variations together with others that would be obvious to persons of ordinary skill in the art are deemed to be within the scope of the present invention the nature of which is to be determined from the above description and the appended claims.

What is claimed is:

1. A surface covering panel comprising:

a first major surface and an opposite second major surface;

first and second opposite sides that lie between the first and second major surfaces;

a male part that extends along the first side and a female part that extend along the second side, the male and female parts configured to enable two identical panels to connect to each other with the male part of one panel engaging with the female part of a second panel in a manner to resist separation of the connected panels in a plane parallel to the first major surface and in a plane perpendicular to the first major surface;

the female part having: a female recess adjacent the first major surface and a female protrusion spaced from the first major surface by the recess; and an inner most female locking surface on the recess extending from the first major surface to a base of the recess, the recess of the female part having a datum surface lying parallel to the first major surface;

the male part having a male protrusion adjacent the first major surface and a male recess inboard of the protrusion, and an outer most male locking surface on the protrusion extending from the first major surface toward the second major surface, the outer most male locking surface having a planar portion that lies parallel to the first major surface;

the male and female parts further configured so that the when the male and female part of identical panels are engaged, the planar portion of the outer most male locking surface abuts the datum surface, and respective portions of the inner most female locking surface and the outer most male locking surface from the datum surface to the recess base are spaced from each other; and the male and female parts are further relatively configured such that when identical panels are in a joined condition one of the parts overhang the other of the parts about each of: a first locking plane that passes through an outer most side of the male protrusion; and, a second locking plane that passes through an outer most side of the female protrusion, each of the first and second locking planes being perpendicular to the major surfaces.

2. The surface covering panel according to claim 1 wherein the male and female parts form a vertical joint system wherein when first and second identical panels are joined together by the vertical joint system the male part of the first panel is engaged with the female part of the second panel in response to a force applied in an engagement direction which is substantially perpendicular to the major surfaces.

3. The surface covering panel according to claim 1 wherein the male part is provided with an inner most male locking surface on its male recess and the female part is provided with an outermost female locking surface on its male protrusion, the inner most male locking surface and the outermost female locking surface arranged to engage about the second locking plane.

4. The surface covering panel according to claim 1 wherein the outermost female locking surface comprises a convexly curved portion that overhangs a convexly curved portion of the inner most male locking surface.

5. The surface covering panel according to claim 4 wherein the inner most male locking surface and the outermost female locking surface are each provided with a respective planar surface portion located between their respective convexly curved portions and a their respective second major surface, the respective planar surface portions being parallel to each other when male and female parts of two identical panels are in the joined condition and juxtaposed with the first major surfaces parallel to each other.

6. The surface covering panel according to claim 5 wherein the planar surface portion of the inner most male locking surface lies inboard of the convexly curved portion of the inner most male locking surface.

7. The surface covering panel according to claim 6 wherein the planar surface portion of the outer most female locking surface lies inboard of the convexly curved portion of the outer most female locking surface.

8. The surface covering panel according to claim 5 wherein the respective parallel planar surface portions are spaced apart by a distance of between 0.02 mm and 0.2 mm inclusive.

9. The surface covering panel according to claim 1 wherein the male and female parts are further configured to form an upper gap between two connected panels when the second major surfaces of the two panels are coplanar, the upper gap comprising a visible portion that is visible at the first major surfaces of two connected panels and extends both in a direction parallel to the first major surfaces and in a direction from the first surface towards the second major surface and a second contiguous portion that extends from the visible portion to a first contact region between the connected panels, the first contact region comprising the datum surface.

10. The surface covering panel to claim 9 wherein the visible portion of the gap is widest at the first major surfaces of two connected panels and reduces in width in the direction from the first major surface towards the second major surface.

11. The surface covering panel according to claim 9 wherein the gap is configured to prevent a direct line of sight from the first major surface to the first contact region when the gap is viewed from a standing position on the panels.

12. The surface covering panel according to claim 9 wherein the gap follows a path of a configuration such that the direct line of sight impinges a surface of the first or second panel at a location intermediate of the first major surfaces and the first contact region; wherein the visible portion of the gap extends from the first major surface to the intermediate location and the second portion extends from the intermediate location to the first contact region.

13. The surface covering panel according to claim 12 wherein the path comprises a bend at the intermediate a location, wherein the visible portion of the gap extends from the first major surfaces to the bend and the bend prevents the direct line of sight from the first major surface to the first contact region.

14. The surface covering panel according to claim 13 wherein the bend is created by a surface portion one of the male and female parts that overlies a surface portion of the other of the male and female parts in a plane lying perpendicular to the first major surfaces.

15. The surface covering panel according to claim 13 wherein the inner most female locking surface comprises an inner surface having a first surface portion extending from the first major surface at an obtuse included angle, a second contiguous surface portion extending toward the lower major surface at a steeper angle than the first surface portion, and a contiguous third surface portion that extends toward the protrusion of the female part.

16. The surface covering panel according to claim 15 wherein the inner most female locking surface comprises a fourth surface portion that extends between the third surface portion and the first contact region.

17. The surface covering panel according to claim 15 wherein the path is a linear path that is inclined relative at an acute angel relative to the first major surfaces, the acute angle arranged so that a direct line of sight impinges the surface of the first or second panel at the intermediate location, wherein the visible portion of the gap extends from the first major surfaces to the intermediate location and the second portion extends from the intermediate location to the first contact region.

18. The surface covering panel according to claim 9 wherein the upper gap extends to a depth D1 measured perpendicular from the first major surface of a panel wherein: $0.3T \geq D1 \geq 0.1T$, where T is the thickness of the panel measured perpendicular to the first major surface.

19. The surface covering panel according to claim 18 wherein the visible part of the upper gap extends to a depth of between 0.4D1 to 0.8D1.

20. The surface covering panel according to claim 1 wherein the male and female parts are configured so that when two identical panels are connected to each other with the male part of one panel engaging with the female part, and an upward motion is induced on the engaged parts, the male and female parts compress against each other at four spaced locations.

21. A surface covering panel comprising:

a first major surface and an opposite second major surface;

first and second opposite sides that lie between the upper and second major surfaces;

a male part that extends along the first side and a female part that extend along the second side, the male and female parts configured to enable two identical panels to connect to each other with the male part of one panel engaging with the female part of a second panel in a manner to resist separation of the connected panels in a plane parallel to the first major surface and in a plane perpendicular to the first major surface;

the female part having a recess adjacent the first major surface and a protrusion spaced from the first major surface by the recess, and an inner most female locking surface on the recess extending from the first major surface to a base of the recess, the recess of the female part having a datum surface lying parallel to the first major surface;

the male part having a protrusion adjacent the first major surface and a recess inboard of the protrusion, and an outer most male locking surface on the protrusion extending from the first major surface toward the second major surface;

the male and female parts further configured so that the when the male and female part of identical panels are engaged, an intermediate portion of the outer most male locking surface abuts the datum surface, and respective portions of the inner most female locking surface and the outer most male locking surface from the datum surface to the recess base are spaced from each other;

the male and female parts being further configured to form an upper gap between two connected panels when the second major surfaces of the two panels are coplanar, the upper gap comprising a visible portion that is visible at the first major surfaces of two connected panels and extends both in a direction parallel to the first major surfaces and in a direction from the first surface towards the second major surface and a second contiguous portion that extends from the visible portion to a first contact region between the connected panels, the first contact region comprising the datum surface.

22. A surface covering panel comprising:

a first major surface and an opposite second major surface;

first and second opposite sides that lie between the first and second major surfaces;

a male part that extends along the first side and a female part that extend along the second side, the male and female parts configured to enable two identical panels to connect to each other with the male part of one panel engaging with the female part of a second panel in a manner to resist separation of the connected panels in a plane parallel to the first major surface and in a plane perpendicular to the first major surface;

the female part having: a female recess adjacent the first major surface and a female protrusion spaced from the first major surface by the recess; an inner most female locking surface on the recess extending from the first major surface to a base of the recess, the recess of the female part having a datum surface lying parallel to the first major surface; and an outermost female locking surface on its female protrusion;

the male part having: a male protrusion adjacent the first major surface and a male recess inboard of the protrusion; an outer most male locking surface on the protrusion extending from the first major surface toward the second major surface, the outer most male locking surface having a planar portion that lies parallel to the first major surface; and an inner most male locking surface on its male recess;

the male and female parts further configured so that the when the male and female part of identical panels are engaged, the planar portion of the outer most male locking surface abuts the datum surface;

wherein the male and female parts are further relatively configured such that when identical panels are in a joined condition one of the parts overhang the other of the parts about each of: a first locking plane that passes through an outer most side of the male protrusion; and, a second locking plane that passes through an outer most side of the female protrusion, each of the first and second locking planes being perpendicular to the major surfaces; and wherein the inner most male locking surface and the outermost female locking surface are each provided with a respective planar surface portion located between their respective overhanging parts on the second locking plane and their second major surfaces, the respective planar surface portions being parallel to each other and to the first and second locking planes when male and female parts of two identical panels are in the joined condition.

23. The surface covering panel according to claim 22 wherein the outermost female locking surface comprises a convexly curved portion that overhangs a convexly curved portion of the inner most male locking surface.

24. The surface covering panel according to claim 23 wherein the planar surface portion of the inner most male locking surface lies inboard of the convexly curved portion of the inner most male locking surface.

25. The surface covering panel according to claim 24 wherein the planar surface portion of the outer most female locking surface lies inboard of the convexly curved portion of the outer most female locking surface.

26. The surface covering panel according to claim 23 wherein the respective parallel planar surface portions are spaced apart by a distance of between 0.02 mm and 0.2 mm inclusive.

27. The surface covering panel according to claim 22 wherein the male protrusion and the female protrusion are each provided with respective planar surfaces arranged to contact each other when two identical panels are in the joined condition, wherein the respective planar surfaces are located between the first locking plane and the second locking plane.

28. The surface covering panel according to claim 22 wherein the panel is made from plastics or otherwise pliable materials including vinyl, PVC, and pliable plastic composites.

29. The surface covering panel according to claim 22 wherein the male and female parts are configured so that when two identical panels are connected to each other with the male part of one panel engaging with the female part, and an upward motion is induced on the engaged parts, the male and female parts compress against each other at four spaced locations.

* * * * *